US007587257B2

(12) United States Patent
Niimi et al.

(10) Patent No.: US 7,587,257 B2
(45) Date of Patent: Sep. 8, 2009

(54) IMAGE EDITING DEVICE AND PRINT/EMBROIDERY DATA CREATING DEVICE

(75) Inventors: Akiko Niimi, Kasugai (JP); Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1081 days.

(21) Appl. No.: 11/060,710

(22) Filed: Feb. 18, 2005

(65) Prior Publication Data

US 2005/0182508 A1 Aug. 18, 2005

(30) Foreign Application Priority Data

Feb. 18, 2004 (JP) ..... 2004-040938
Feb. 19, 2004 (JP) ..... 2004-043172
Mar. 29, 2004 (JP) ..... 2004-096584

(51) Int. Cl.
*D05C 5/02* (2006.01)

(52) U.S. Cl. ..... 700/138

(58) Field of Classification Search ..... 700/130–133, 700/136–138; 112/78, 102.5, 470.01, 470.06, 112/475.01
See application file for complete search history.

(56) References Cited

U.S. PATENT DOCUMENTS 5,144,899 A * 9/1992 Allen ..... 112/470.06
5,855,176 A * 1/1999 Takenoya et al. ..... 112/102.5
5,877,797 A 3/1999 Miyashita et al.
5,904,108 A * 5/1999 Tanaka et al. ..... 112/102.5
6,158,366 A * 12/2000 Codos ..... 112/470.05
2004/0221783 A1* 11/2004 Niimi ..... 112/475.01

FOREIGN PATENT DOCUMENTS

JP A 5-272046 10/1993
JP A 8-242386 9/1996
JP B2 3100790 8/2000
JP A 2000-343687 12/2000

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

A print/embroidery data creating device is provided with a usable color designating system, an output information setting system, a pixel examining system, an area setting system that sets a pixel area determined to correspond to the usable color as a usable color area and sets an area which does not correspond to the usable color area as a print area, an embroidery data creating system. The usable color area is output with the size set by the output information setting system at the position set by the output information setting system by the embroidering machine, and a print data creating system that creates print data such that a pixel area set as the print area by the area setting system is output as printed area with a color corresponding to the pixel color, the print area being output with the size set by the output information setting system at the position set by the output information setting system by the printer.

10 Claims, 44 Drawing Sheets

FIG.12

| | | |
|---|---|---|
| 41 | [COLOR CHANGE CODE] | C800 |
| 42 | [STITCH CODE] | 180 970 193 975 261 971 376 911 423 ••• |
| 43 | [FEED CODE] | F000 |
| | [STITCH CODE] | 771 581 721 628 705 668 704 683 700 713 ••• |
| | [FEED CODE] | F000 |
| | [STITCH CODE] | 180 970 193 975 261 971 376 911 423 ••• |
| | [FEED CODE] | F000 |
| | [STITCH CODE] | 771 581 721 628 705 668 704 683 700 713 ••• |
| | [FEED CODE] | F000 |
| | [COLOR CHANGE CODE] | C220 |
| | [STITCH CODE] | 970 190 971 145 950 102 916 87 947 ••• |
| | [FEED CODE] | F000 |
| | [STITCH CODE] | 970 190 971 145 950 102 916 87 947 ••• |
| | [FEED CODE] | F000 |
| | | |
| | | |
| 44 | [END CODE] | FFFF |

FIG.15

| | | |
|---|---|---|
| 51 | [P0000] | PRINT AREA DESIGNATION CODE |
| 52 | [X1、Y1、W1、H1] | PRINT AREA (HORIZONTAL START POSITION, VERTICAL START POSITION, WIDTH, HEIGHT) UNIT:INCH |
| 53 | [D000] | RESOLUTION DESIGNATION CODE |
| 54 | [nnn] | UNIT:DPI |
| 55 | [1000] | IMAGE DATA DESIGNATION CODE |
| 56 | [1001] | IMAGE SIZE DESIGNATION CODE |
| 57 | [IW1、IW2] | IMAGE SIZE(WIDTH, HEIGHT) |
| 58 | [1002] | PIXEL DESIGNATION CODE |
| 59 | [R00、G00、B00] | PIXEL VALUES |
| | [R01、G01、B01] | |
| | [R02、G02、B02] | |
| | ⋮ | |
| | [Pmm,Gmm,Bmm] | REPEATED FOR THE SIZE OF $IW_1 \times IW_2$ |
| 60 | [QQQ] | END CODE |

FIG.17A
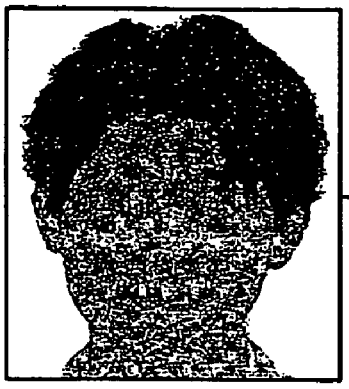
EMBROIDERY DATA
FIG.17B
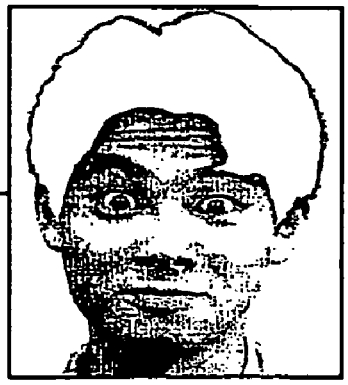
PRINT DATA
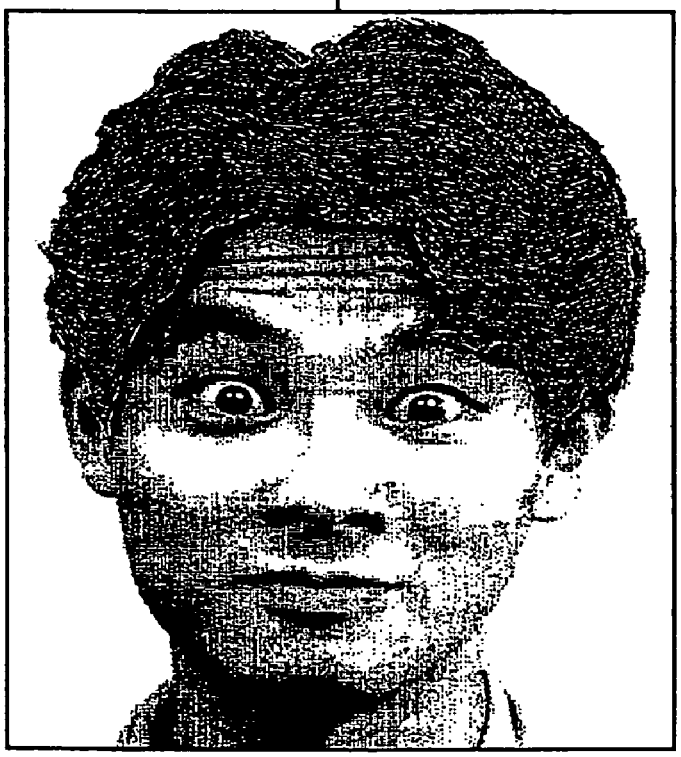
PATTERN EMBROIDERED AND PRINTED
FIG.17C FIG.18A
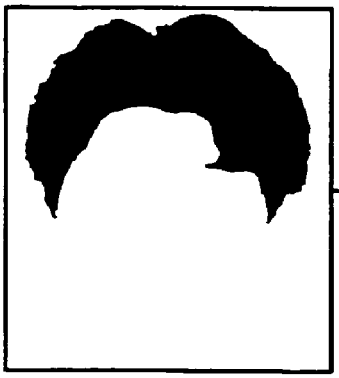
EMBROIDERY DATA
FIG.18B
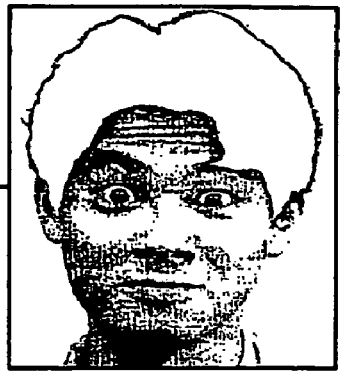
PRINT DATA
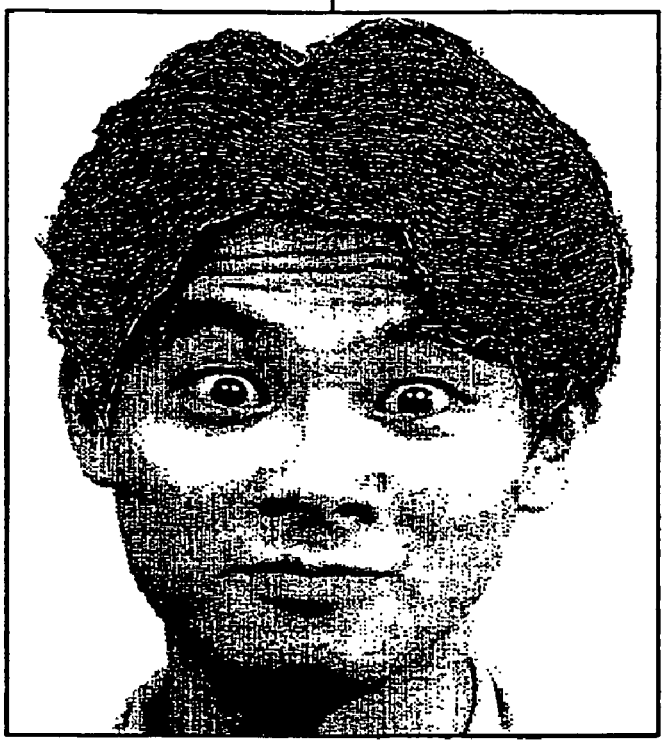
PATTERN EMBROIDERED AND PRINTED
FIG.18C

EMBROIDERY THREADS TABLE

| COLOR CODE | (R,G,B) |
|---|---|
| 001 | (000、000、000) |
| 002 | (255、000、000) |
| 003 | (000、255、000) |
| 004 | (000、000、255) |
| 005 | (255、255、000) |
| ⋮ | ⋮ |

FIG.33A
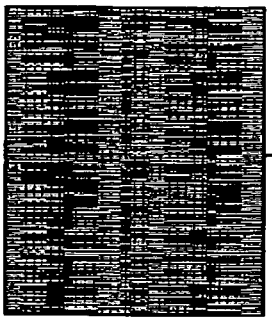
EMBROIDERY DATA
FIG.33B
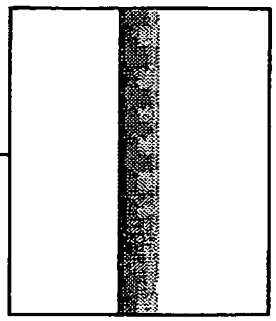
PRINT DATA
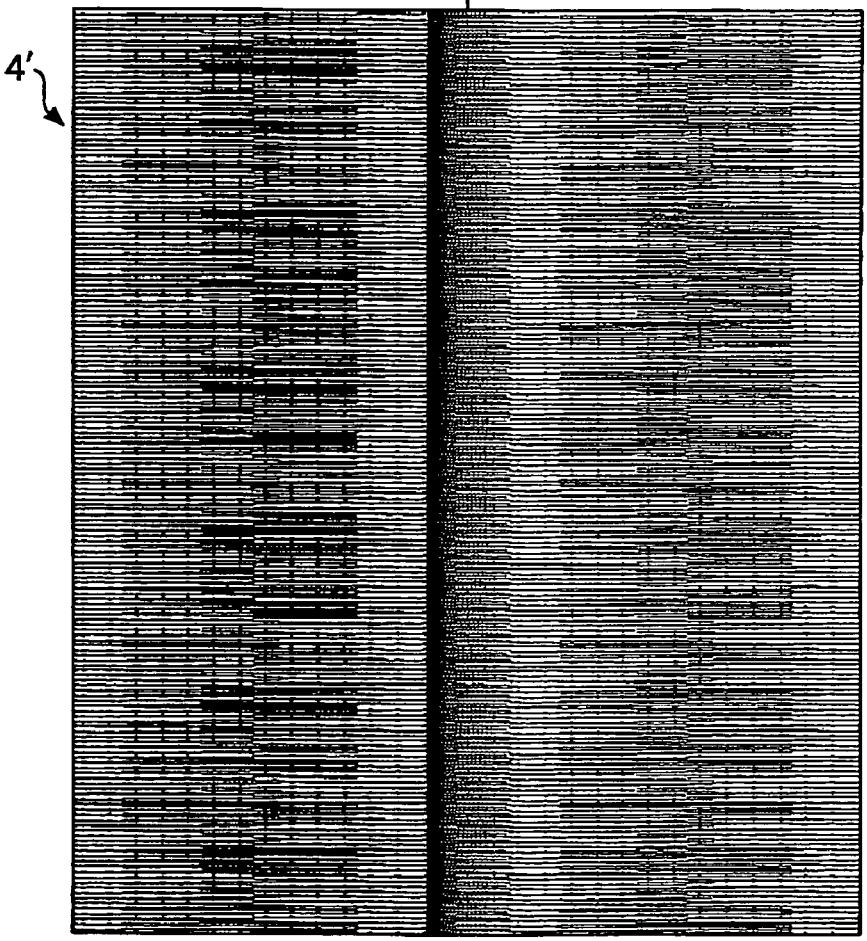
OUTPUT PATTERN
FIG.33C FIG.34A
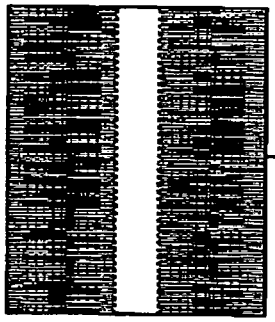
EMBROIDERY DATA
FIG.34B
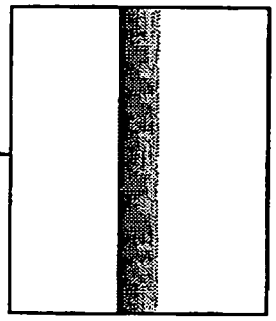
PRINT DATA
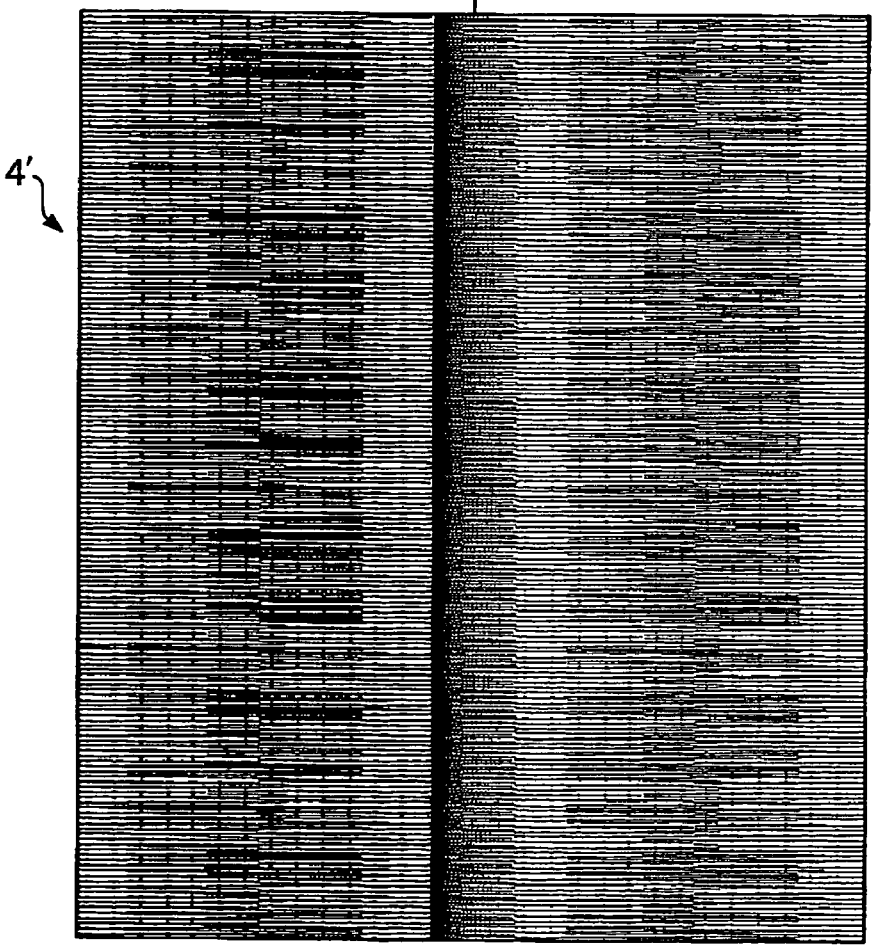
OUTPUT PATTERN
FIG.34C

FIG.35

72

| 7221 LEVEL | 7222 INPUT RGB | 7223 OUTPUT CMYK |
|---|---|---|
| LEVEL 5 | 255,0,0 | 7,100,96,0 |
| | 196,0,0 | 20,90,90,7 |
| | 126,255,0 | 49,0,97,0 |
| | : | : |
| LEVEL 4 | 255,0,0 | 4,97,94,0 |
| | 196,0,0 | 16,86,86,6 |
| | 126,255,0 | 46,0,93,0 |
| | : | : |
| LEVEL 3 | 255,0,0 | 3,80,74,0 |
| | 196,0,0 | 10,78,77,5 |
| | 126,255,0 | 30,0,80,0 |
| | : | : |
| LEVEL 2 | 255,0,0 | 3,72,66,0 |
| | 196,0,0 | 5,70,68,5 |
| | 126,255,0 | 22,0,65,0 |
| | : | : |
| LEVEL 1 | 255,0,0 | 2,50,45,0 |
| | 196,0,0 | 5,45,45,3 |
| | 126,255,0 | 20,0,48,0 |
| | : | : |

IMAGE EDITING DEVICE AND PRINT/EMBROIDERY DATA CREATING DEVICE

INCORPORATION BY REFERENCE

This application claims priority from Japanese Patent Applications No. 2004-040938, filed on Feb. 18, 2004, and No. 2004-043172, filed on Feb. 19, 2004, No. 2004-096584, filed on Mar. 29, 2004, the entire subject matters of the applications are incorporated herein by reference thereto.

BACKGROUND OF THE INVENTION

The present invention relates to an image editing device capable of creating print data, and a print/embroidery data creating method, device and a printing/embroidering system that create print/embroidery data.

Conventionally, there has been known a printing system that prints, in accordance with image data representing people, animals, sceneries and the like, an image pattern on a fabric such as a T-shirt with, for example, an inkjet printer. On the other hand, there has also been know an embroidering system that embroiders, in accordance with the image data, an image pattern on a fabric such as the T-shirt with, for example, an embroidering machine.

Printing of an image on the fabric and embroidering of an image on the fabric are often combined such that, for example, an image is embroidered on a T-shirt, and then, another image is printed on the embroidered image pattern. For this purpose, it is necessary to prepare print data for the printer, and embroidery data for the embroidering machine.

When the print data and the embroidery data are created independently, the resultant images of printing and embroidering do not have consistency therebetween in their positions and sizes. Conventionally, the adjustment is done by the user, which depends on the skill of the user. Such an adjustment should be done manually, and accordingly, it is troublesome and heavy burden to the user.

Japanese Patent Provisional Publication No. HEI 5-272046 discloses an embroidering machine equipped with a printer. With this embroidering machine, either the printing operation or embroidering operation can be executed easily, without replacing the fabric between the embroidering machine and the printer. According to the disclosed embroidering machine a combination pattern of printed image and embroidery can be formed on the fabric accurately. Further, according to the embroidering machine, threads of an embroidery that is formed by the embroidering machine can be colored with the printer equipped to the embroidering machine.

Even in the embroidering machine equipped with the printer as described above, the print data and the embroidery data are created according to a conventional method, i.e., created independently, based on the same image data. Since the fabric need not be replaced, the printed image and the embroidered image do not shift from each other. However, since the embroidery data and print data may not have consistency in position and size, even if a mechanical adjustment is accurate, there still remains some errors in position and/or size of the output images (i.e., printed/embroidered patterns). Therefore, even if the embroidering machine disclosed in Japanese Patent Provisional Publication No. HEI 5-272046 is used, the user is still required to adjust the position and/or size of the images, which is a troublesome and time-consuming job for the operator.

Further to the above, there is a case in which an image is printed on an embroidery. In such a case, a further problem may arise.

When an image is printed on a paper with an inkjet printer, permeability of ink of the paper is considered to be substantially even over the surface of the paper. When an image is printed on the fabric, the permeability differs may be different from that of the paper. Further, depending on the type of the fabric, the permeability may also be different. Therefore, in order to maintain the image quality, the ink ejection amount should be adjusted in accordance with the type of the fabric.

For example, Japanese Patent Publication No. 3100790 discloses an image recording device which contains a plurality of tables defining a relationship between the data corresponding to the darkness (thickness density) and the number of recording dots for a plurality of types of fabrics. When an image is printed on a fabric, one of the plurality of tables is selected corresponding to the type of the fabric, and obtains the number of recording dots corresponding to the value of the image data representing the thickness density. Then, based on the thus obtained data, a recording head is driven to form a gradation image on the fabric.

Japanese Patent Provisional Publication No. P2000-343687A discloses a printing device and a printing method that control a printing operation such that, for recording mediums having a variety of ink fixing property, a main scanning is performed with controlling an inkjet head standby time in accordance with information on the ink fixability. With this control, it is ensured that ink dots are formed and fixed. It should be noted that, as the information related to the ink fixability, information regarding the permeability of the ink for respective objects is used.

Japanese Patent Provisional Publication No. HEI 8-242386 also discloses an inkjet printer and an inkjet printing method. In this publication, when a printing operation is executed for fabrics of a plurality of types of fibers, image processing parameters are determined based on the image processing parameters of respective fibers and the composition ratio of the plurality of types of fibers so that the optimum coloring property is obtained for each type of fiber.

As described above, the devices and methods in the above-described publications, an appropriate printing operation is performed in accordance with the type of the material (fiber). It should be noted that, in each of the publications described above, it is assumed that, the property of the fabric remains unchanged during each printing operation. There are cases where the fabric contains weaving portions, embroidered portions or patch work portions, and thus, contains portions having different properties in terms of the ink permeability. The above-described publications cannot deal with a printing operation with respect to a fabric including a plurality of areas having different permeability.

SUMMARY OF THE INVENTION

The present invention is advantageous in that, when an image pattern represented by image data is printed and embroidered on a fabric, a part of the image pattern suitable to be embroidered and a part suitable to be printed are automatically determined and the print data and embroidery data are created with consistency regarding the position and size of the image therebetween. Further, it is possible that the print data and embroidery data are combined to a single piece of data.

The present invention is also advantageous in that the ink ejection amount can be controlled appropriately even when an object surface, on which an image is formed, has a plurality of areas respectively having different ink permeability characteristics.

According to an aspect of the invention, there is provided a print/embroidery data creating device that creates print/embroidery data from image data which is a collection of a plurality of pixels, the print/embroidery data being printed by a printer and embroidered by an embroidering machine. The print/embroidery data creating device is provided with a usable color designating system that allows a user to designate at least one usable color, an output information setting system that allows the user to set an output size and an output position of each of an embroidery of the embroidery data formed by the embroidering machine and a printout of the print data formed by the printer, a pixel examining system that examines whether each pixel of the image data corresponds to the usable color, an area setting system that sets a pixel area, which is a collection of pixels, determined to correspond to the usable color as a usable color area and sets an area which does not correspond to the usable color area as a print area, an embroidery data creating system that creates embroidery data such that a pixel area set as the usable color area by the area setting system is output as embroidered with a thread having a color corresponding to the usable color, the usable color area being output with the size set by the output information setting system at the position set by the output information setting system by the embroidering machine, and a print data creating system that creates print data such that a pixel area set as the print area by the area setting system is output as printed area with a color corresponding to the pixel color, the print area being output with the size set by the output information setting system at the position set by the output information setting system by the printer.

Optionally, the print/embroidery data creating device may further include a print/embroidery data creating system that creates print/embroidering data including both the print data and embroidering data.

Further, a ratio of a size of the image data in units of pixel to a measurable size of an embroidery formed by the embroidering machine is equal to a ratio of a size of the image data in units of pixel to a measurable size of a printout formed by the printing device.

Furthermore, the embroidery data may include information indicating color code of each thread and position and size of the embroidery the embroidery data represents, and stitch data indicating stitches for expressing the specific area.

Still optionally, the print data may include a pixel area of the image data which has been set as the print area, and position and size of a printout.

Optionally, the embroidery data creating system may create second embroidery data based on a pixel area that has been set as the print area by the area setting system.

Further, the second embroidery data may include a color code for white thread, size and position of an embroidery, and stitch data indicating needle fall points of the embroidering machine to express the print area with an embroidery.

The print/embroidery data creating device may further include a thread table storing a relationship between a plurality of embroidery thread and color codes thereof. The usable color designating system may designate one of the colors corresponding to the codes stored in the thread table as the usable color.

Further optionally, the pixel examining system may determine that a pixel corresponds to the usable color when a distance of the color of the pixel and the usable color in a certain color space is smaller than a predetermined threshold value.

According to a further aspect of the invention, there is provided a computer program product comprising computer accessible instructions that cause a computer to serve as a print/embroidery data creating device that creates print/embroidery data from image data which is a collection of a plurality of pixels, the print/embroidery data being printed/embroidered by printer/embroidering machine. The print/embroidery data creating device may include a usable color designating system that allows a user to designate at least one usable color, an output information setting system that allows the user to set an output size and an output position of each of an embroidery of the embroidery data formed by the embroidering machine and a printout of the print data formed by the printer, a pixel examining system that examines whether each pixel of the image data corresponds to the usable color, an area setting system that sets a pixel area, which is a collection of pixels, determined to correspond to the usable color as a usable color area and sets an area which does not correspond to the usable color area as a print area, an embroidery data creating system that creates embroidery data such that a pixel area set as the usable color area by the area setting system is output as embroidered with a thread having a color corresponding to the usable color, the usable color area being output with the size set by the output information setting system at the position set by the output information setting system by the embroidering machine, and a print data creating system that creates print data such that a pixel area set as the print area by the area setting system is output as printed area with a color corresponding to the pixel color, the print area being output with the size set by the output information setting system at the position set by the output information setting system by the printer.

According to a furthermore aspect of the invention, there is provided a method of creating print/embroidery data from image data, the print/embroidery data being printed/embroidered by a printer and an embroidering machine, the method including the steps of designating at least one usable color, first setting an output size and an output position of each of an embroidery of the embroidery data formed by the embroidering machine and a printout of the print data formed by the printer, judging whether each pixel of the image data corresponds to the usable color, second setting a pixel area, which is a collection of pixels, determined to correspond to the usable color as a usable color area and sets an area which does not correspond to the usable color area as a print area, creating embroidery data such that a pixel area set as the usable color area is embroidered with a thread having a color corresponding to the usable color, the usable color area being output with the size set by the first setting step at the position set by the first setting step, and creating print data such that a pixel area set as the print area by the second setting step is output as printed area with a color corresponding to the pixel color, the print area being output with the size set by first setting step at the position set by the first setting step.

According to another aspect of the invention, there is provided a structure of print/embroidery data, which includes embroidery data which is read by an embroidering machine that forms an embroidery on an object, the embroidery data corresponding to an output size and an output position on the object, and print data which is read by a printing device that forms a printed image on the object, the print data corresponding to the output size and the output position on the object.

Optionally, a ratio of a size of the image data in units of pixel to a measurable size of an embroidery formed by the embroidering machine is equal to a ratio of a size of the image data in units of pixel to a measurable size of a printout formed by the printing device.

Further, the embroidery data may be configured to include information indicating color code of each thread and position and size of the embroidery the embroidery data represents, an d stitch data indicating stitches for expressing the specific area.

Furthermore, the print data may be configured to include a pixel area of the image data which has been set as the print area, and position and size of a printout.

According to a further aspect of the invention, there is provided a print/embroidery data creating device that creates print/embroidery data from image data which is a collection of a plurality of pixels, the print/embroidery data being printed by a printer and embroidered by an embroidering machine. The print/embroidery data creating device includes a usable color designating system that allows a user to designate at least one usable color of at least one thread, an output information setting system that allows the user to set an output size and an output position of each of an embroidery of the embroidery data formed by the embroidering machine and a printout of the print data formed by the printer, a stitch data setting system that sets stitch data constituting an embroidery pattern, a minute area setting system that sets a line segment constituting an expressive portion of a stitch of the stitch data as a minute area of the image data, a judging system that judges whether at least one pixel included in the minute area set by the minute area setting system corresponds to the usable color, an area setting system that sets the minute area as the embroidery area if the judging system determines that the at least one pixel included in the minute area corresponds to the usable color, the area setting system setting the minute area as the print area if the judging system determines that the at least one pixel included in the minute area does not correspond to the usable color, an embroidery data creating system that creates embroidery data such that each minute area determined as the embroidery area by the area setting system is output as embroidered with a thread having a color corresponding to the usable color, the minute area being output with the size set by the output information setting system at the position set by the output information setting system by the embroidering machine, and a print data creating system that creates print data such that each minute area determined as the print area by the area setting system is output as a printout with a color corresponding to the pixel color, the minute area being output with the size set by the output information setting system at the position set by the output information setting system by the printer.

Optionally, the area setting system may set the minute area as the embroidery area if the pixel examining system determines that a predetermined portion or more of at least one pixel included in the minute area corresponds to the usable color.

Further optionally, the area setting system may set the minute area as the embroidery area if a color of a pixel corresponding to the start of the stitch corresponds to one of the usable colors, and if the pixel examining system determines that a predetermined portion or more of at least one pixel included in the minute area corresponds to the usable color.

Still optionally, the stitch data setting system may include a stitch data reading system that reads preliminarily prepared stitch data.

Further, the area setting system may set a part of the image data excluding all of the minute areas as the print areas.

Optionally, the embroidery data creating system may create second embroidery data from the minute areas set as the print areas by the area setting system.

Furthermore, the pixel examining system may determine that a pixel corresponds to the usable color if a distance between the color of the pixel and the color of the usable color in a predetermined color space is greater than a predetermined threshold value.

Optionally, the print/embroidery data creating device may further include a print/embroidery data creating system that creates print/embroidery data containing the print data and the embroidery data in a related manner.

According to another aspect of the invention, there is provided a method of creating print/embroidery data from image data, the print/embroidery data being printed/embroidered by a printer and an embroidering machine. The method includes the steps of designating at least one usable color of at least one thread, setting an output size and an output position of each of an embroidery of the embroidery data formed by the embroidering machine and a printout of the print data formed by the printer, setting stitch data constituting an embroidery pattern, setting a line segment constituting an expressive portion of a stitch of the stitch data as a minute area of the image data, judging whether at least one pixel included in the minute area set by the minute area setting system corresponds to the usable color, setting the minute area as the embroidery area if the at least one pixel included in the minute area corresponds to the usable color, otherwise setting the minute area as the print area if the at least one pixel included in the minute area does not correspond to the usable color, creating embroidery data such that each minute area is output as embroidered with a thread having a color corresponding to the usable color, the minute area being output with the size at the position as set, and creating print data such that each minute area is output as a printout with a color corresponding to the pixel color, the minute area being output with the size at the position as set.

According to a further aspect of the invention, there is provided a computer program product comprising computer accessible instructions that cause a computer to serve as a print/embroidery data creating device that creates print/embroidery data from image data which is a collection of a plurality of pixels, the print/embroidery data being printed/embroidered by printer/embroidering machine. The instructions realizes the method described above. In other words, with the method, the computer serves as the print/embroidery data creating device which includes a usable color designating system that allows a user to designate at least one usable color of at least one thread, an output information setting system that allows the user to set an output size and an output position of each of an embroidery of the embroidery data formed by the embroidering machine and a printout of the print data formed by the printer, a stitch data setting system that sets stitch data constituting an embroidery pattern, a minute area setting system that sets a line segment constituting an expressive portion of a stitch of the stitch data as a minute area of the image data, a judging system that judges whether at least one pixel included in the minute area set by the minute area setting system corresponds to the usable color, an area setting system that sets the minute area as the embroidery area if the judging system determines that the at least one pixel included in the minute area corresponds to the usable color, the area setting system setting the minute area as the print area if the judging system determines that the at least one pixel included in the minute area does not correspond to the usable color, an embroidery data creating system that creates embroidery data such that each minute area determined as the embroidery area by the area setting system is output as embroidered with a thread having a color corresponding to the usable color, the minute area being output with the size set by the output information setting system at the position set by the output information setting system by the embroidering machine, and a print data creating system that creates print data such that each minute area determined as the print area by the area setting system is output as a printout with a color corresponding to the pixel color, the minute area being output with the size set by the output information setting system at the position set by the output information setting system by the printer.

According to another aspect of the invention, there is provided an image editing device capable of creating print data for an inkjet printer that ejects ink drops from an inkjet head to a fabric to print an image thereon. The image editing device is provided with a display device that displays image data input to the image editing device, an area designating system that allows a user to designate a specific area of the input image data displayed on the display device, an ejection amount designating system that allows the user to designate an ejection amount of ink, which is ejected from the inkjet head, corresponding to the specific area designated by the user, an ejection amount storing system that stores the ejection amount of ink designated by the ejection amount designating system, and a print data creating system that creates print data for the specific area based on the ejection amount of ink stored in the ejection amount storing system.

Optionally, the fabric may include a plurality of areas respectively having different permeability, and the area designating system designates a portion of the input image corresponding to one of the plurality of areas as the specific area.

Further optionally, the plurality of areas have different types of material, respectively. Alternatively or optionally, the plurality of areas may have different surface conditions, respectively.

Further, the image editing device may include a reading system that reads a surface of the fabric as captured image data, and a display controlling system that displays the captured image data read with the reading system on the display device together with the input image in an overlapped manner. The area designating system may allow the user to refer to the captured image data when the specific area is designated.

Still optionally, the image editing device may include an embroidery data creating system that creates embroidery data which is used by an embroidering machine to form an image pattern on the fabric. The area designating system may allow the user to designate an area of the input image data corresponding to the embroidery data created by the embroidery data creating system.

Further, the image editing device may include a color conversion table storing system that stores a plurality of color conversion tables corresponding to ink ejection amounts through the inkjet head, and a selecting system that selects one of the color conversion tables stored in the color conversion table storing area, the one of the color conversion tables corresponding to the ink ejection amount designated by the ink ejection amount designating system.

According to another aspect of the invention, there is provided a method of creating print data for an inkjet printer that ejects ink drops from an inkjet head to a fabric to print an image thereon. The method includes the steps of displaying input image data, first designating a specific area of the input image data displayed on the display device, second designating an ejection amount of ink, which is ejected from the inkjet head, corresponding to the specific area designated in the first designating step, storing the ejection amount of ink designated in the second designating step, and creating the print data for the specific area based on the ejection amount of ink stored in the storing step.

Optionally, the fabric may include a plurality of areas respectively having different permeability, and the first designating step designates a portion of the input image corresponding to one of the plurality of areas as the specific area.

Still optionally, the plurality of areas have different types of material, respectively.

Further, the plurality of areas may have different surface conditions, respectively.

Further optionally, the image editing method may further includes the steps of reading a surface of the fabric as captured image data, and displaying the captured image data read with the reading system on the display device together with the input image in an overlapped manner, The first designating step may refer to the captured image data when designating the specific area.

The image editing method may further include a step of creating embroidery data which is used by an embroidering machine to form an image pattern on the fabric. The first designating step may designate an area of the input image data corresponding to the embroidery data created by the embroidery data creating system.

Further, the image editing method may include the steps of storing a plurality of color conversion tables corresponding to ink ejection amounts through the inkjet head, and selecting one of the color conversion tables stored in the color conversion table storing steps, the one of the color conversion tables corresponding to the ink ejection amount designated second designating step.

According to a further aspect of the invention, there is provided a computer program product comprising computer accessible instructions that cause a computer to execute a method of creating print data for an inkjet printer that ejects ink drops from an inkjet head to a fabric to print an image thereon, the instructions comprising displaying input image data, first designating a specific area of the input image data displayed on the display device, second designating an ejection amount of ink, which is ejected from the inkjet head, corresponding to the specific area designated in the first designating step, storing the ejection amount of ink designated in the second designating step, and creating the print data for the specific area based on the ejection amount of ink stored in the storing step.

BRIEF DESCRIPTION OF THE ACCOMPANYING DRAWINGS

Figure 1:
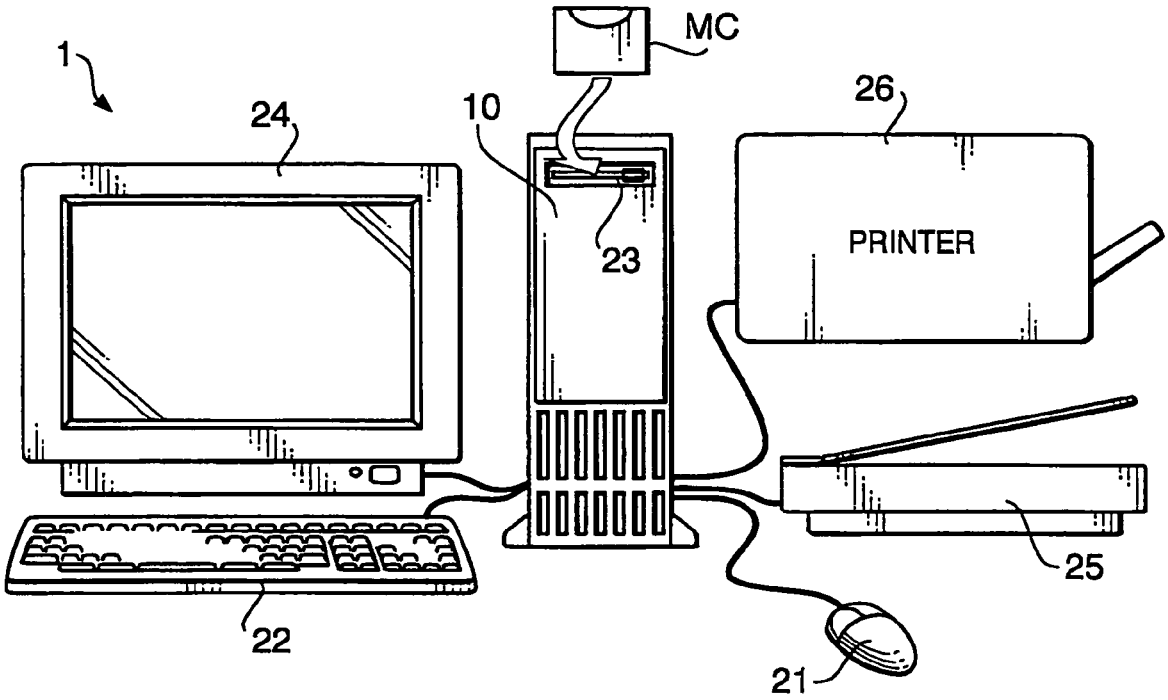
FIG. 1 shows a system configuration of a print/embroidery data creating device to according to the present invention.
Figure 3:
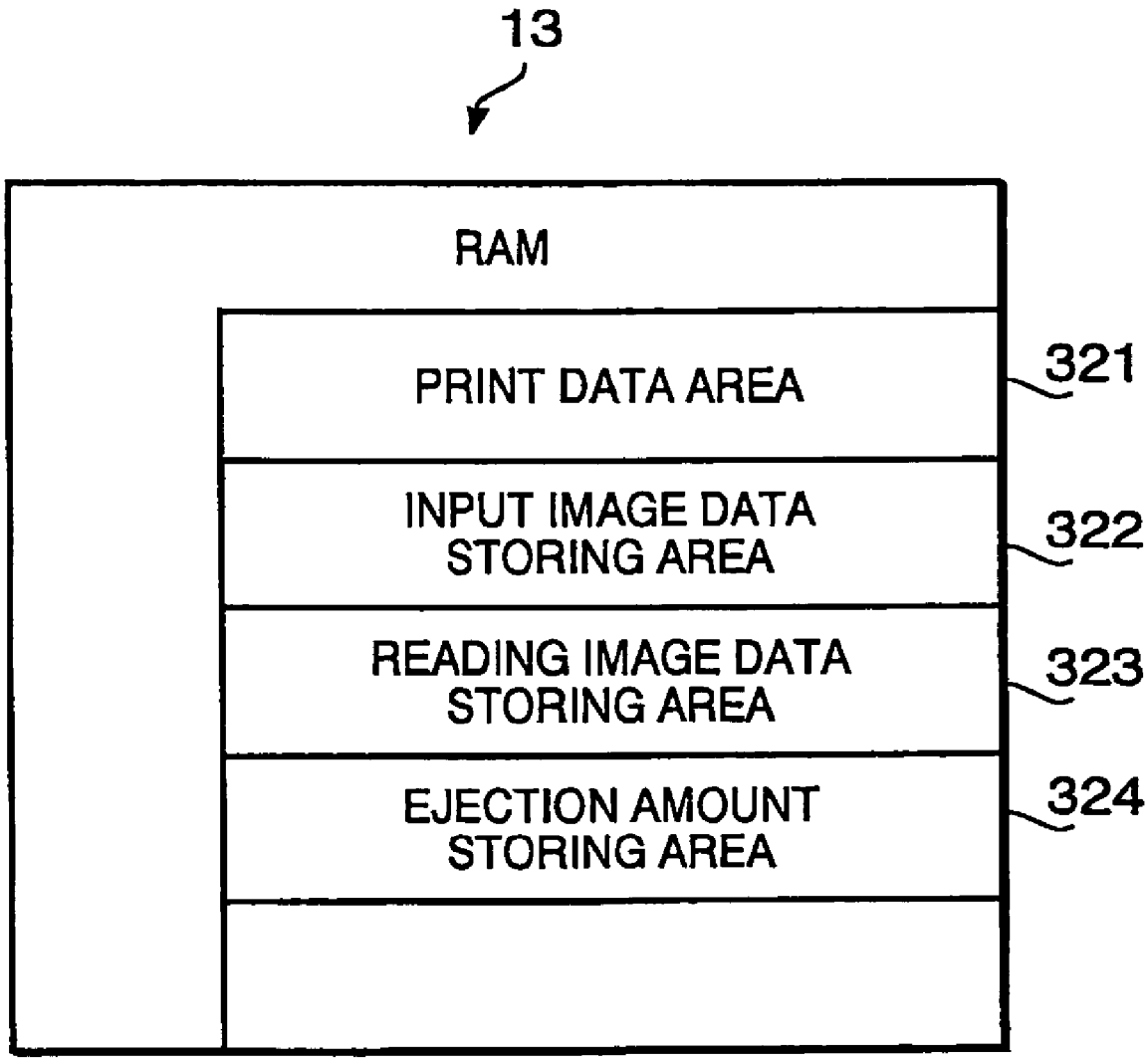
Figure 4:
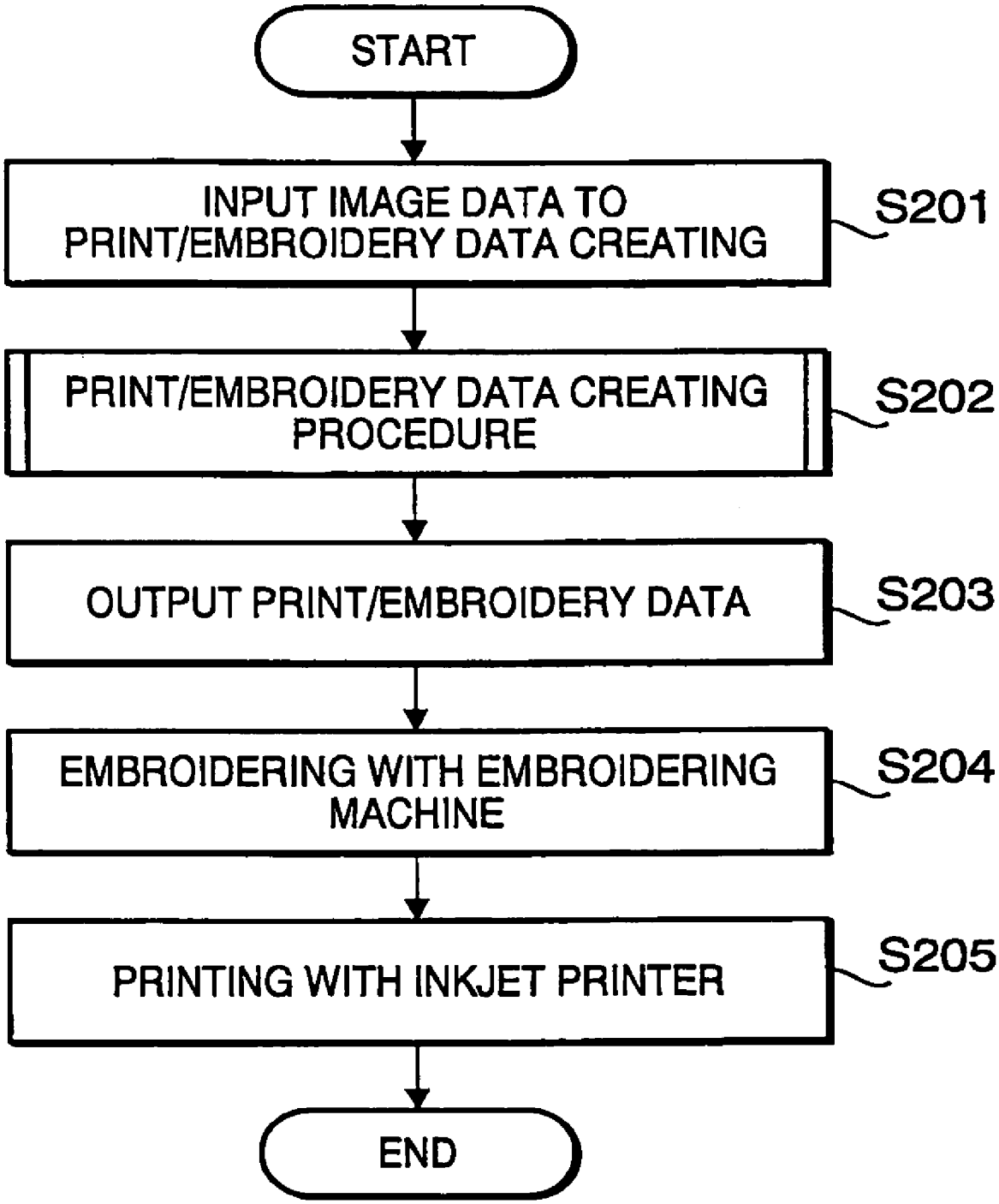
Figure 5:
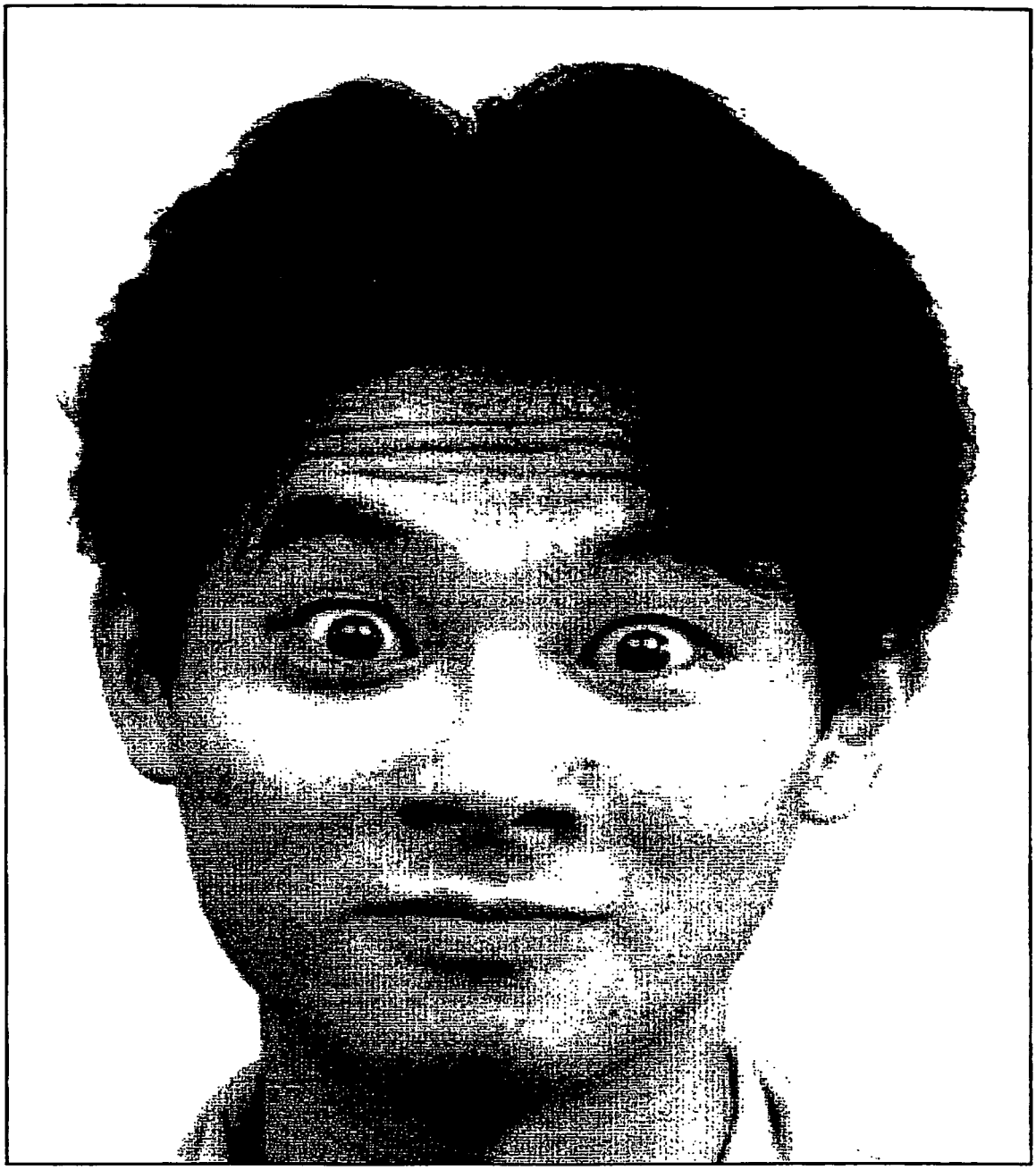
Figure 6:
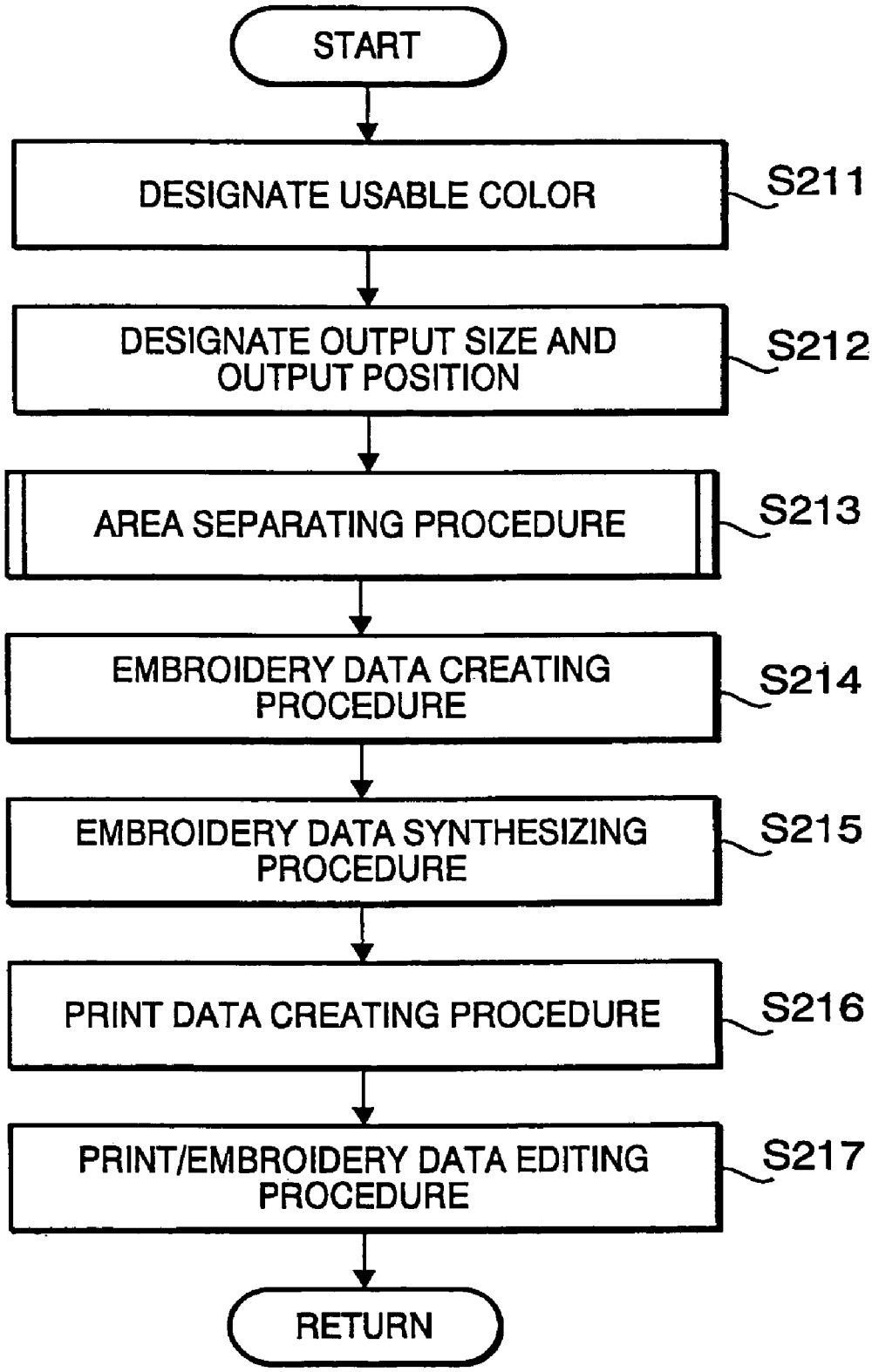
Figure 7:
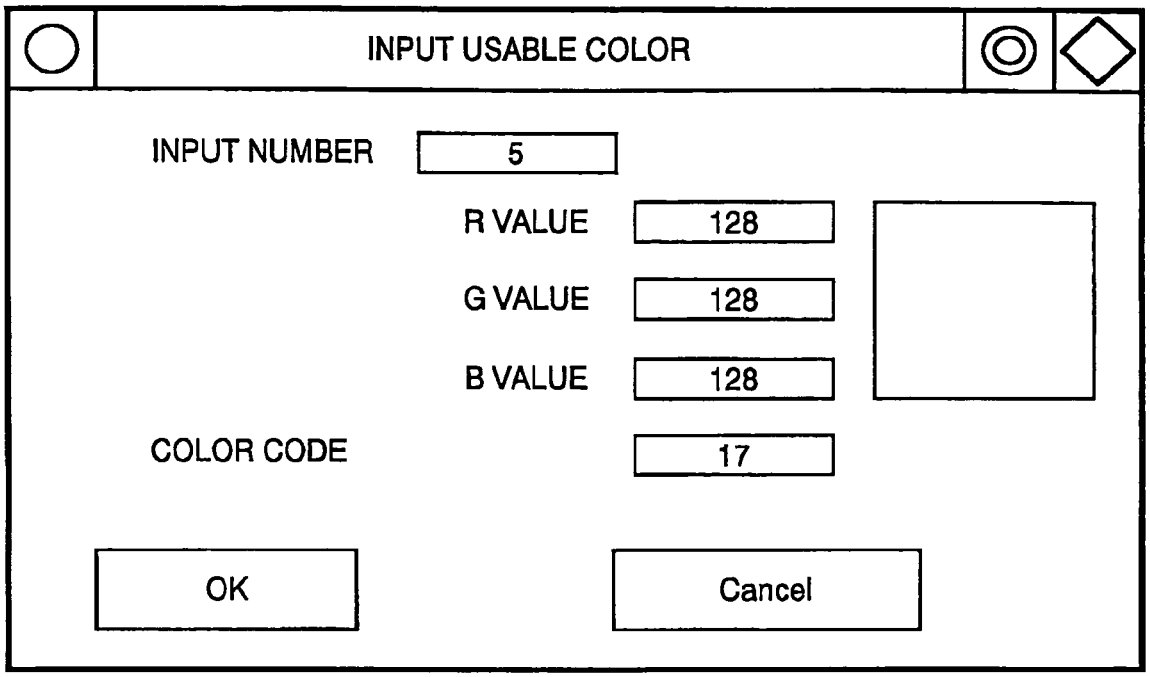
Figure 8:
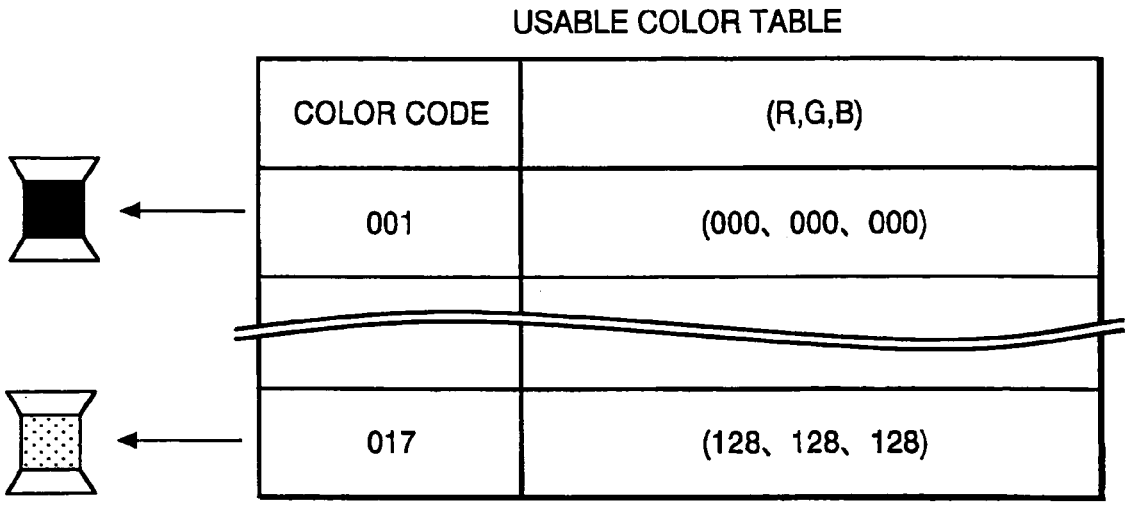
Figure 9:
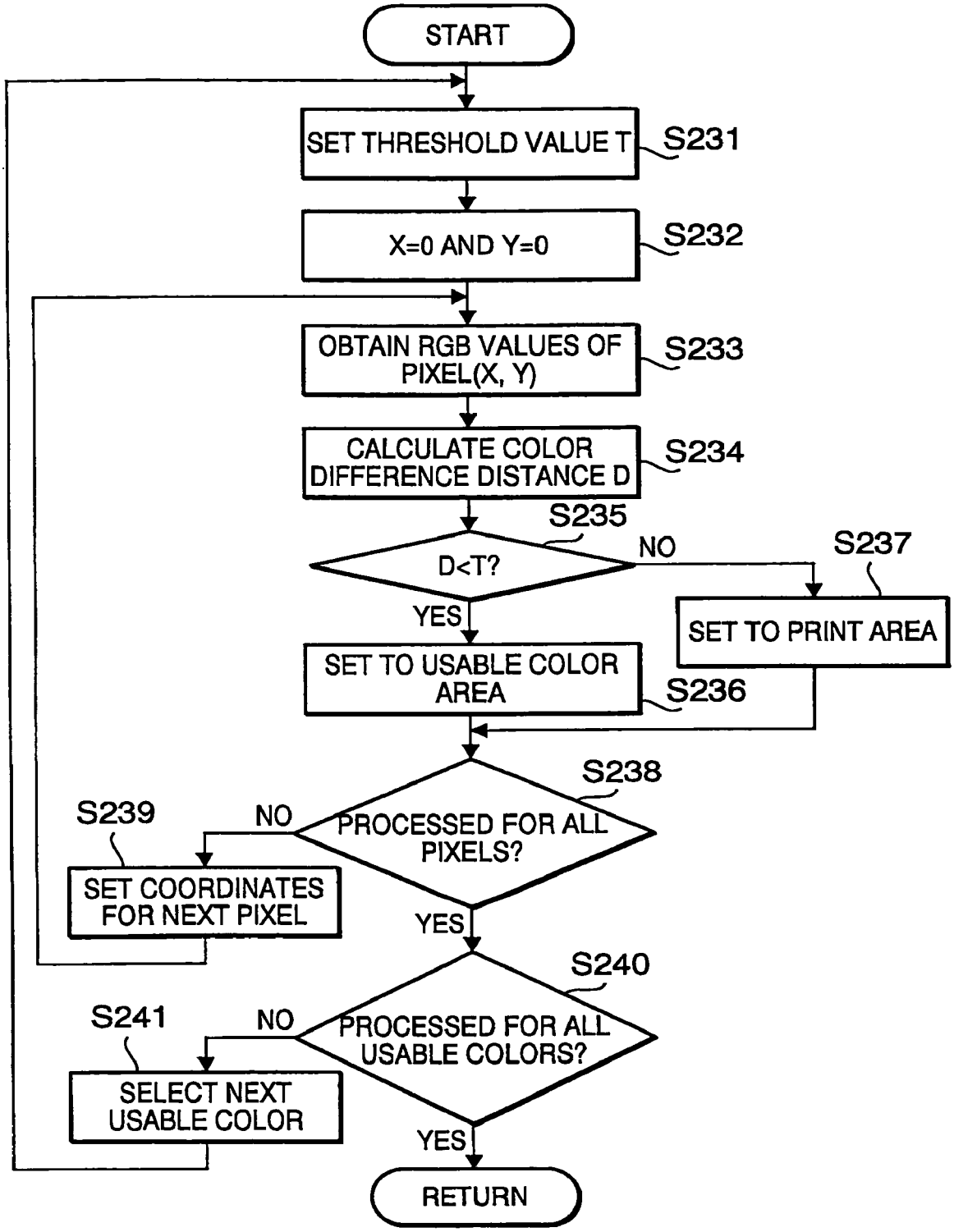
Figure 10A:
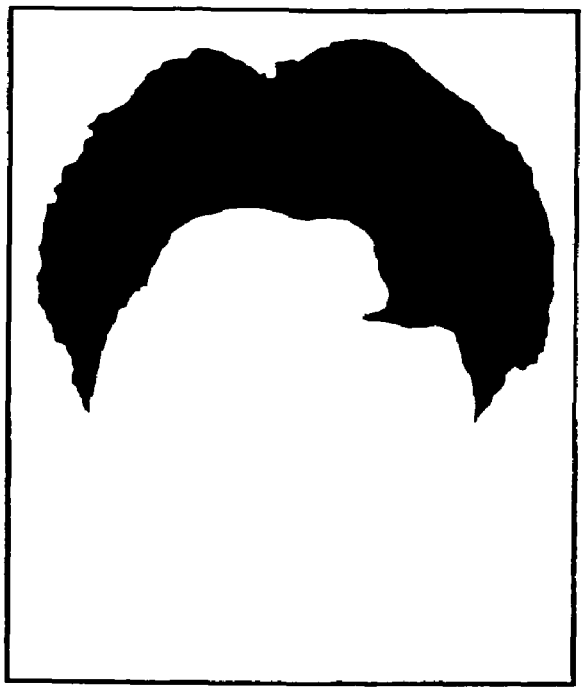
Figure 10B:
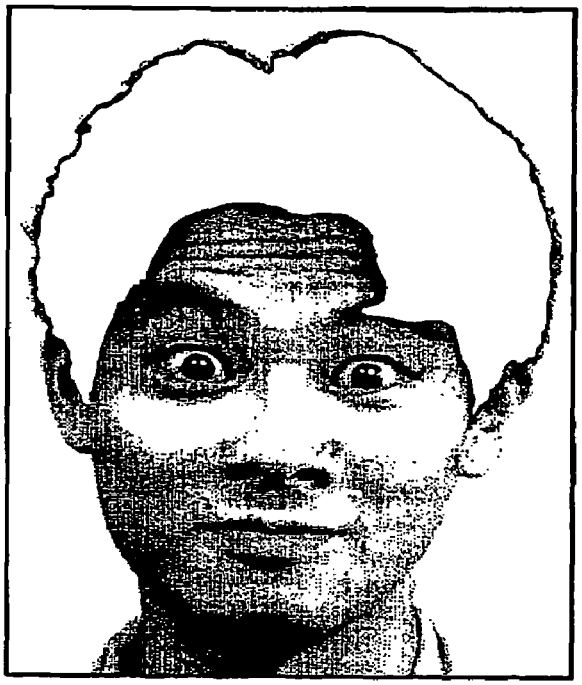
Figure 11A:
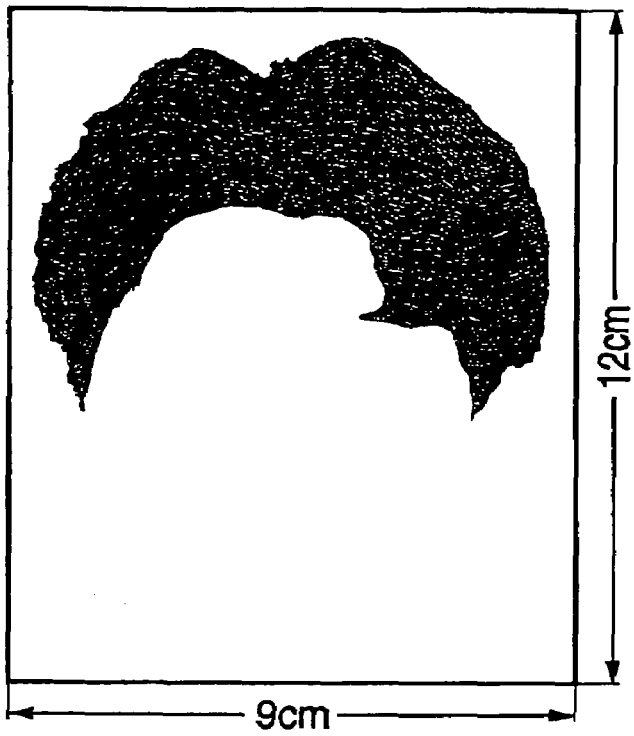
Figure 11B:
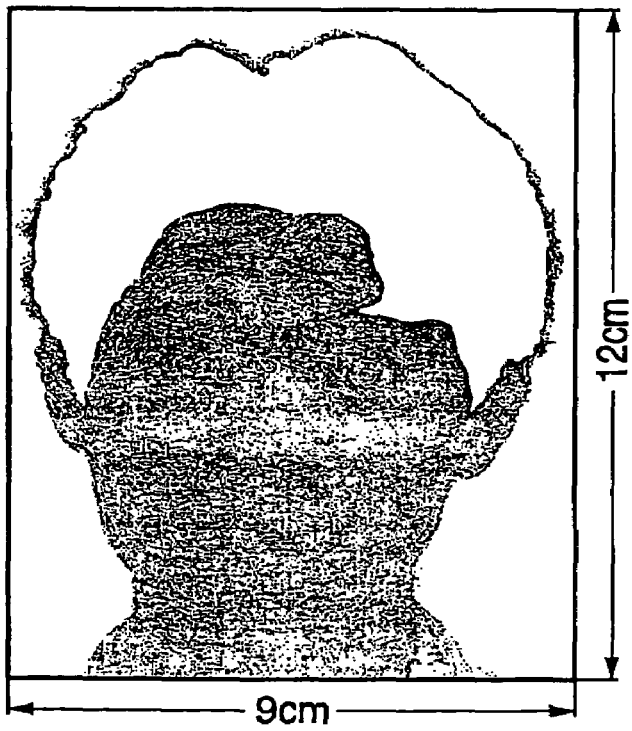
Figure 13:
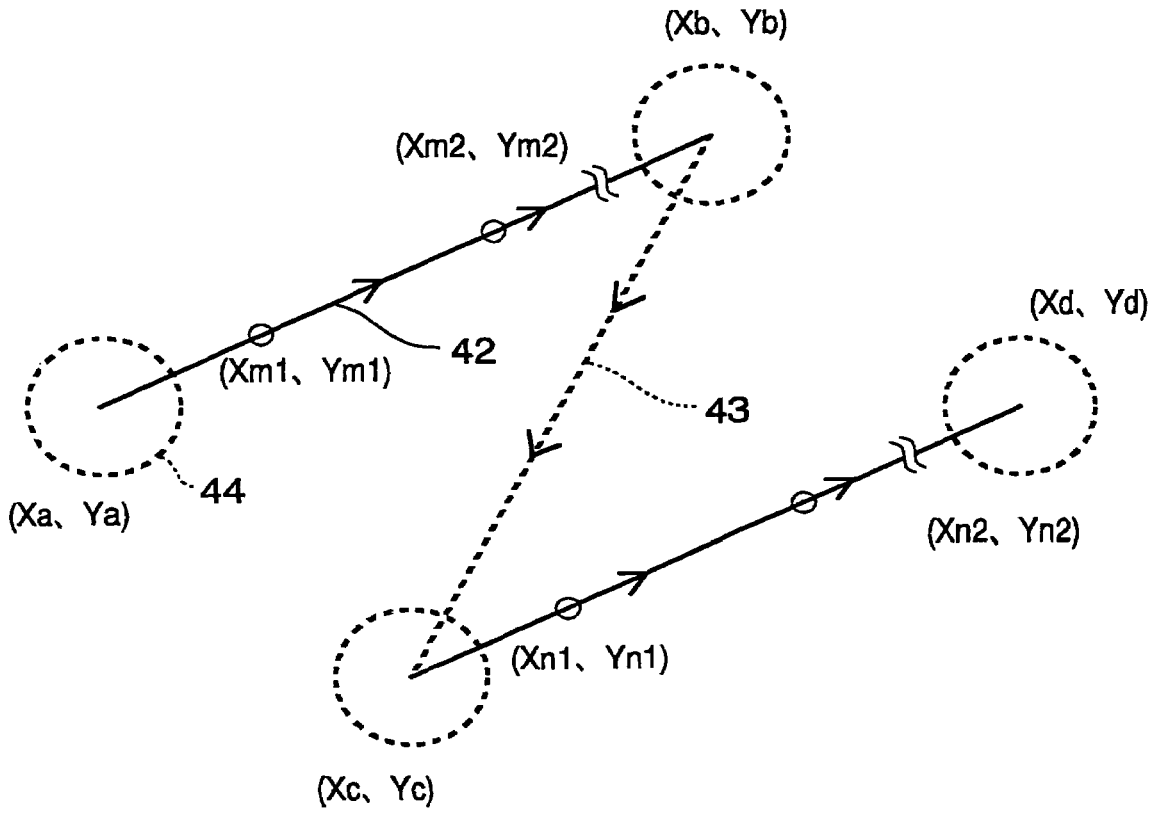
Figure 14:
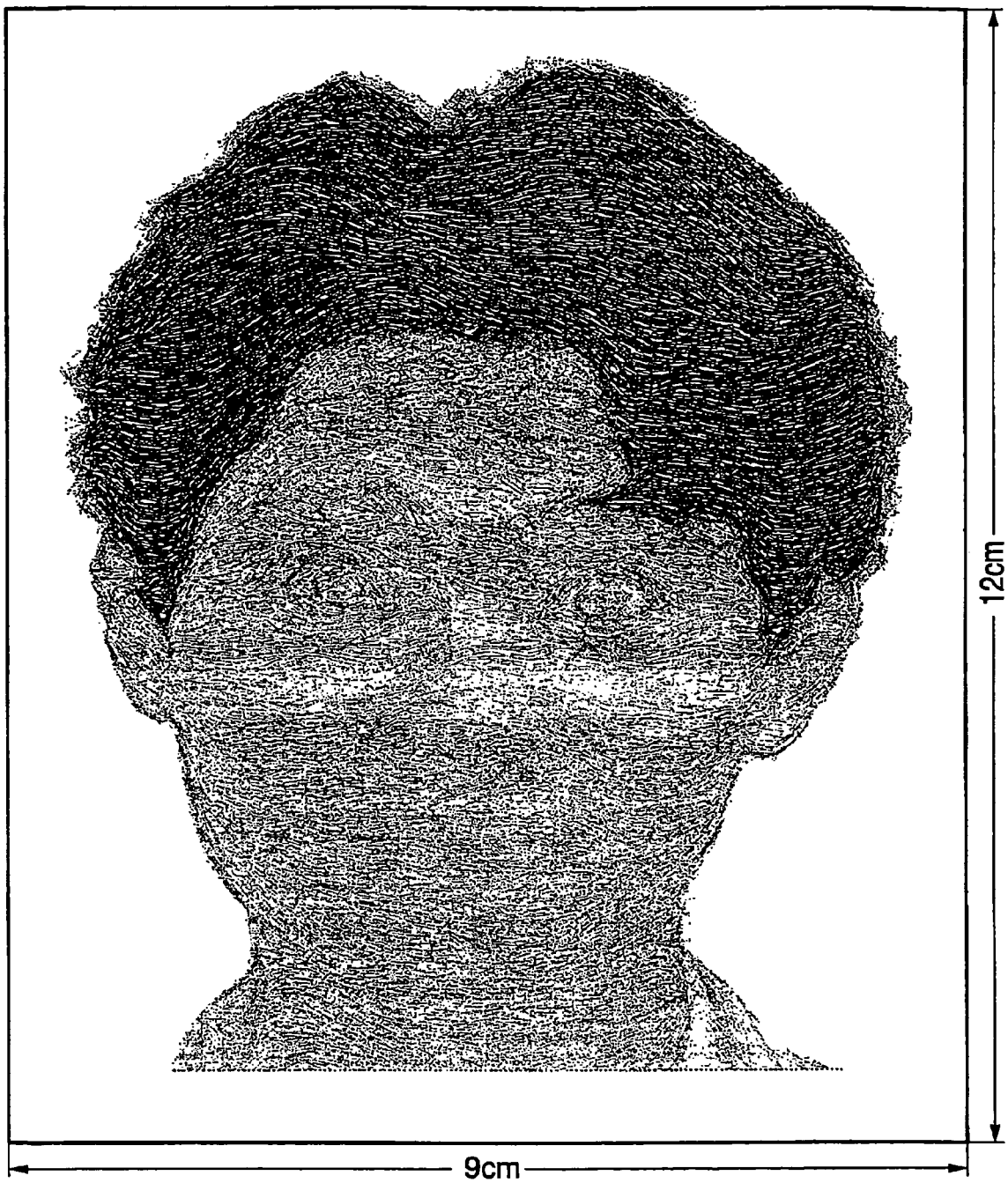
Figure 16:
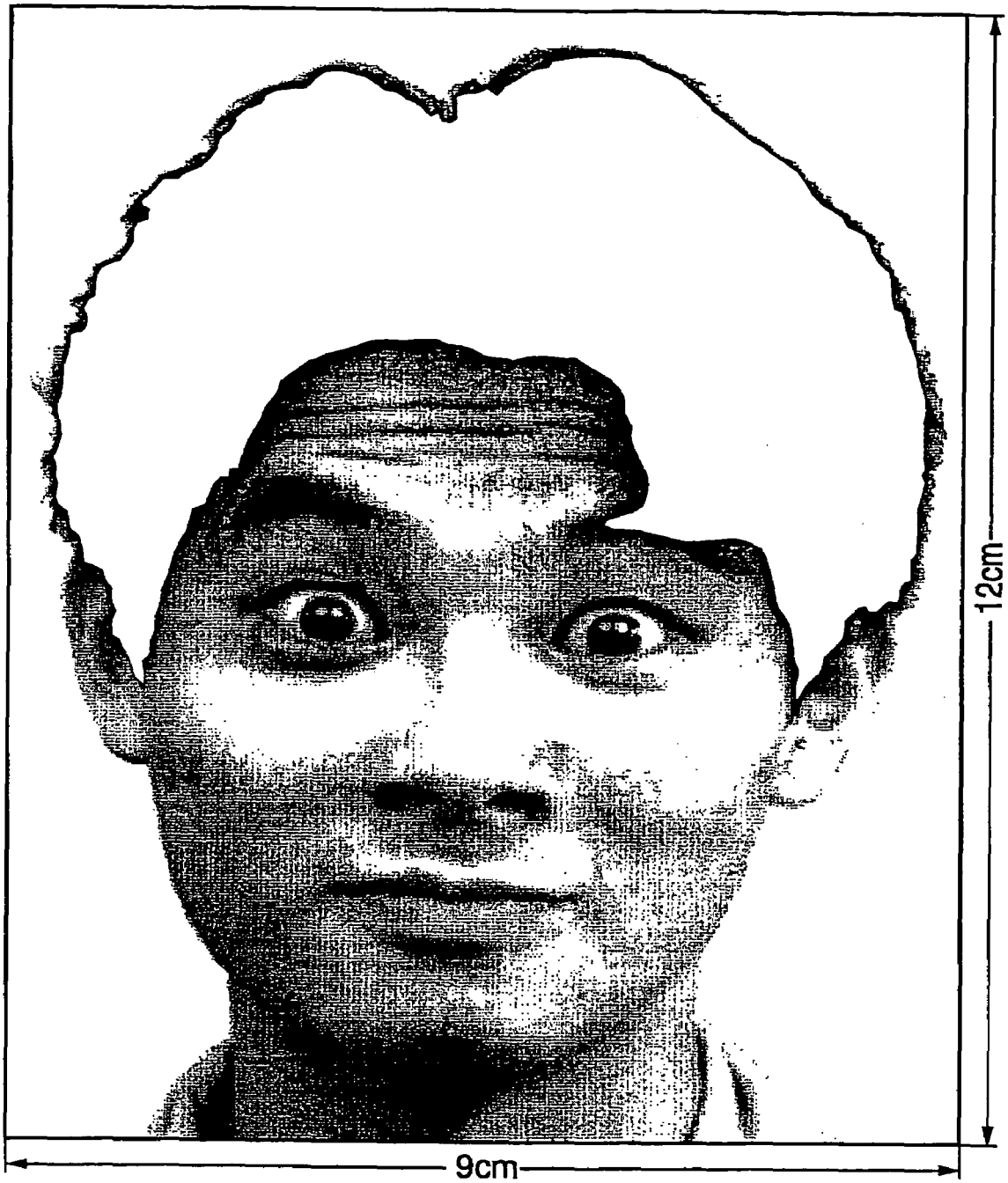
Figure 19:
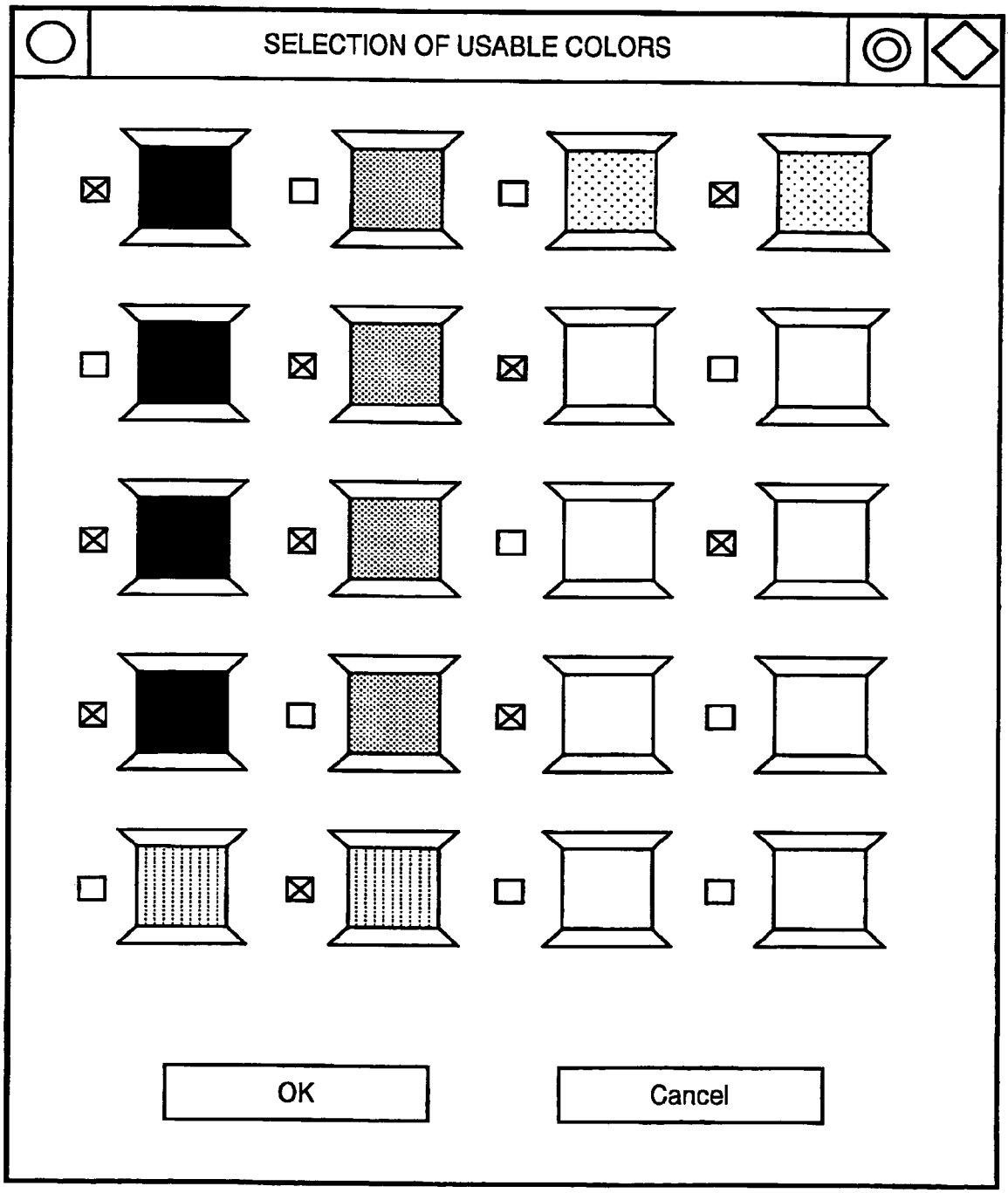
Figure 20:
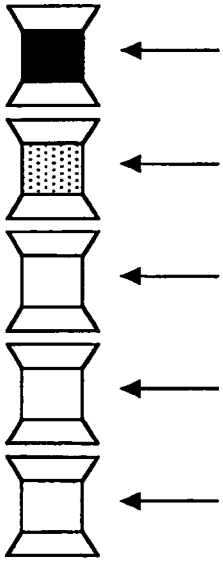
Figure 21:
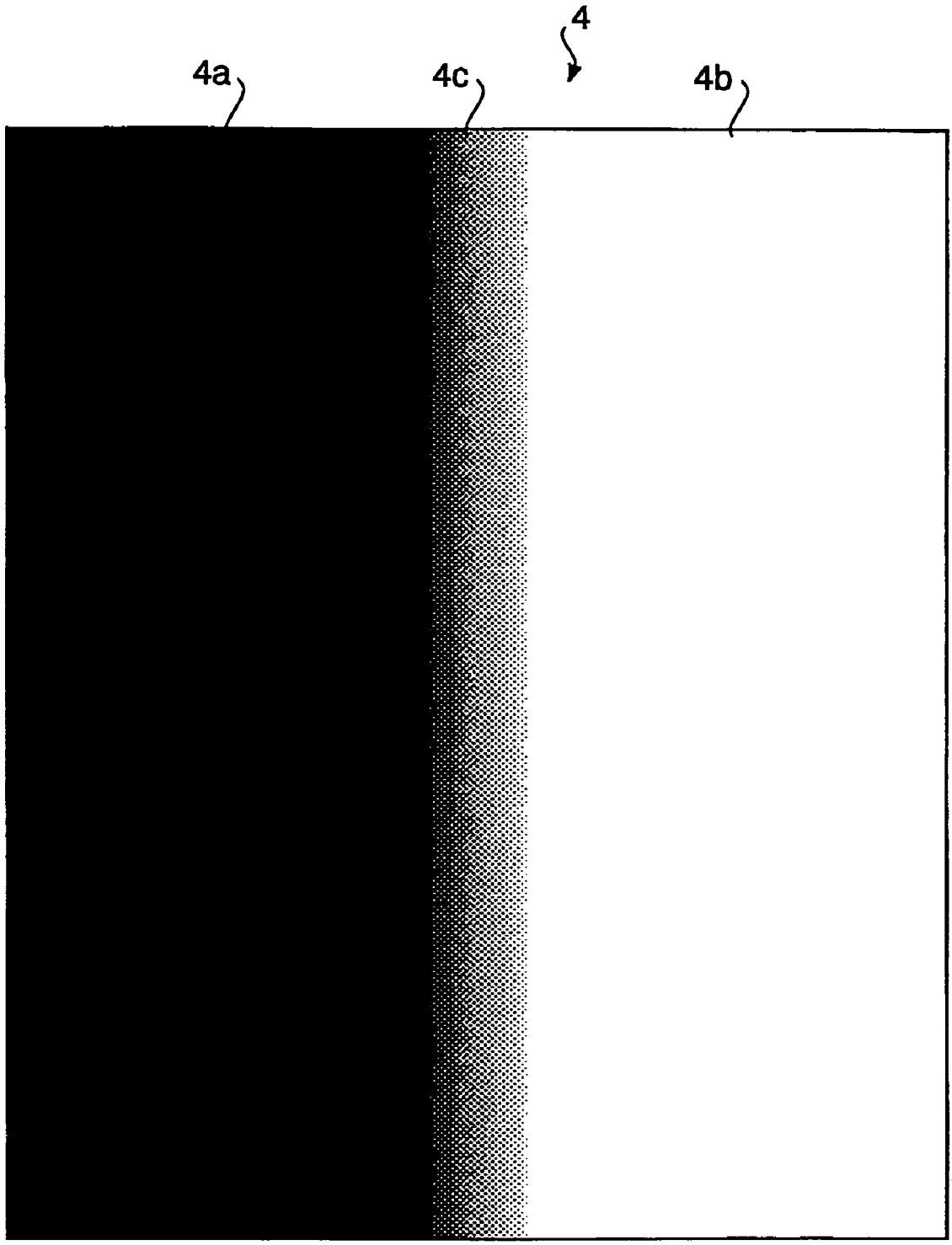
Figure 22:
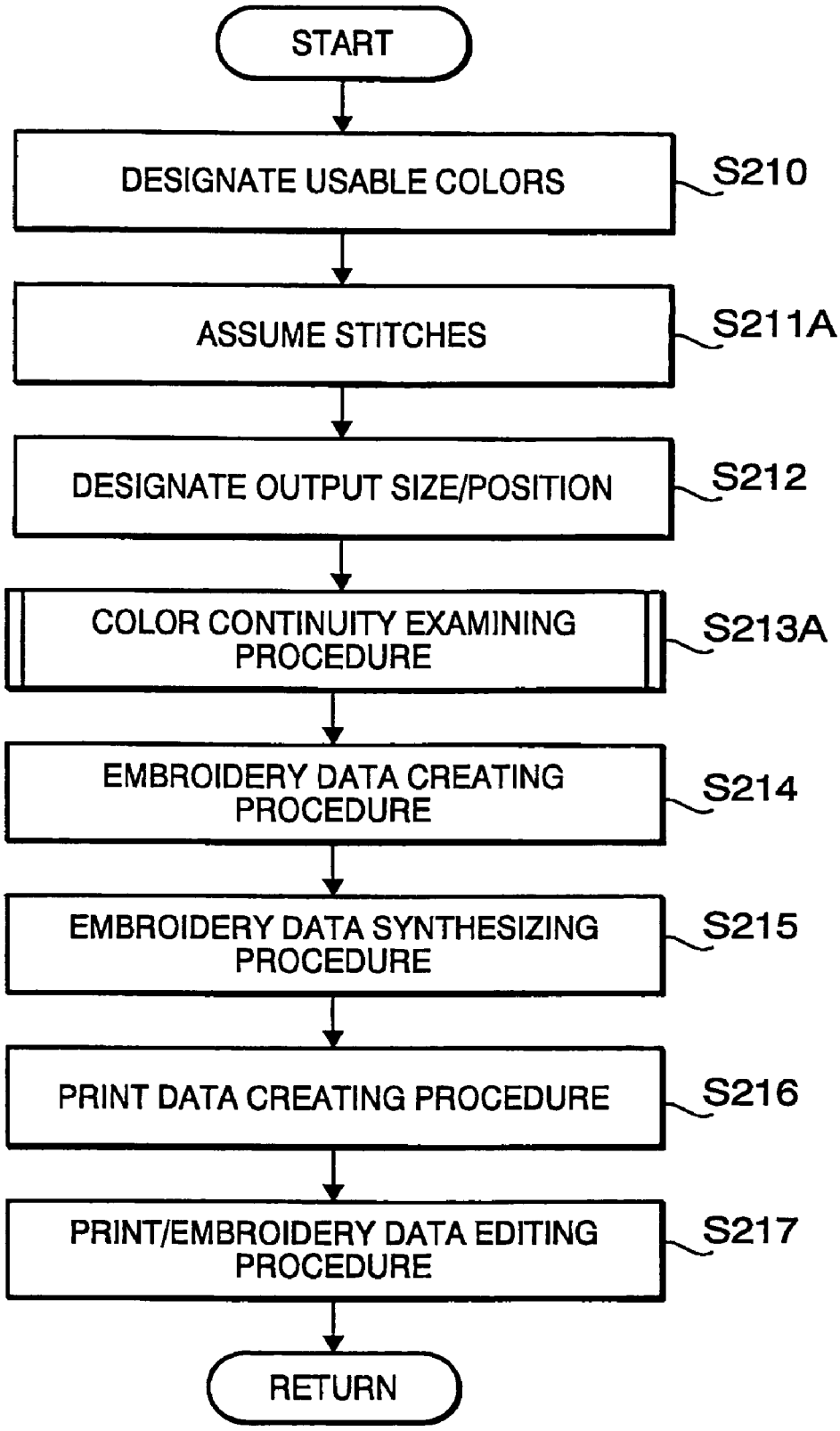
Figure 23:
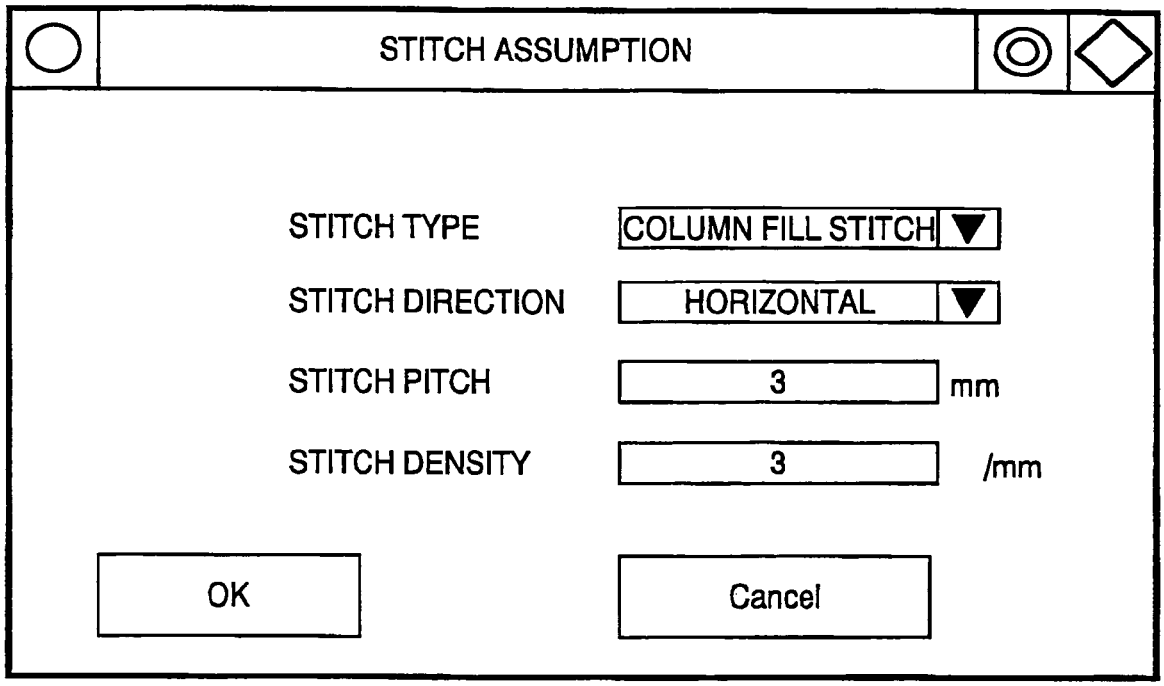
Figure 24:
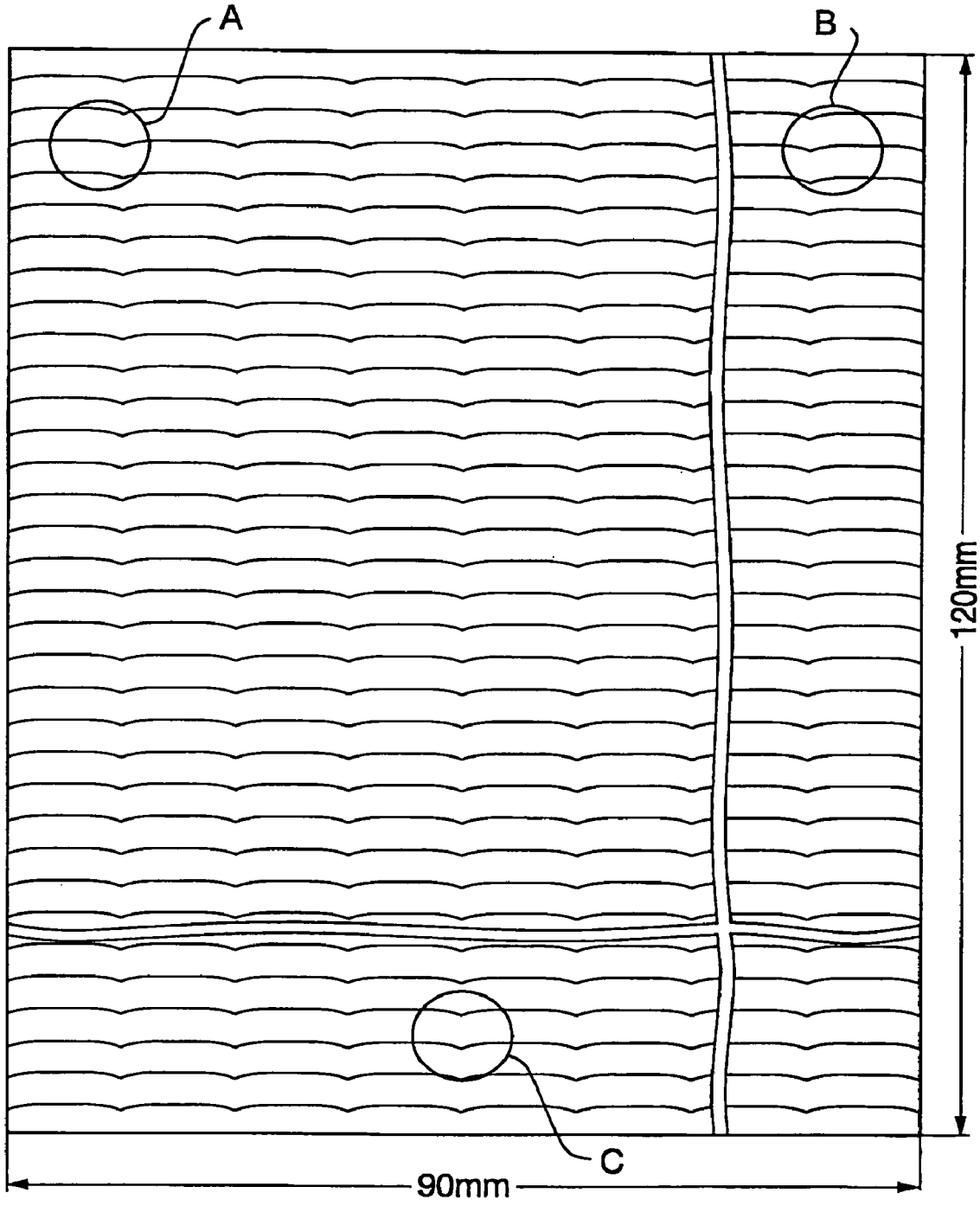
Figure 25:
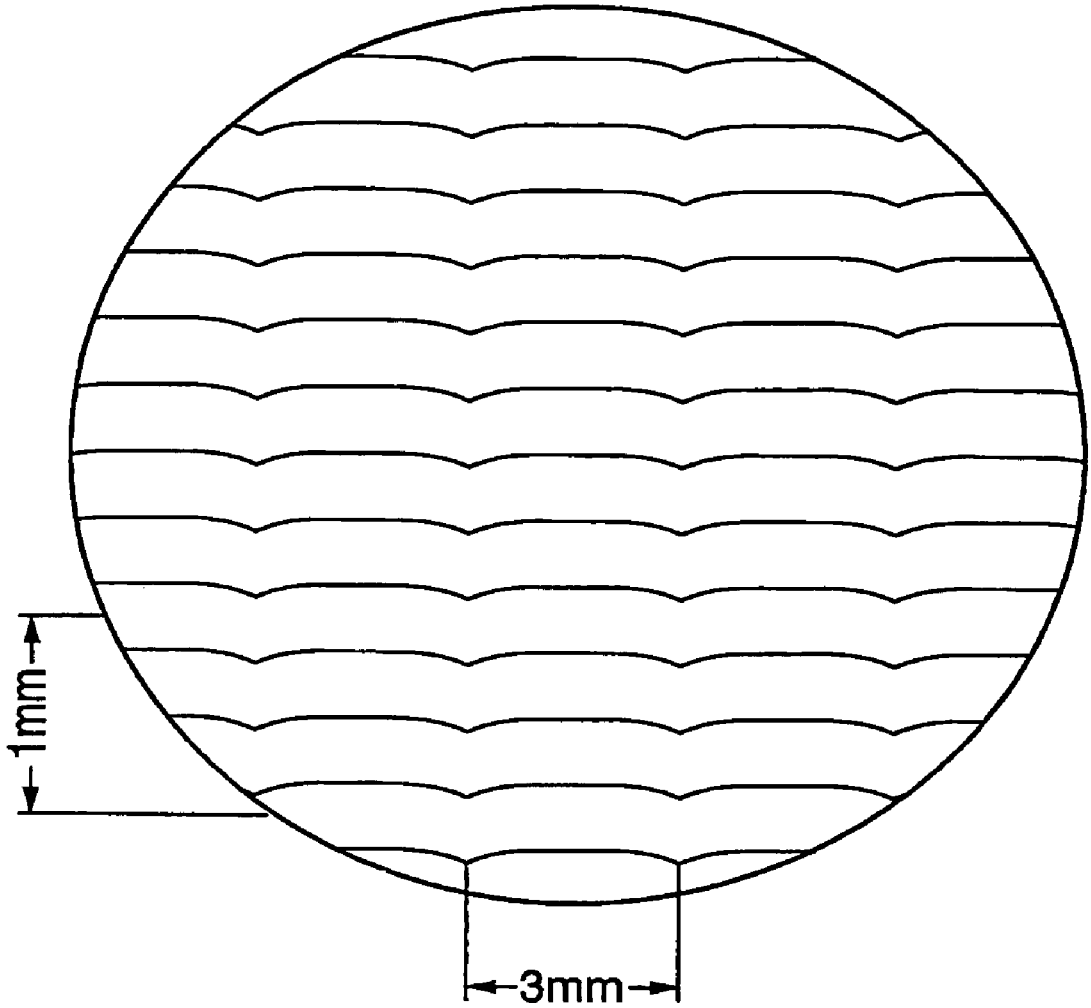
Figure 26:
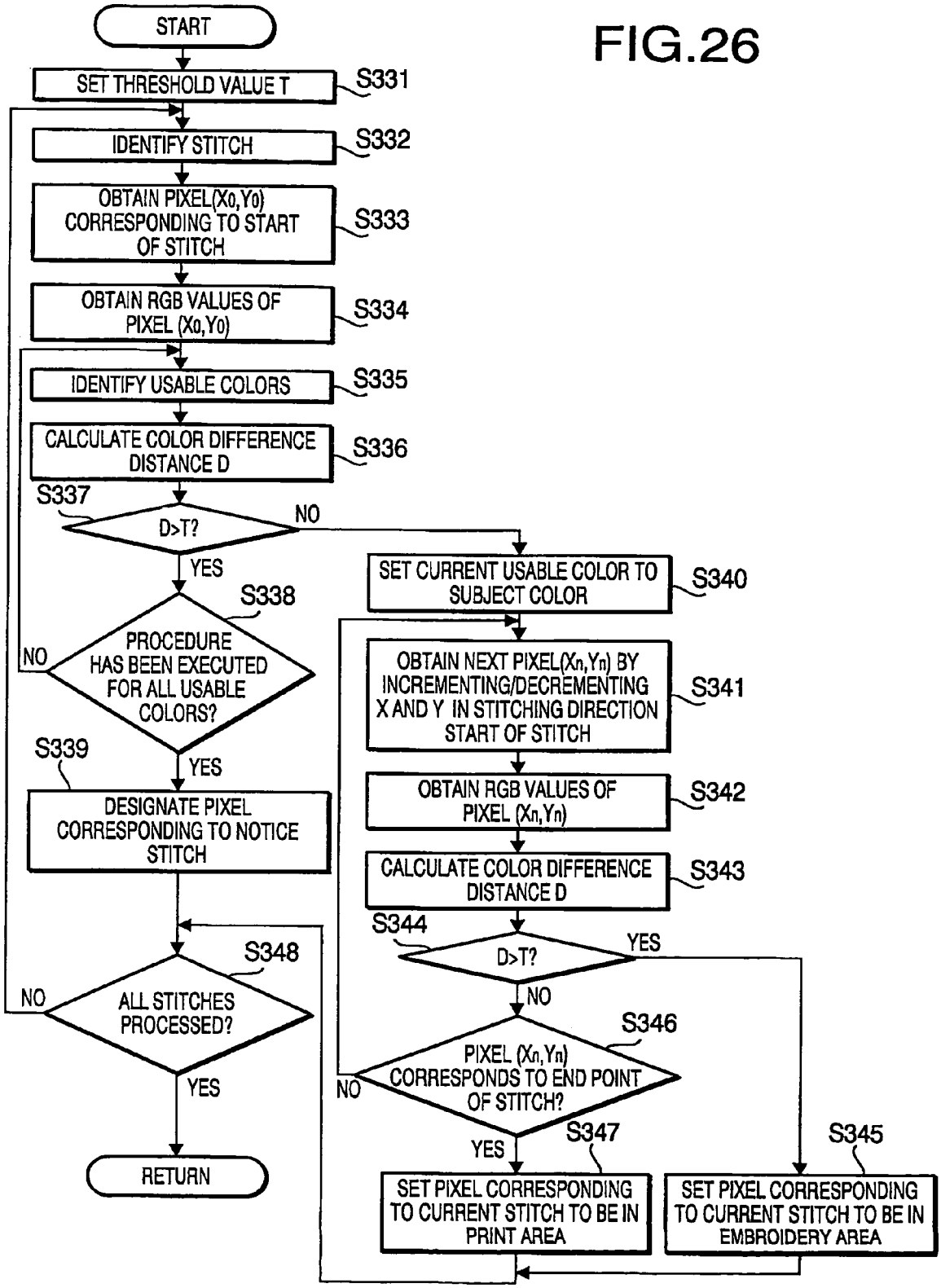
Figure 27:
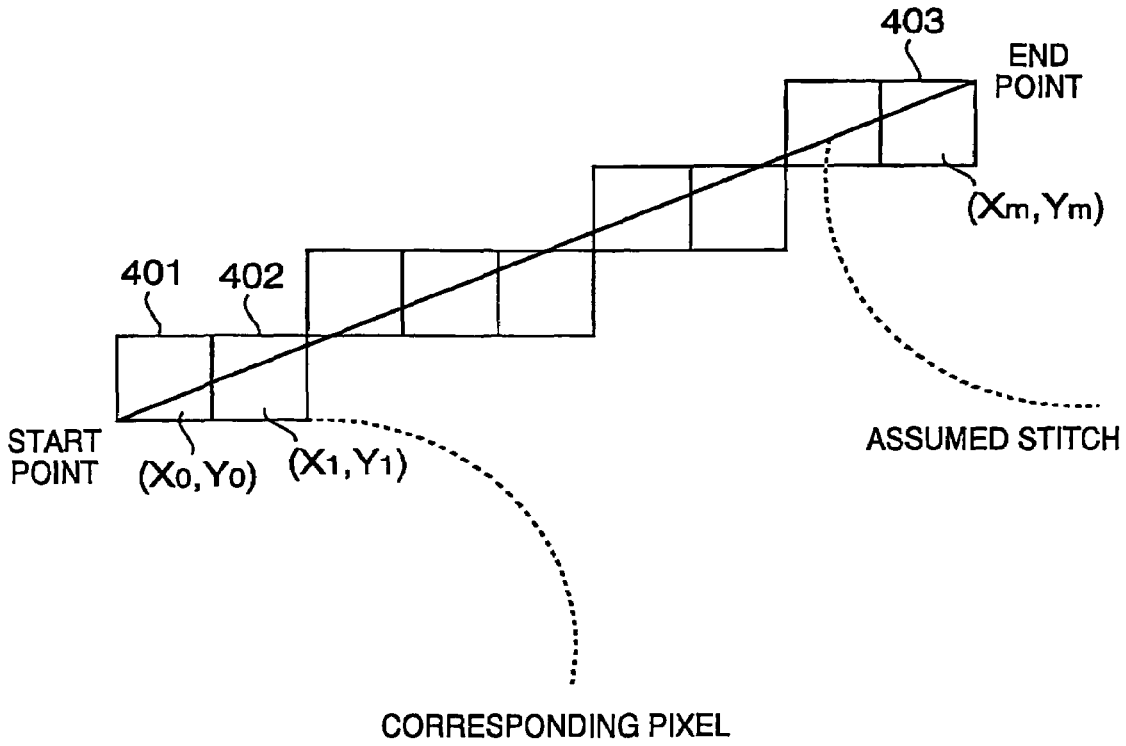
Figure 28:
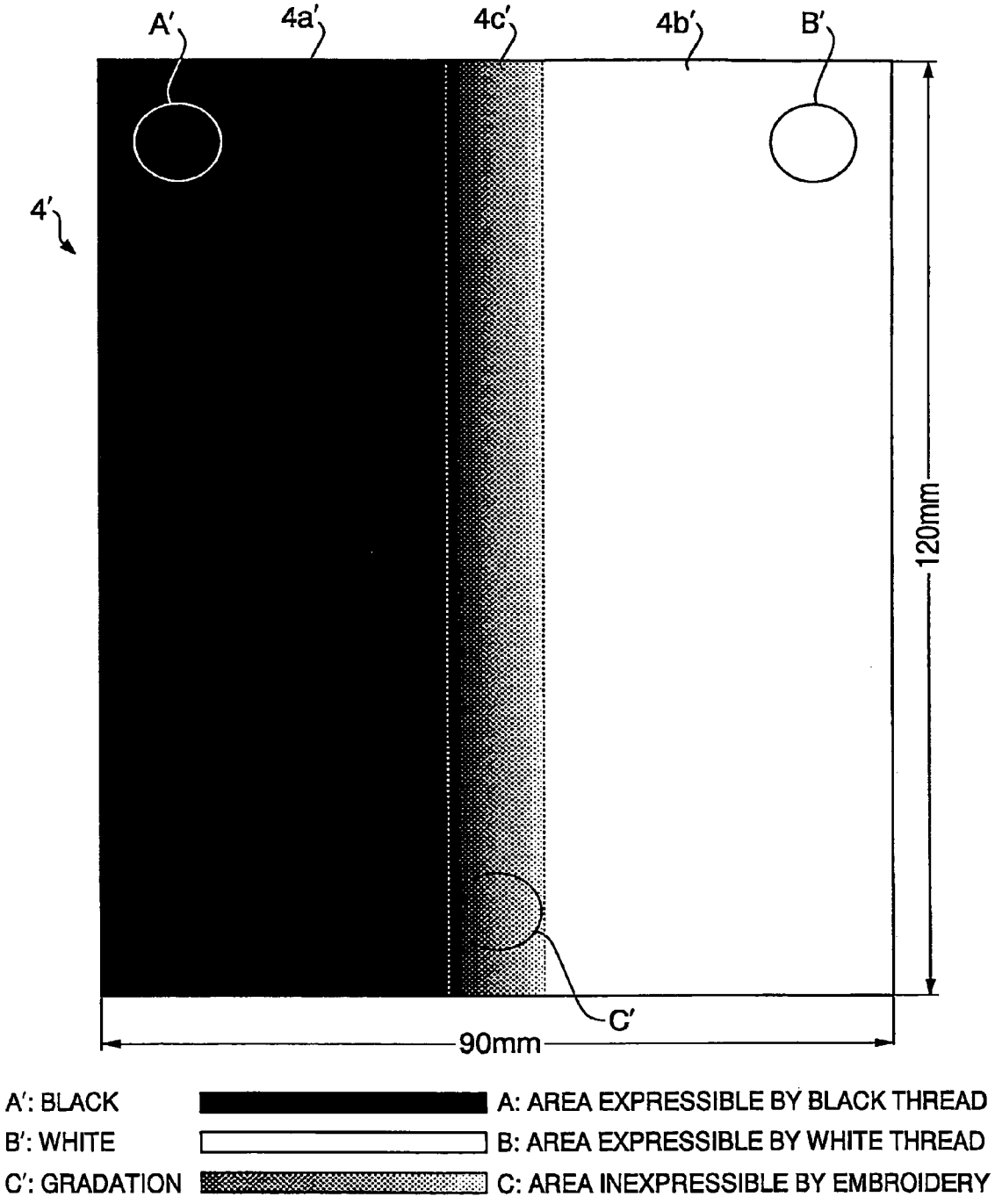
Figure 29:
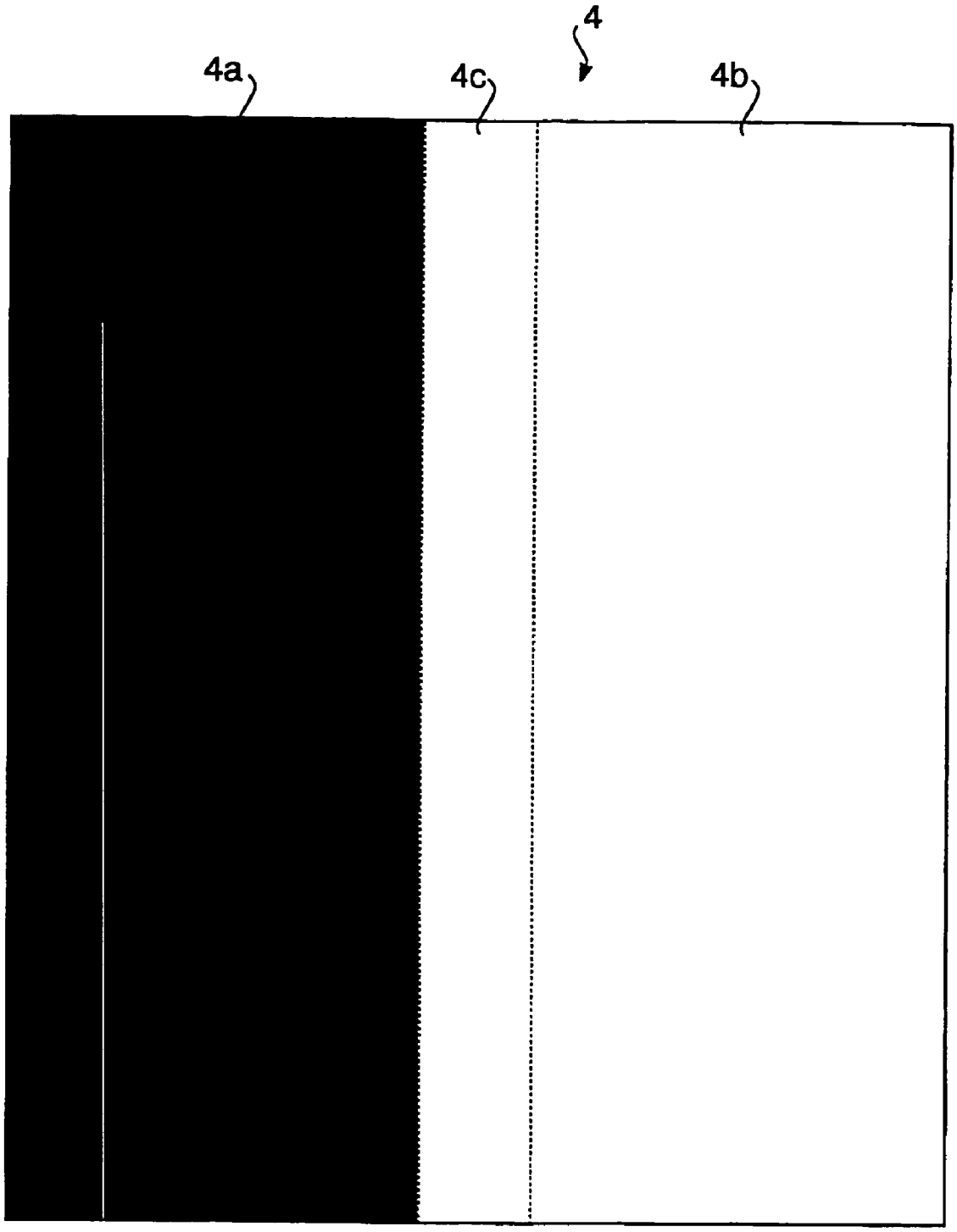
Figure 30:
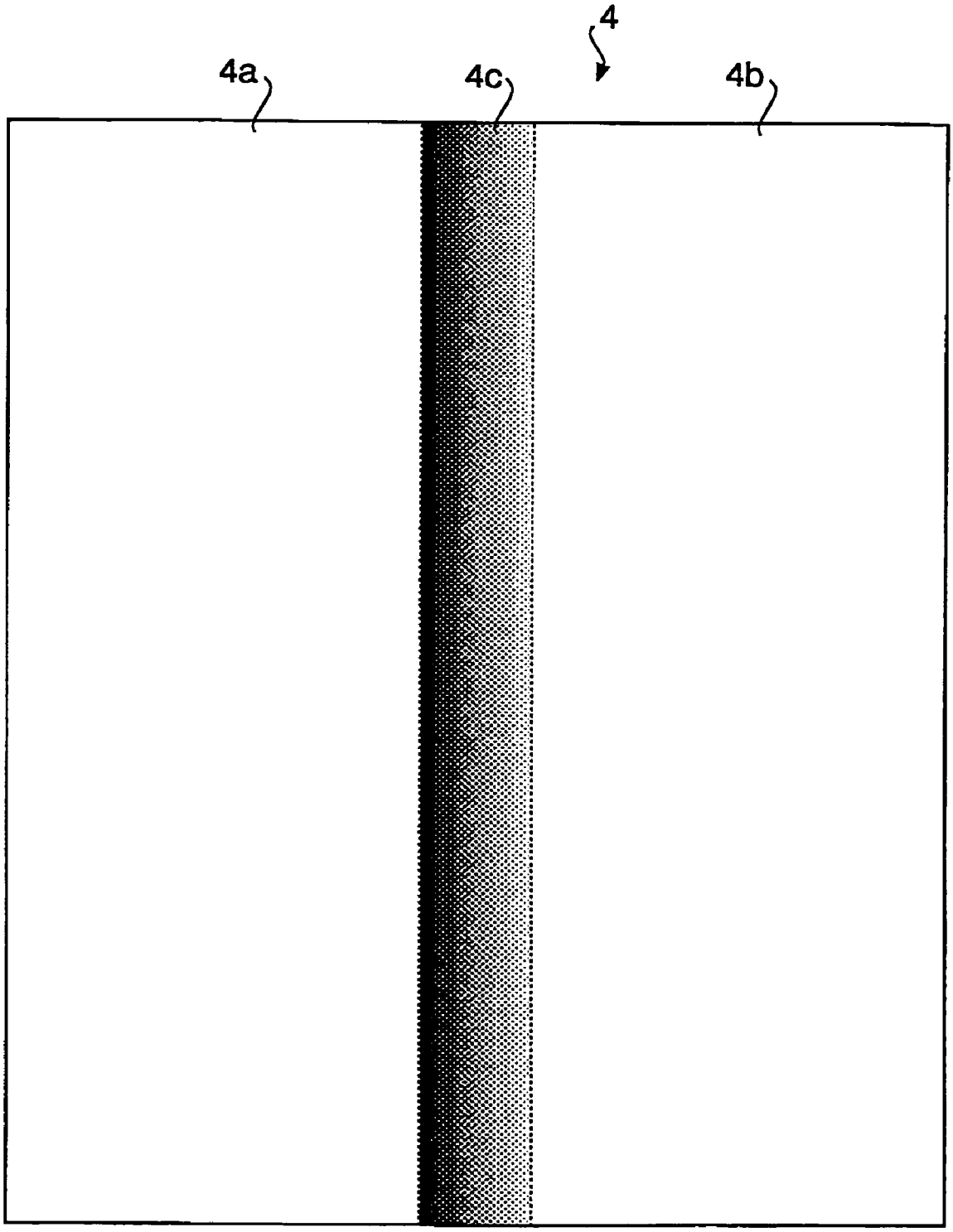
Figure 31:
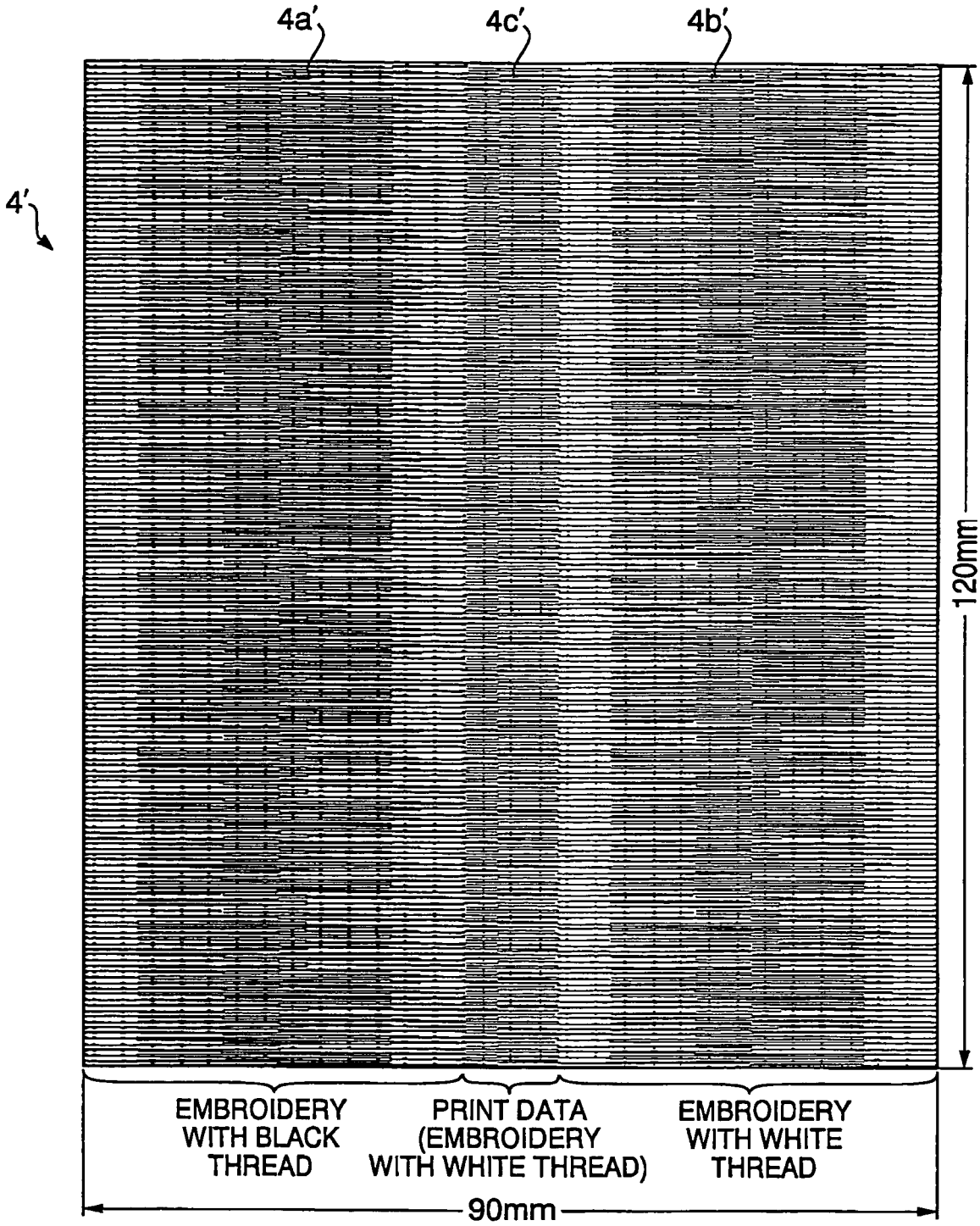
Figure 32:
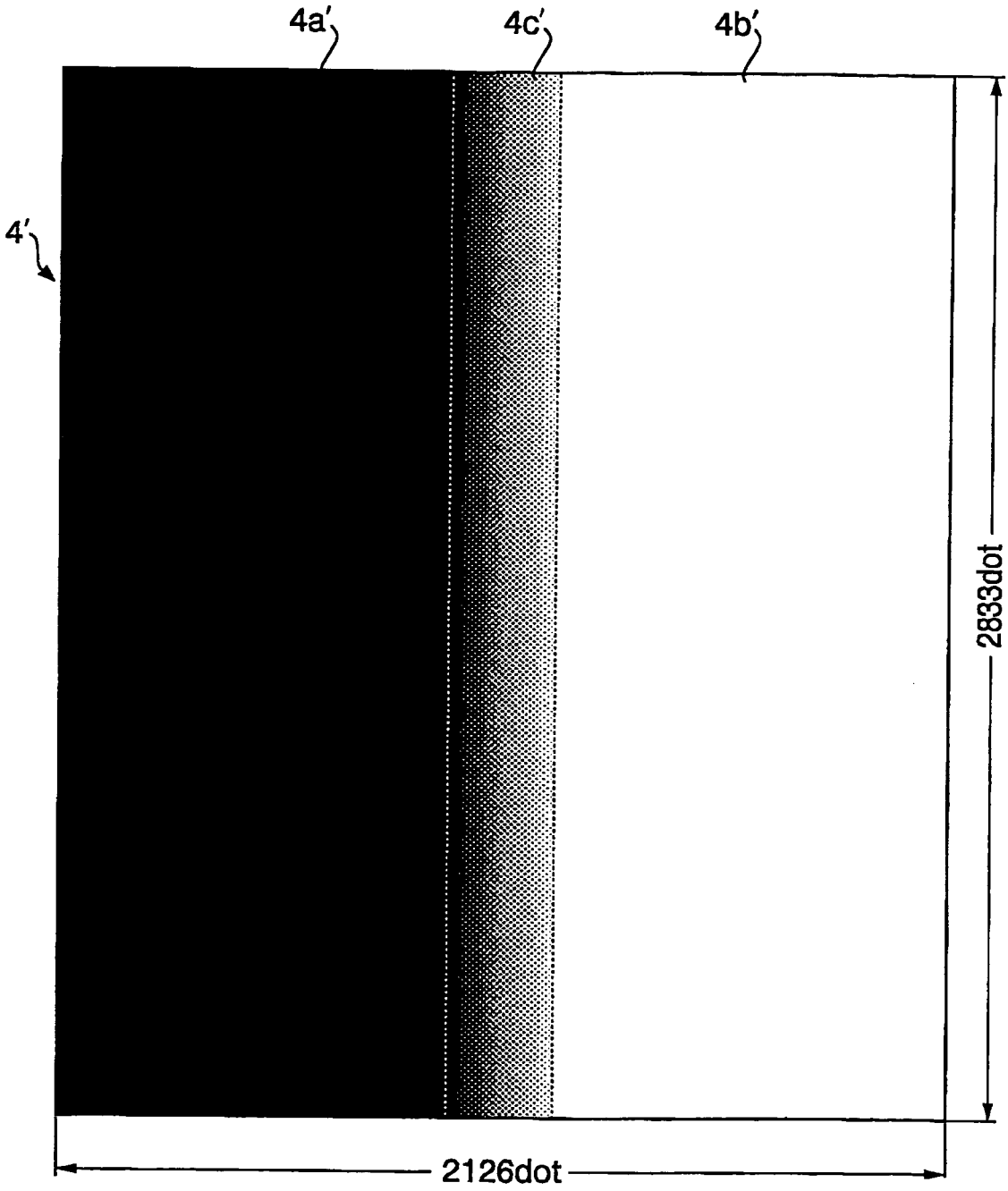
Figure 36:
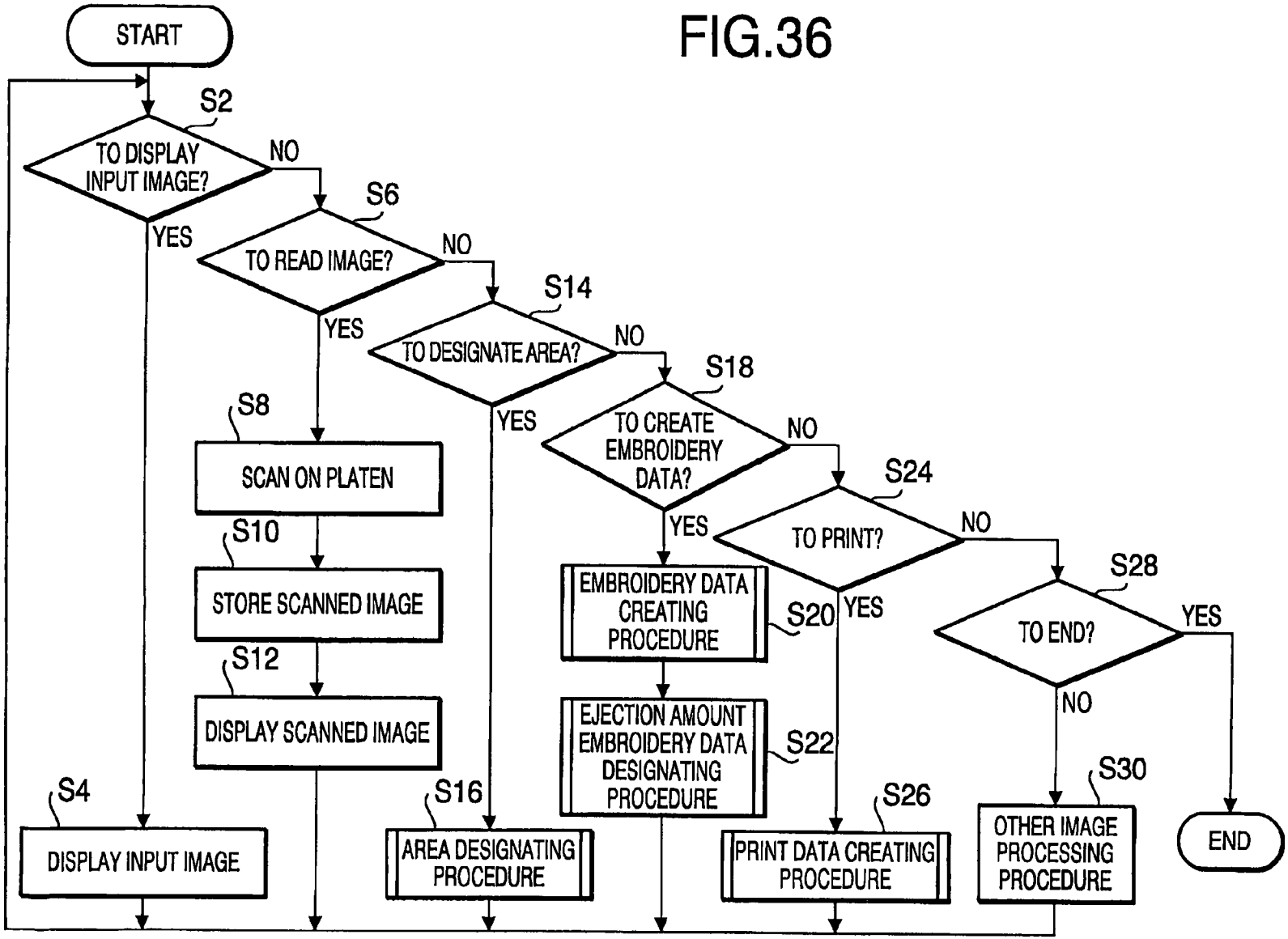
Figure 37:
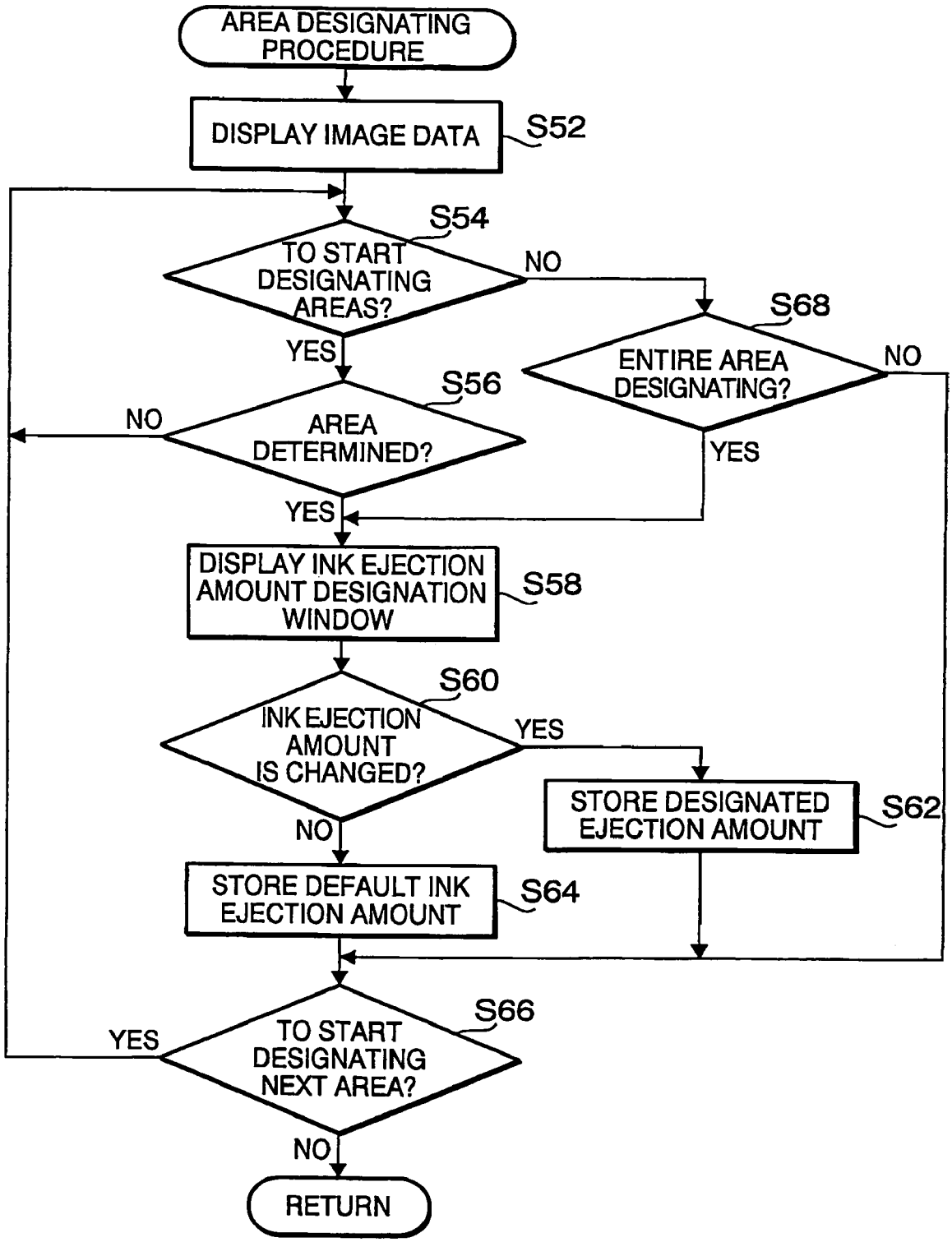
Figure 38:
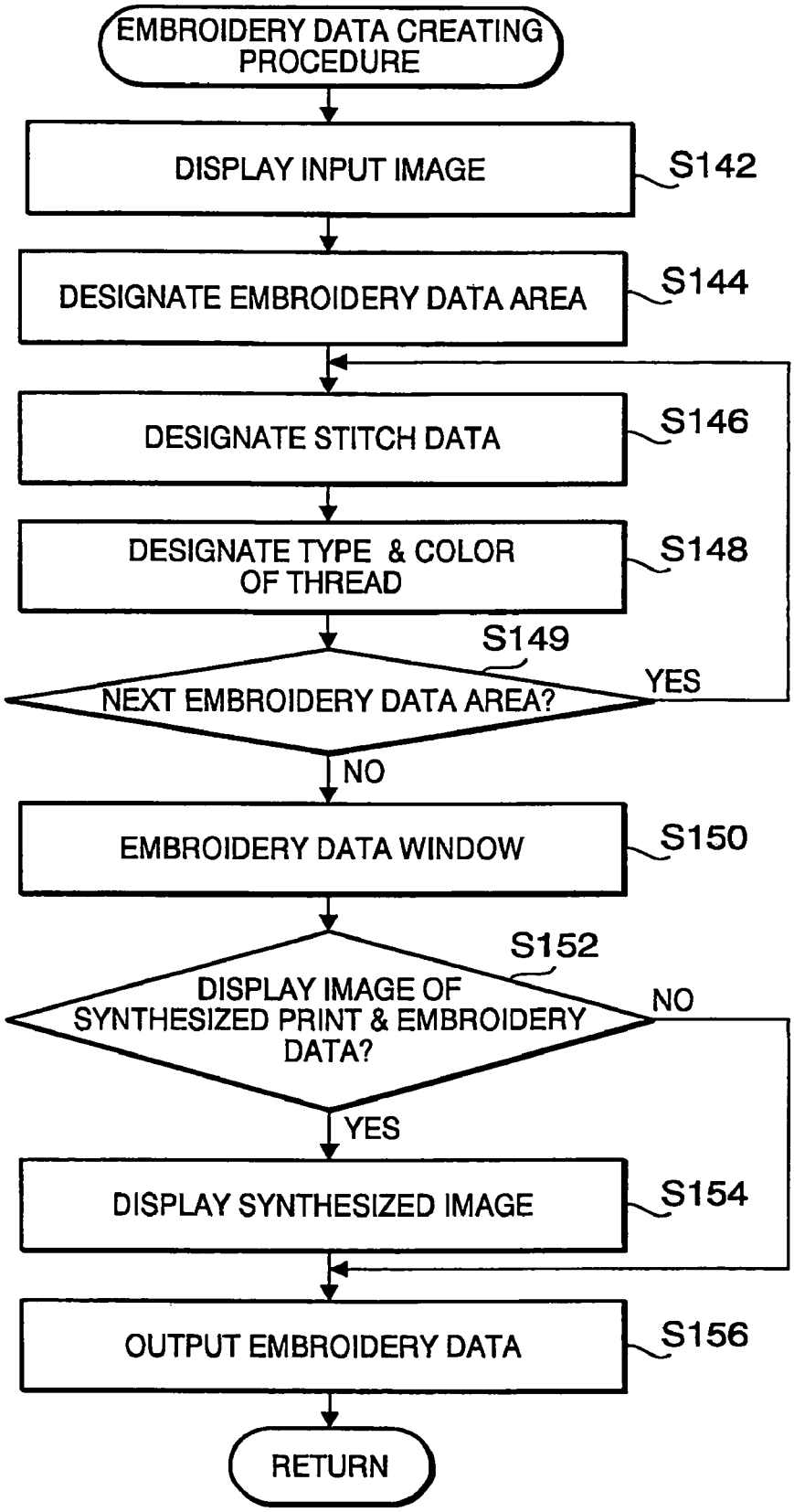
Figure 39:
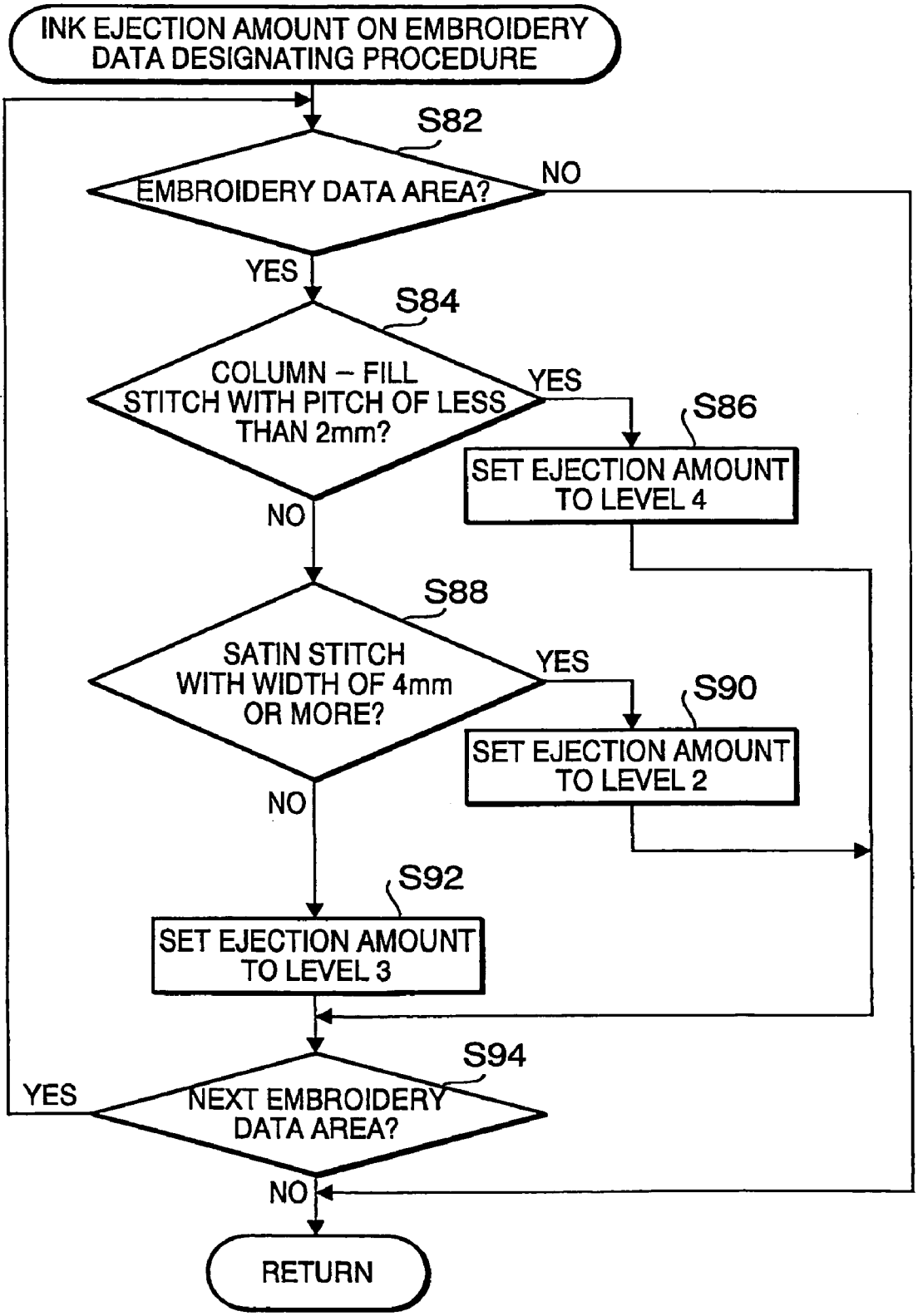
Figure 40:
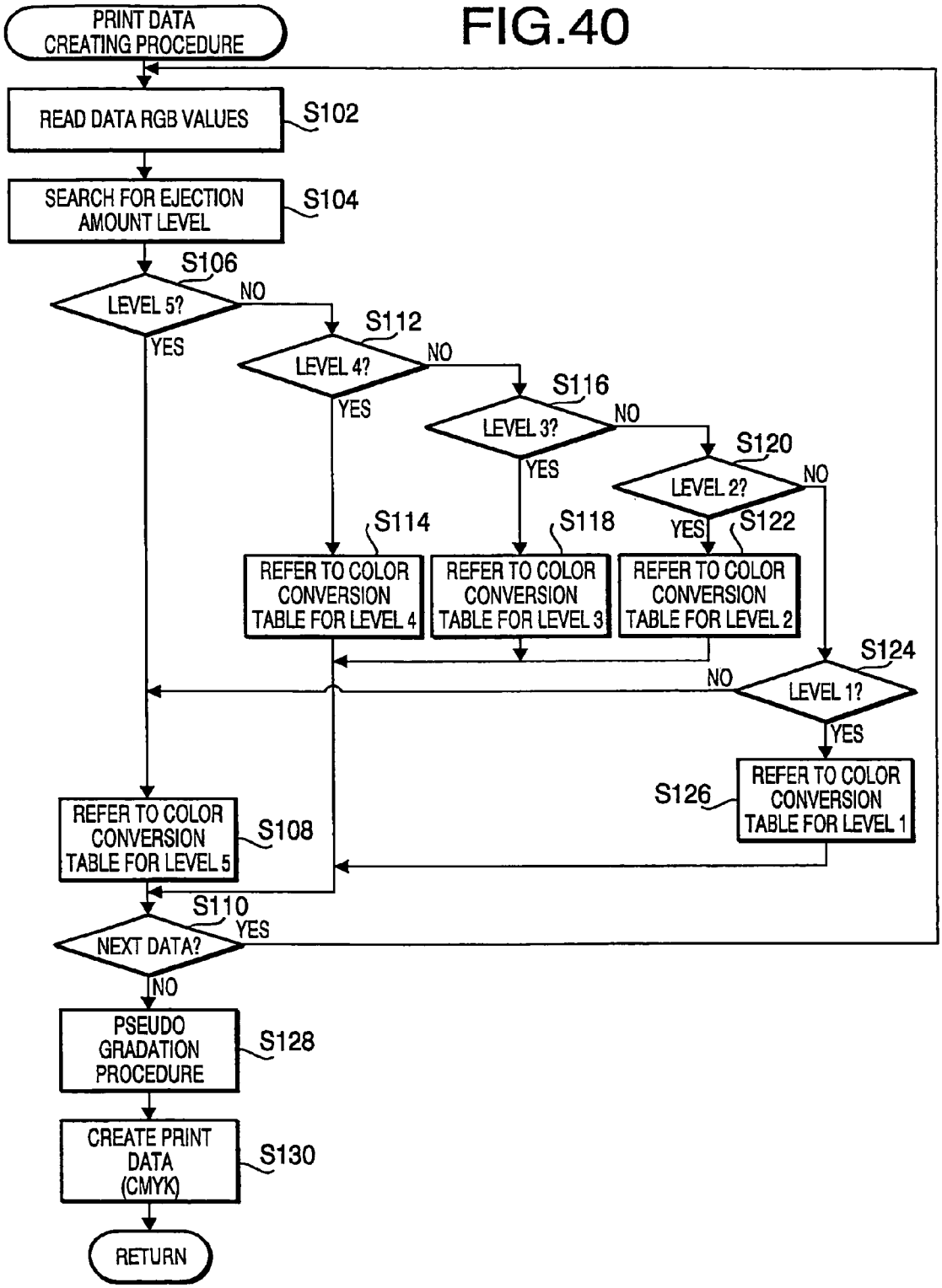
Figure 41:
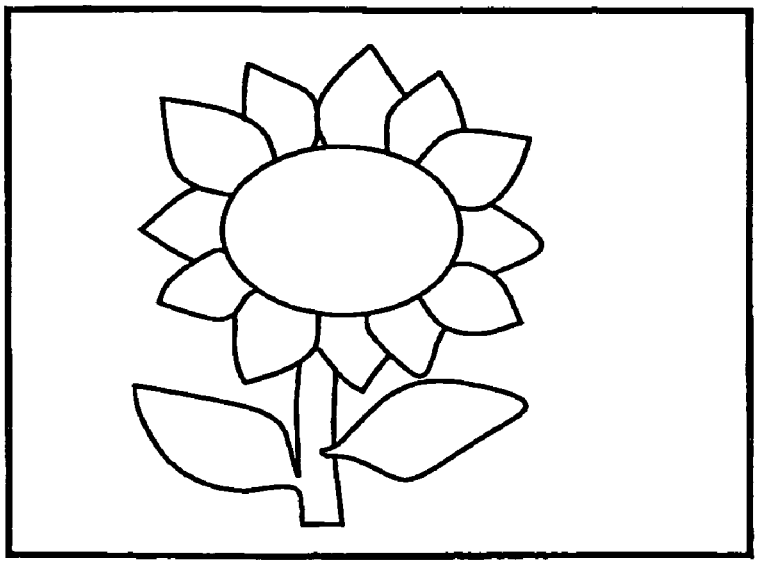
Figure 42:
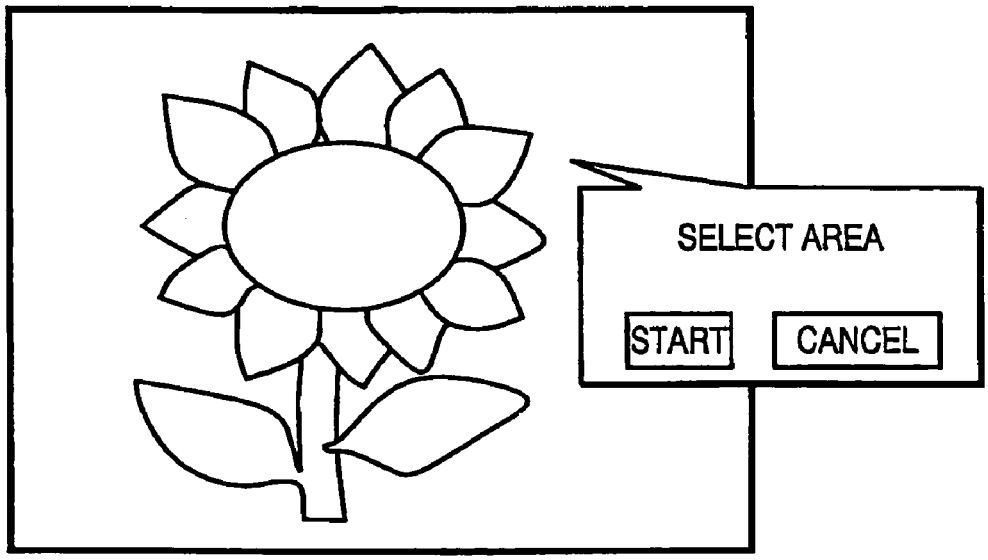
Figure 43:
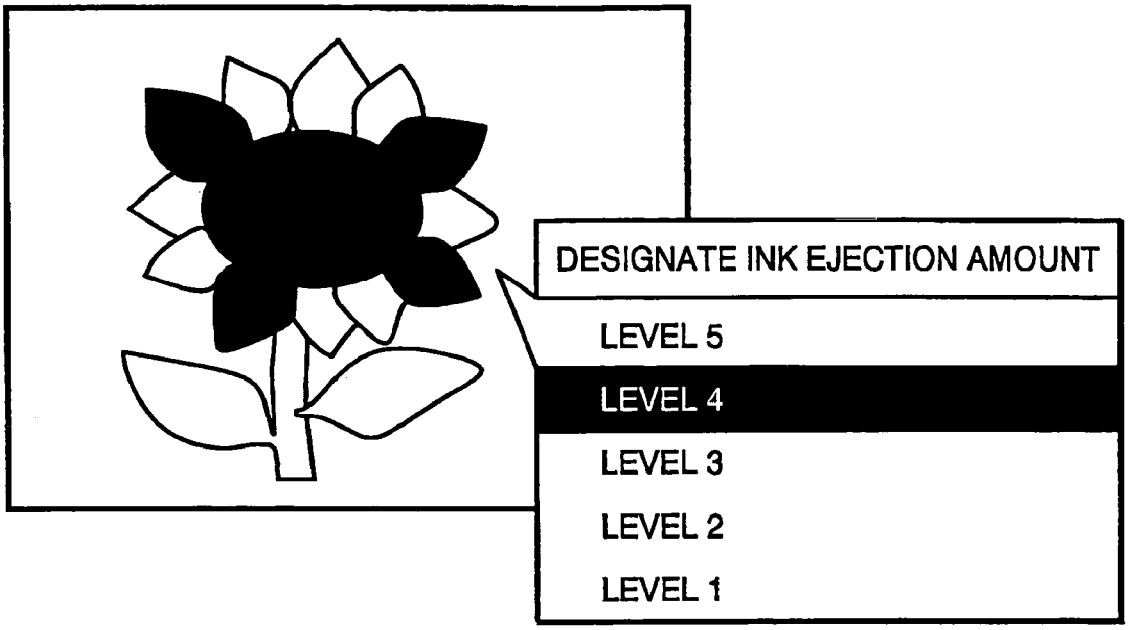
Figure 44:
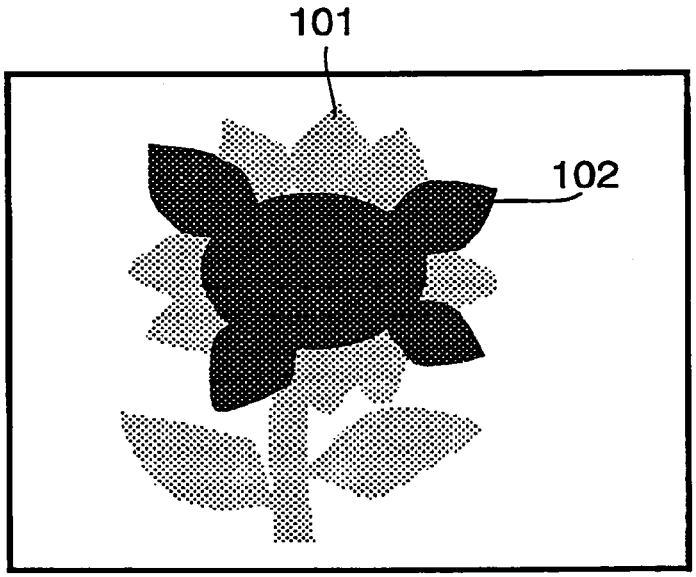
Figure 45:
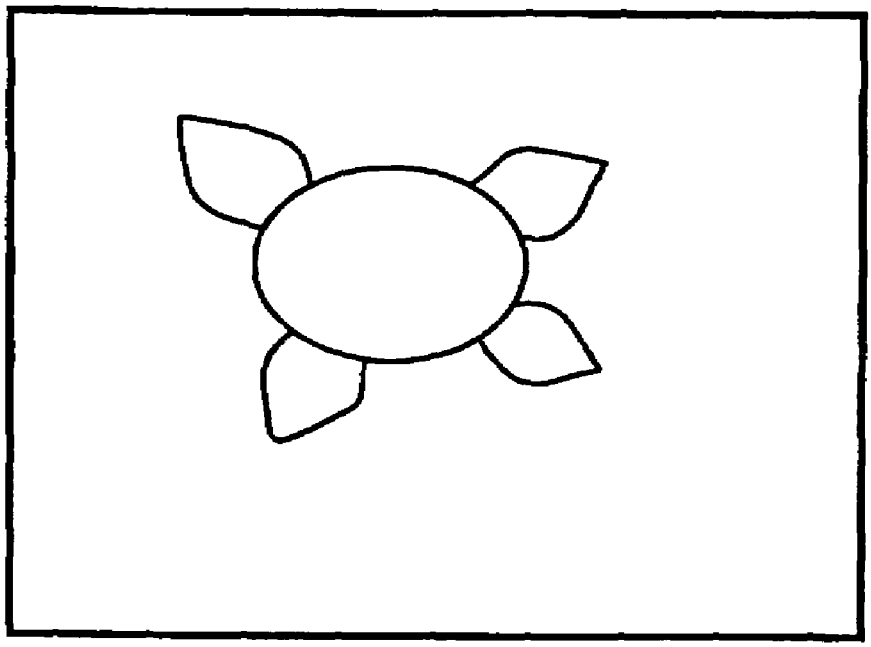
Figure 46:
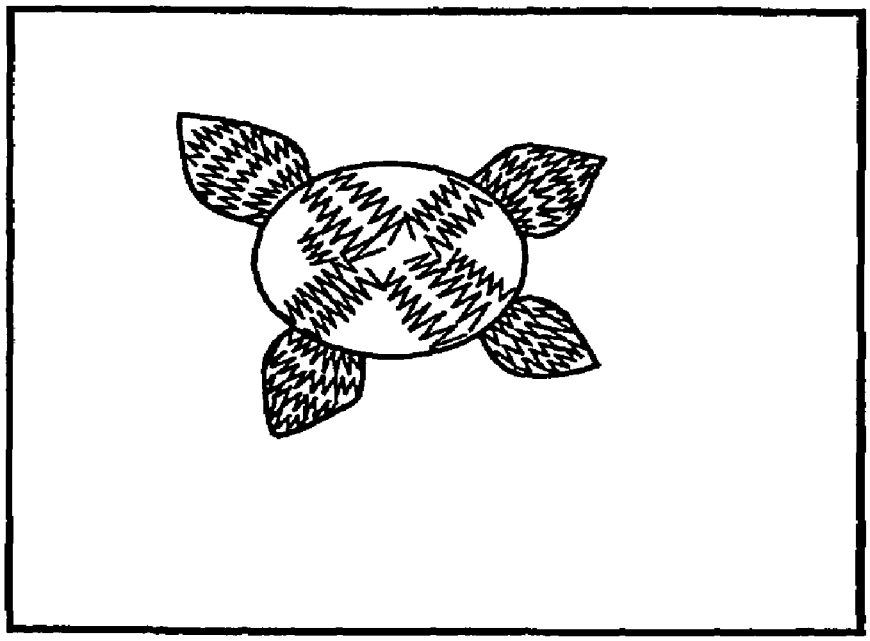
Figure 47:
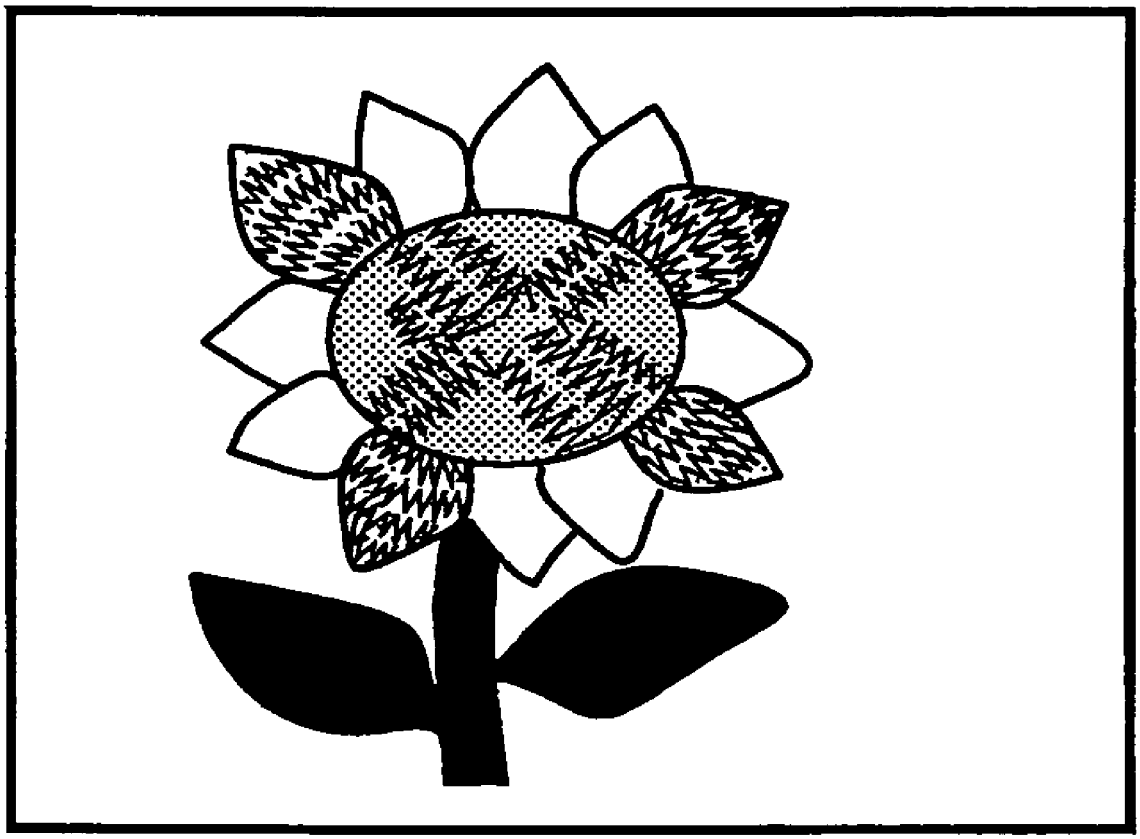
Figure 48:
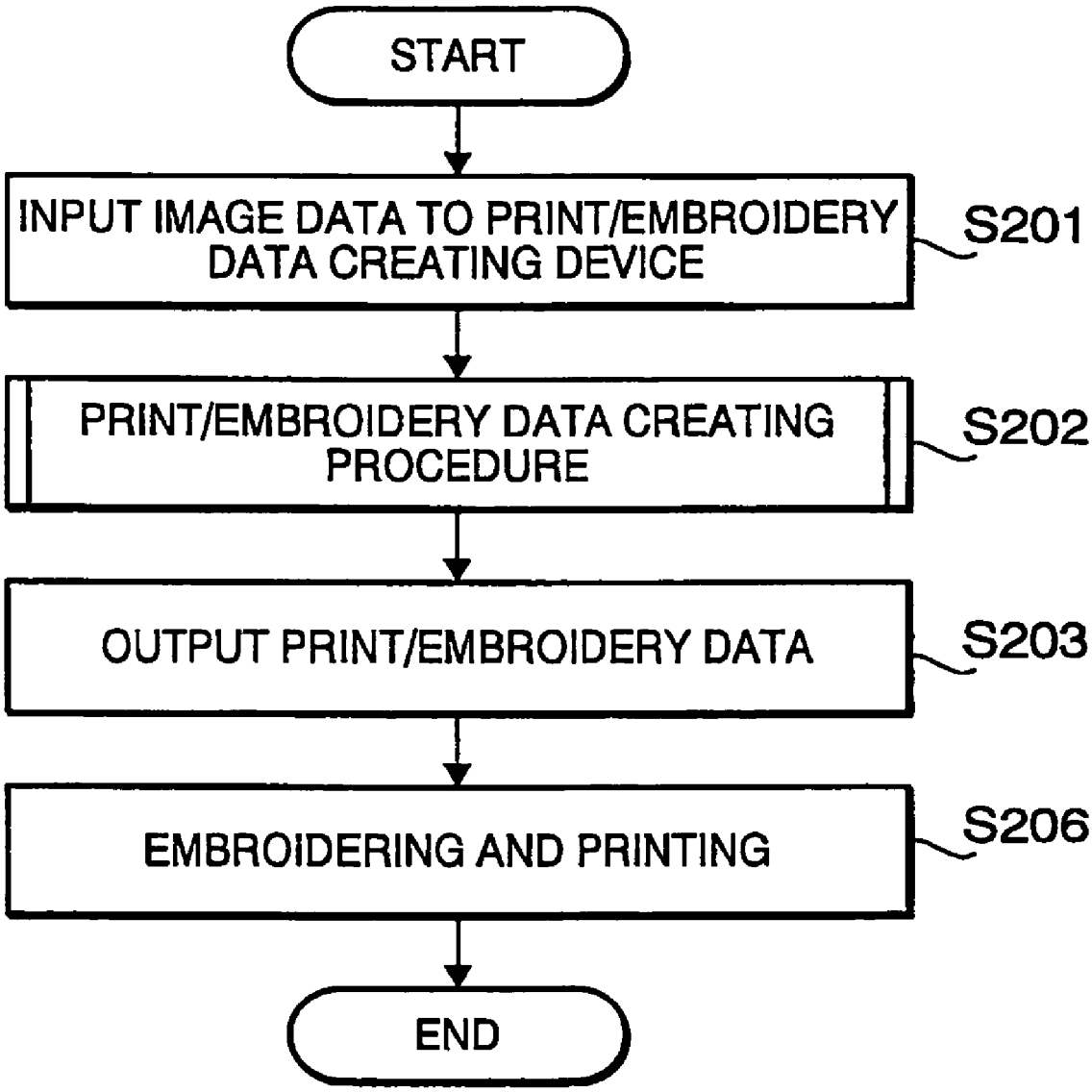

FIG. 3 schematically shows a structure of a RAM of the image editing device shown in FIG. 1;

FIG. 4 is a flowchart illustrating an overall flow from input of image data to output of image pattern on an object according to a first embodiment;

FIG. 5 is an exemplary image of the image data;

FIG. 6 is a flowchart illustrating a main procedure of the print/embroidery data creating procedure;

FIG. 7 shows a usable color input dialogue;

FIG. 8 shows a color correspondence table;

FIG. 9 is a flowchart illustrating a usable color area separating procedure;

FIGS. 10A and 10B respectively show usable color area and print area set by the usable color area separating procedure;

FIGS. 11A and 11B show embroidery data corresponding to the usable color area and to the print area set by the usable color area separating procedure, respectively;

FIG. 12 shows an example of the embroidery data synthesized by an embroidery data synthesizing procedure;

FIG. 13 is a conceptual chart illustrating the stitch data contained in the embroidery data;

FIG. 14 shows an exemplary image represented by the embroidery data which is data synthesized by the embroidery data synthesizing procedure;

FIG. 15 shows a exemplary table indicating the print data which is data created by the embroidery data synthesizing procedure;

FIG. 16 shows a exemplary image represented by the print data which is data created by the embroidery data synthesizing procedure;

FIGS. 17A-17C illustrate image patterns output by a print/embroidery data editing procedure;

FIGS. 18A-18C illustrate image patterns output by a print/embroidery data editing procedure according to a second embodiment;

FIG. 19 shows a usable color input window;

FIG. 20 shows a thread-color table;

FIG. 21 shows an example of image data;

FIG. 22 is a flowchart illustrating the main flow of the print/embroidery data creating procedure according to a third embodiment;

FIG. 23 shows an example of a stitch designation dialogue;

FIGS. 24 and 25 are charts illustrating the output size and position of the image pattern;

FIG. 26 is a flowchart illustrating the color continuity examining procedure according to the third embodiment;

FIG. 27 shows a relationship between the pixels constituting the image data and the assumed stitches;

FIG. 28 shows an output pattern corresponding to the image data shown in FIG. 21;

FIG. 29 shows embroidery areas determined from the image data shown in FIG. 21;

FIG. 30 shows a print area determined from the image data shown in FIG. 21;

FIG. 31 shows an example of the output pattern based on the synthesized embroidery data;

FIG. 32 shows an output pattern corresponding to the print data;

FIGS. 33A-33C illustrate output patterns according to the third embodiment;

FIGS. 34A-34C illustrate output patterns according to a modification of the third embodiment;

FIG. 35 shows an exemplary structure of a color conversion table stored in a color conversion table storing area;

FIG. 36 is a flowchart illustrating a main procedure of the image editing device according to a fourth embodiment;

FIG. 37 is a flowchart illustrating an area designating procedure called in the main procedure shown in FIG. 36;

FIG. 38 is a flowchart illustrating an embroidery data creating procedure called in the main procedure shown in FIG. 36;

FIG. 39 is a flowchart illustrating an ejection amount designating procedure called in the main procedure shown in FIG. 36;

FIG. 40 is a flowchart illustrating a print data creating procedure called in the main procedure sown in FIG. 36;

FIG. 41 is an example of a screen image corresponding to input image data;

FIG. 42 is similar to FIG. 41 and further a dialogue requesting a user to designate an area;

FIG. 43 is a screen image showing a dialogue requesting the user to de designate the ink ejection amount level;

FIG. 44 is a screen image showing the image to be formed and ink ejection amounts at respective areas;

FIG. 45 is a screen image when areas for the embroidery data have been designated;

FIG. 46 is an exemplary screen image of the designated areas for the embroidery data with a type of embroidery being indicated;

FIG. 47 is a screen image of a pattern to be formed in accordance with the embroidery data and the print data; and FIG. 48 is a flowchart illustrating an overall flow according to a fifth embodiment.

DETAILED DESCRIPTION OF THE EMBODIMENTS

Referring now to the accompanying drawings, embodiments of the invention will be described in detail.

Initially, a print/embroidery data creating device 1 according to the present invention will be described with reference to FIGS. 1 through 3.

The print/embroidery data creating device 1 creates print/embroidery data, which is a combination of print data and embroidery data related to each other, based on a single piece of image data so that a pattern represented by the image data is printed/embroidered by an inkjet printer and an embroidery machine.

The inkjet printer is a printer which ejects drops of ink to an object to form images/characters on the object. Specifically, the inkjet printer is configured such that ink is introduced a plurality of ejection channels provided to inkjet heads from an ink reservoir. By selectively driving actuators such as heat generating elements or piezoelectric elements, ink drops are ejected from ejection nozzles respectively provided to the ink ejection channels. When a color image is printed, the color of each pixel of the image is divided into components of three primary colors, cyan (C), magenta (M) and yellow (Y), and by adjusting the thickness density of each color component, a desired color is realized. A black pixel is formed as a mixture of three primary color components having maximum values. It is known, however, the black formed by mixing the three primary colors has low contrast and dull. Therefore, recently, the black component is added and a color image is typically formed with CMYK components.

The inkjet printer is connected with a personal computer (PC) that controls the operation of the inkjet printer. The PC stores various applications (programs) controlling the operation of the inkjet printer, and a printer driver that converts the print data to data intrinsic to the inkjet printer. Further, the ink jet printer is provided with a memory card read/write drive. Thus, by inserting a memory card storing print data, the print data can be input to the inkjet printer from an external device. Typically, the print data includes data indicating pixel areas which is defined as a print area, and information indicative of print position and size. In accordance with the print data configured as above, a control mechanism of the inkjet printer automatically executes a printing operation, in accordance with the print data.

An embroidering machine is configured such that an embroidery frame for holding a fabric which will be embroidered is moved horizontally by a horizontal driving system to a position in an X-Y coordinate system. While the embroidery frame is being moved horizontally, sewing (embroidering) operation is performed so that a desired pattern is formed on the fabric held by the embroidery frame. The horizontal driving system and sewing mechanism are controlled by a control unit having a microprocessor built in the embroidering machine.

The embroidering machine has a memory card read/write device. By loading a memory card storing the embroidery data, it embroidery data can be input to the embroidering machine from an external device. Typically, the embroidery data contains color code, information indicating positions and sizes of embroideries, and stitch data used for respective embroideries. Based on the embroidery data, the embroidering machine automatically executes the embroidering operation.

Figure 2:
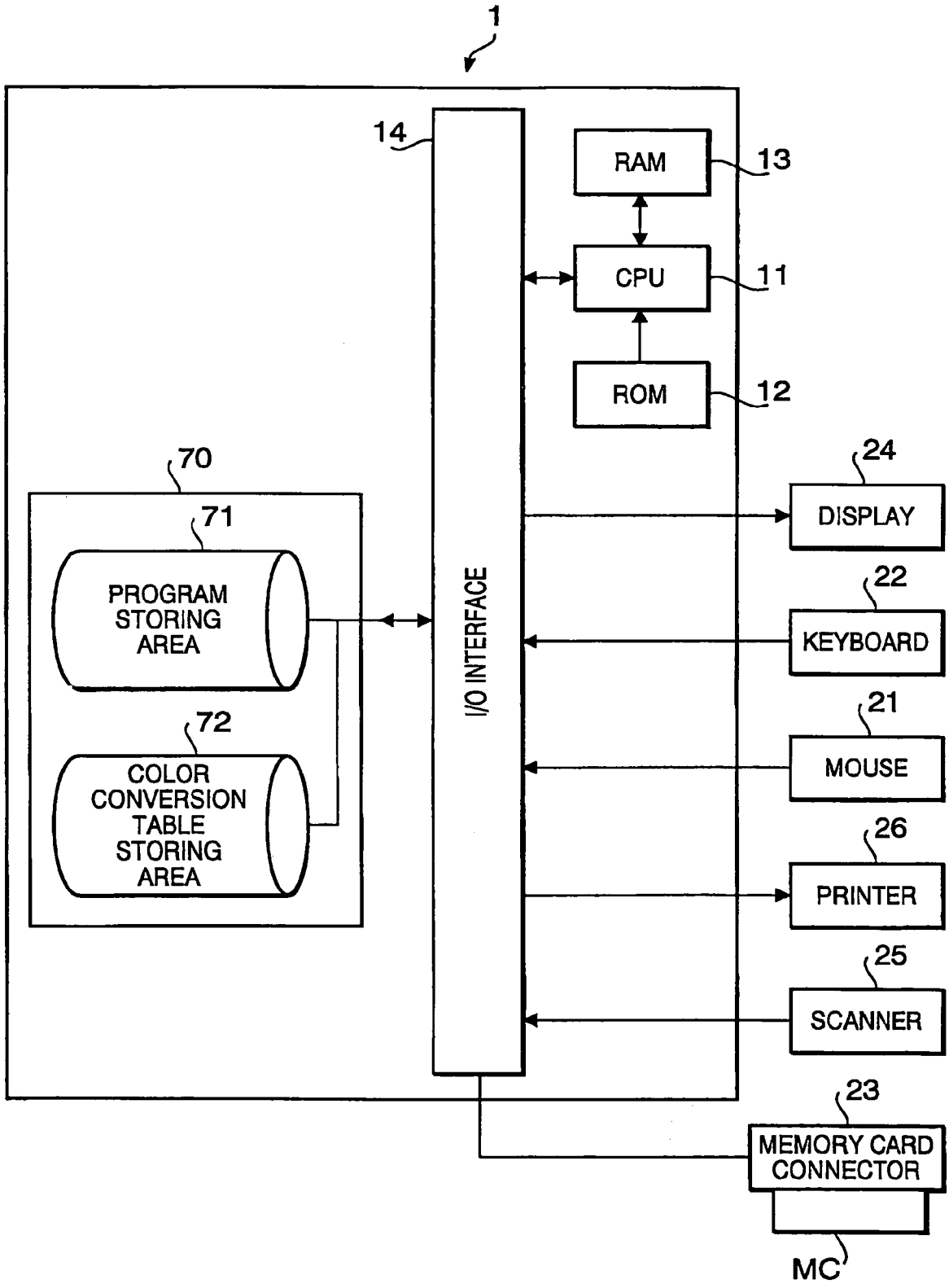
FIG. 2 is a block diagram illustrating an electrical configuration of an image editing device according to the invention.

FIG. 1 shows a system configuration of a print/embroidery data creating device 1 according to the invention, and FIG. 2 is a block diagram showing a functional configuration of the print/embroidery data creating device 1.

The print/embroidery data creating device 1 is for editing/creating the embroidery data and print data to be supplied to the embroidering machine and inkjet printer, respectively. The print/embroidery data creating device 1 includes a main body 10, a mouse 21, a keyboard 22, a memory card connector 23, a display 24, an image scanner 25 and a printer 26. The mouse 21, keyboard 22, memory card connector 23, display 24, image scanner 25 and printer 26 are all connected to the main body 10.

As shown in FIG. 2, the print/embroidery data creating device 1 includes a CPU 11, a ROM 12, a RAM 13, and an I/O interface 14. The mouse 21, keyboard 22, memory card connector 23, display 24, image scanner 25 and inkjet printer 26 are connected to the I/O interface 14. In FIG. 2, MC denotes a memory card to be inserted in the memory connector 23. The I/O interface 14 is also connected with an HDD (hard disk drive) 70. The HDD 70 includes a program storing area 7 storing programs executed by the CPU 11, and a color conversion table storing area 72.

The CPU 11 executes various operations in accordance with a print/embroidery data creating program, which is stored in the ROM 12. It should be noted that, if the print/embroidery data creating device 1 is a dedicated device, the program may be stored in the ROM 12. If the device 1 is used as a general purpose device, the program may be stored in the HDD and is retrieved in the RAM 13 for execution.

The RAM 13 is a readable/writable memory and is capable of storing image data transmitted from the image scanner 25 and/or retrieved from an external device such as the hard disk (not shown), CD-ROM and CD-R.

Next, the overall flow of operations from input of image data to completion of producing the T-shirt will be described in detail.

FIG. 2 schematically shows a structure of the RAM 13 of the image editing device 1 shown in FIG. 1. As illustrated, the RAM 13 has a print data storing area 321 for temporarily storing print data created by the print/embroidery data creating device 1, an input image data storing area 322 for storing an input image prepared and input by a user of the print/embroidery data creating device 1, a scanned image data storing area 323 for storing the imaged data representing the image scanned by the scanner 25, and an ejection amount storing area 324 (which will be referred to in a fourth embodiment) for temporarily storing the ink ejection amount designated by the user with respect each of the designated areas of the image data. Although not indicated, the RAM 13 also includes other areas for storing various data.

First Embodiment

FIG. 4 is a flowchart illustrating an overall operation from input of image data to output of image pattern on an object (e.g., T-shirt). FIG. 5 shows an example of the input image data.

As shown in FIG. 4, a user of the print/embroidery data creating device 1 inputs image data in the main body 10. The image data to be input may be created using the image scanner 25, or retrieved from an external storage such as the hard disk, CD-ROM, CD-R and input to the main body 10. According to the first embodiment, it is assumed that a photograph of a person as shown in FIG. 5 is scanned by the image scanner 25 to generate the image data.

Next, upon instruction of the user, a print/embroidery data creating procedure is executed (S202). By the print/embroidery data creating procedure, the print/embroidery data is created based on the image data input in S201.

The print/embroidery data creating procedure will be described in detail.

FIG. 6 is a flowchart illustrating a main procedure of the print/embroidery data creating procedure which is called in S202 of the flowchart shown in FIG. 4. In this procedure, process requests the user to designate usable colors (S211). The term "usable color(s)" in this specification is defined as colors to be used in the embroidering machine and are arbitrarily designated by the user. Specifically, in S211, a usable color input dialogue as shown in FIG. 7 is displayed on the display 24. Then, the user designates, using the mouse 21 and keyboard 22, one of more colors as the usable colors. In this step (S211), process firstly asks the user to input the number of colors of the embroidery threads to be used. Then, process requires the user to fill in the usable color input dialogue by the input number of times so that the color information and color code for each embroidery thread is set. As the information for each embroidery thread has been input, a usable color table as shown in FIG. 8 is created.

In the usable color table shown in FIG. 8, the RGB values are stored related to the color codes, respectively. The usable color table is created in the RAM 13 of the main body 10, and stored in the RAM 13. Optionally, the user may set the order of usage of the colors (threads) in S211, which may also be stored in the RAM 13. It should be noted that the order of the usage of the color threads may be set beforehand, or the user may input the order following input instructions displayed on the display 24. The designated usage colors should be identical to the colors of the threads used in the embroidering machine. However, it may be modified such that the threads having colors not identical but close to the designated usage colors may be selected in the embroidering machine.

In the first embodiment, for the sake of brevity, it is assumed that the user designate "black" as the usable color. Thus, through the input dialogue shown in FIG. 7, the thread information and color code for black are input, and in the usable color table (FIG. 8), the color code of the black thread and its RGB values are stored.

In S212, the user designates the output size and output position. The output size represents the actual size of an image formed (printed/embroidered) on the fabric (e.g., T-shirt), and the output position represents the actual position of the image formed on the fabric. The user inputs the output size and output position, using the mouse 21 and keyboard 22, through an input dialogue (not shown) displayed on the display 24. Although not shown, it is preferable that the designation of the size and position may be input using the unit of cm (centimeters), mm (millimeters), inches or the like. The unit of pixel may be inappropriate for this purpose since it does not indicate a measurable length. In the first embodiment, it is assumed that the image as shown in FIG. 5 is output at a predetermined position on the T-shirt, the size of the image being 120 mm (H)×90 mm (W).

It should be noted that, when the image shown in FIG. 5 is input, either the entire image or only a part of the image may be output. In the first embodiment, it is assumed that, in the image shown in FIG. 5, a background portion other than the person is excluded from the output image, and only the face and neck of the person are output by printing and embroidery. It should be note that designation of portions to be output can be done by displaying an image as shown in FIG. 5 on the display 24, and allowing the user to designate the portions to be output with the mouse 21 and the keyboard 22. Such an image editing process is well-known, and is not described in detail herein.

When the usable colors are designated in S211, and the output size and position are designated in S212, an area separating procedure is executed in S213. In the area separating procedure, process judges whether each pixel of the image data input in S201 corresponds to the usable colors designated in S211. If the color of a pixel corresponds to one of the usable colors, the pixel is determined to be in an area which is embroidered with the thread having the corresponding color. Otherwise, the pixel is determined to be out of areas which are embroidered. The pixels which are not included in the embroidered areas are formed by printing (i.e., regarded to be included in a printing area). In the first embodiment, as described above, the usable color is assumed to be one, black. Additionally, it is assumed that, in the embroidering machine, the other area (i.e., the area other than the areas corresponding to the usable colors) is embroidered with white threads.

As shown in FIG. 9, in the area separation procedure (S213), a threshold value T is set (S231). The threshold value T serves as a standard for determining whether it belongs to the usable color areas. The threshold value T may be determined by the user for each usable color, or one threshold value T may be used for all the usable colors. Alternatively, a value preliminarily stored in the main body 10 may be used automatically as the threshold value T.

Next, for each pixel of the image data input in S201, scanning is performed and each pixel is examined. For this purpose, an initial point (X=0, Y=0) of the X-Y coordinate system is set (S232). Then, the RGB values of a pixel (X, Y) are obtained (S233). Since the first values of X and Y are 0 and 0, respectively, initially, the RGB values of pixel (0, 0) are obtained.

When the RGB values of the pixel (X, Y) are obtained in S233, a color difference distance D is calculated (S234). The color difference distance is the absolute value of a distance between the RGB values of the usable color and those of the notice pixel. When the color distance value D is greater, the difference between the color of the notice pixel and the usable color is greater, and if the color distance value D is smaller, the difference between the color of the notice pixel and the usable color is also smaller. The color difference distance D is defined by the following formula:

$$D=\sqrt{(r1-r2)^2+(g1-g2)^2+(b1-b2)^2} \quad (1)$$

where the RGB values of the usable color are (r1, g1, b1), and the RGB values of the notice pixel are (r2, g2, b2).

Next, the color difference distance D calculated in S234 and the threshold value T set in S231 are compared (S235). As a result of the comparison, if the color difference distance D is equal to or less than the threshold value T (S235: YES), the notice pixel is determined to fall within the usable color area (S236). If the color difference distance D is greater than the threshold value T (S235: NO), the notice pixel is determined to be in the print area (S237).

That is, in S235, if the color difference distance D is equal to or smaller than the threshold value T, process determines that the color of the notice pixel is within a color range which can be expressed as the usable color. If the color difference distance D is greater than the threshold value T, process determines that the color of the notice pixel is very different from the usable color and the pixel color cannot be expressed using the usable colors. In such a case, the notice pixel is determined to be within a print range in which the color is expressed by the printed image.

If all the pixels have not been processed (S238: NO), that is, there remains unprocessed pixels, next values of X and Y coordinates are set (S239), and process returns to S233. Until all the pixels are processed, steps S233 through S238 are repeated. As a result, for example, the usable color is "black", an area consists of a group of pixels corresponding to "black" is set as the usable color area, and the other areas are set as the print areas.

After all the pixels constituting the image data have been processed (S238: YES), if the procedure has not been performed for all the usable colors (S240: NO), process returns to S231. That is, if a plurality of usable colors have been designated in S211 and for at least one of the usable colors, the above steps have not been executed, process returns to S231. If for all the usable colors, the above steps have been finished, process finished the procedure. Accordingly, for all the usable colors designated in S211, steps S231-S240 are repeated. As a result, if in S211, "black" and "red" are designated, the usable color areas and print areas for "black" and the usable color areas and print areas for "red" are set. If a plurality of usable color areas are set; areas which do not correspond to any one of the usable colors are determined as the print areas, finally, and the other areas are set as one of the plurality of usable color areas.

As above, by the area separation procedure (FIG. 6: S213), the pixels of the image data input in S201 are categorized into the pixels included in the usable color areas, which will be embroidered by the embroidering machine, and the pixels included in the print areas, which will be formed by the inkjet printer. According to the first embodiment, the image data input is S201 is a photographic image of a human face as shown in FIG. 5, and the usable color designated by the user in S211 is "black". Therefore, the pixels of the image data shown in FIG. 5 are grouped and separated as shown in FIGS. 10A and 10B. As shown in FIG. 10A, in this example, the area set as the usable color area corresponds to the hair portion, the pixels of which has a relatively small color difference distance D with respect to "black". The other areas, i.e., the pixels of the area other than the usable color area correspond to the portion of the face other than the hair portion as shown in FIG. 10B.

Back to FIG. 6, in the main body 10, an embroidery data creating procedure is executed (S214) after the area separation procedure (S214). In the embroidery data creation procedure, the embroidery data is created based on the usable color areas.

The embroidery data includes a color code, an embroidery position, a size of the embroidery and stitch data indicating stitches for forming an image pattern with stitches. The stitch data indicates stitch positions by means of, for example, a moving amount, at every stitch, of the fabric in the X-axis and Y-axis directions in the X-Y coordinate system intrinsic to the embroidering machine.

Further, in the embroidery data creating procedure (S214), the image data represented in units of pixels is converted into the actual output size. The position at which the image pattern is embroidered is also represented by actual position on the fabric. Thus, the stitch data including the actual stitch positions on the fabric is created. In this example of the first embodiment, in S212, the user has designated that the image of 12 cm (H)×9 cm (W) is output on a predetermined position of the fabric.

It should be noted that a ratio of the size of the image data in units of the pixel to the size thereof in units of the actual length (cm, mm or the like) in the embroidery data creating procedure (S214) is equal to a ratio of the size of the image data in units of pixel to the size thereof printed out by the inkjet printer in the print data creating procedure (S216). With this setting, the embroidery data created by the embroidery data creating procedure (S214) and the print data created by the print data creating procedure (S216) are converted at the same ratio. Therefore, there embroidery data and the print data have consistency in the output sizes and output positions.

Various methods have been conventionally known for creating the embroidery data from the image data, and any one of the conventional methods can be employed in the present invention. In the first embodiment, as an example, the embroidery data creating method described in Japanese Patent Provisional Publication No. P2001-259268A is employed. This method is particularly applicable when the original image having a characteristic such that its thickness density or color changes two-dimensionally and continuously is to be re-formed with the embroidery.

According to the first embodiment, in S214, the embroidery data for the usable color of "black" is created. Further, according to the first embodiment, to the areas other than the usable color area (i.e., the print area), an embroidery with "white" threads is assigned. Therefore, according to the first embodiment, with respect to the area set as the print area, the embroidery data creating procedure (S214) is executed, and the embroidery data of the usable color of "white" is created, which will be referred to as second embroidery data.

FIG. 11A shows the pattern represented by the embroidery data of the usable color (i.e., "black"). In the usable color area set in the area separation procedure (FIG. 9) corresponding to the hair portion of the person shown in FIG. 5, the embroidery data for the "black" thread is created. FIG. 11B shows the pattern represented by the embroidery data of the color of "white". As afore-mentioned, for the area determined as the print area in S213, which is the area other than the hair portion of the person shown in FIG. 5, the second embroidery data, which represent the embroidery with "white" thread. It should be noted that the output size of each of the patterns shown in FIGS. 11A and 11B is 12 cm (H)×9 cm (W), which has been input by the user in S212.

In the main body 10, when the embroidery data creating procedure (S214) is executed and the embroidery data for each usable color is created, an embroidery data synthesizing procedure for combining all the pieces of the embroidery data into one embroidery data is executed (S215). That is, the embroidery data for each usable color is synthesized to form the synthesized embroidery data having a form of: "color code for white"+"stitch data in print area"+"color code for usable color 1"+"stitch data corresponding to usable color 1"+"color code for usable color 2"+"stitch data corresponding to usable color 2" . . . "color code for usable color n"+"stitch data corresponding to usable color n". The synthesized embroidery data is configured such that embroidery data for respective usable colors is bunched into one data, and further contains the stitch data indicating the position of the embroidery on the fabric and related information including the color codes of the usable colors. The synthesized embroidery data represents the actual output size and output position of the embroidery formed by the embroidering machine.

The embroidery data will be described in detail, referring to FIGS. 12 and 13.

As shown in FIG. 12, the synthesized embroidery data includes the color change code 41, stitch code 42, feed code 43 and end code 44. The color change code 41 indicates the color code of the usable color. The stitch code 42 is coordinate information indicating embroidered positions using the thread of the usable color indicated by the color change code 41. The feed code 43 is inserted between discrete stitches and indicates a break of continuous stitches. The end code 44 is a indication code provided at the end of the embroidery data. The embroidering machine recognized the end of the embroidery data as it detects the end code 44. Each piece of embroidery data corresponding to each usable color starts from the color change code 41, and includes repetition of the stitch code 42 and feed code 43. The embroidery data for respective usable colors are synthesized to one piece of data and the end code 44 is added at the end thereof. The thus created data is the synthesized embroidery data created in S214.

In the embroidering machine, the synthesized embroidery data is read from the top. When the color change code 41 is read, the thread having the color same as the usable color indicated by the color change code 41 is automatically set to a predetermined position, or notifies the user that the thread should be placed at the predetermined position. Then, in accordance with the coordinates (stitch points) indicated in the subsequent stitch code 42, the embroidery operation using the thread of the usable color is executed. In the example of FIG. 12, the stitch code 42 is configured such that the moving amounts of the fabric in the X and Y directions for each stitch are indicated with continuous values of the X-coordinate and Y-coordinate.

Further, when the feed code 43 is read, in the embroidering machine, it is determined that the operation comes to the end of the continuing stitches, and the ending stitch is performed. Thereafter, the next stitch code 42 is read, the fabric is moved such that the next needle fall point indicated in the stitch code 42 is located at the needle position with the embroidering movement being stopped. When the needle fall point is located at the needle position, the ending stitch is executed again. As above, before and after the feed code 43, the ending stitches are performed. The ending stitches are performed because of the following reason.

In a case of embroidering, the length of one stitch is 1-3 mm. When the embroidery is to be formed with the same usable color is discontinued, if the stitches are done continuously without forming a break, the embroidery may be unraveled. Therefore, between the discontinued stitches, the feed code 43 is provided so that the continuous stitches are grouped and included in the stitch code 42, and at the first needle fall point and the last needle fall point of each stitch code 42, the ending stitches are formed to prevent the unraveling of the embroidery.

When the embroidery operation (i.e., repetition of the stitch code 42 and the feed code 43) is executed for all the color codes 41, and lastly, the end code 44 is read, the end of the embroidery data is recognized in the embroidering machine, and the embroidery operation is finished.

As shown in FIG. 13, the stitches indicated by solid lines are the series of a plurality of stitches (stitch codes 42), and indicated by a plurality of coordinates indicating the stitch positions (e.g., (Xa, Ya), (Xm1, Ym1), (Xm2, Ym2), . . . , (Xb, Yb)). At the coordinates of the beginning and end of the series of stitches, the end stitching 44 is performed. When the feed code 43 is read, the fabric is fed such that a stitching point is moved from the coordinate (Xb, Yb) representing the end of the stitch code 42 to the coordinate (Xc, Yc) representing the start of the stitch code 43 with the embroidery being unapplied. Thereafter, beginning from the coordinate (Xc, Yc), the embroidery according to the stitch code 43 is started in the order of the coordinates (needle fall points) of (Xc, Yc), (Xn1, Yn1), (Xn2, Yn2), . . . (Xd, Yd).

In the first embodiment described above, the second embroidery data for white threads is created for the pixel area(s) other than the usable color area(s) (i.e., for the print areas) although "white" is not designated as the usable colors. Thus, according to the first embodiment, the "color code for white" and "stitch data for the print area" are incorporated in the embroidery data, at the beginning thereof.

It is of course possible to modify the above such that the embroidery is not formed in the area(s) other than the usable color area (i.e., the print area(s)). In such a case, the embroidery data, which is a combination of a plurality of pieces of embroidery data respectively for a plurality of usable colors such as "color code for usable color 1"+"stitch data for usable color 1"+"color code for usable color 2"+"stitch data for usable color 2" . . . +"color code for usable color n"+"stitch data for usable color n" is created.

FIG. 14 shows an exemplary image represented by the synthesized embroidery data which is a combination of a plurality of pieces of embroidery data corresponding to a plurality of usable colors created in S215. By synthesizing the embroidery data respectively representing the patterns shown in FIGS. 11A and 11B, the hair portion, which corresponds to the usable color area, is embroidered with black threads, and other portions of the face, which is set as the print area, is embroidered with white threads, the resultant data (i.e., the synthesized embroidery data) represents the pattern shown in FIG. 14. It should be noted that the synthesized embroidery data also represents the pattern of 12 cm(H)×9 cm(W) on the T-shirt, and the pattern is embroidered at the designated portion of the fabric.

Back to FIG. 6, a print data creating procedure for creating the print data corresponding to the print area is executed in S216.

In S216, the output size is determined such that the ratio of the size of the image data in units of pixel to the pattern output by the inkjet printer in units of actual dimension (i.e., cm, mm or the like) is equal to the ratio of the size of the image data in units of pixel to the pattern output by the embroidering machine in units of actual dimension (i.e., cm, mm or the like). With this configuration, since the print data created in the print data creating procedure (S216) and the embroidery data created in the embroidery data creating procedure (S214) uses the same conversion ratio, the embroidery data and the print data have consistency in output sizes.

In the print data creating procedure (S216), the print data is created in accordance with the data of the pixels in the print area (i.e., the area other than the usable color area) which is set in the area separation procedure (S213). Specifically, according to the first embodiment, the image area shown in FIG. 10B is set as the print area. That is, the area other than the area of the hair is set as the area to be printed by the inkjet printer.

It should be noted that various methods for creating the print data based on the image data have been known conventionally. Further, various methods are employed depending on a application and/or data format to be used. Importantly, any one of such methods can be employed in the print/embroidery data creating device 1 according to the first embodiment. Only an exemplary application of one method will be described below.

In the print data creating procedure (S216), data items necessary for creating the print data based on the image data are set. The necessary data items include, at least, "print range", "print resolution" and "print-subject image". The "print area" represents the output size and output position on the object (e.g., T-shirt) when the image pattern is printed by the inkjet printer. The "print resolution" represents the number indicating the resolution at which the image is printed by the inkjet printer. In other word, the "print resolution" indicates the quality of the printed image. The "print-subject image" is the information of the pixel areas constituting the image data to be printed.

By the information "print area", the output size is defined by the height and width, and the output position is defined by a horizontal start position and a vertical start position. In this example, the size (i.e., 12 cm(H)×9 cm(W)) which is input by the user in S212 is obtained. This size is expressed in inch, 4.72 inches (i.e., approximately 12 cm) in height×3.54 inches (i.e., approximately 9 cm) in width. As the "print-subject image", the image data 24B which is set as the print area in the area separation procedure in S213 is set. Further, the "print resolution" can be a value the user arbitrarily set of a predetermined default value may be used. In this example, it is assumed that the "print resolution" is 600 dpi (H)×600 dpi (W).

After each of the data items are set as above, the print data having the structure shown in FIG. 15 is generated.

As shown in FIG. 15, the print data includes:

- a print area designation code 51, which is an identifier indicating the print area;
- a print area 52 which is the body of the data of the print area designation code 51 and indicating the output size and output position (horizontal start position, vertical start position, width and height);
- a resolution designation code 53 which is an identifier indicating the print resolution; and
- a unit DPI which is the body of the data of the resolution designation code and indicates the print quality of the image on the object in units of dot.

The print data further includes an image data designation code 55 which is an identifier indicating that the data designates the image data information. The image data information includes:

- an image size designation code 56 which is an identifier indicating that the data designates the size of the image;
- an image size 57 that indicates the size (height and width) of the image in units of pixel:
- a pixel designation code 58 which is an identifier indicating the data is one indicating the pixels constituting the image data; and
- pixel values 59 which indicate the RGB values of each pixel.

The pixel values 59 are repeatedly indicated to indicate the values for all the pixels constituting the image data, whose size is indicated by the image size 57. At the end of the print data, the end code 60 is provided, which is an identifier indicating the end of the print data.

The print data is configured such that the print area excluding the hair portion is printed by the inkjet printer as shown in FIG. 16. The output size of the image data is 4.72 inches in height (i.e., approximately 12 cm) and 3.54 inches in width (i.e., approximately 9 cm). The print resolution is 600 dpi in height and 600 dpi in width. Therefore, the numbers of print dots within the output area of the image data are 2833 dots×2126 dots (600 dpi×4.72 inches=2833 dots in height, and 600 dpi×3.54 inches=2126 dots in width). The image data is magnified/reduces so that the modified image data is expressed the above number of dots. Then, in the inkjet printer, the printing operation is executed in units of dots. It should be noted that the print data also corresponds to the output size and output position input by the user in S212, similarly to the embroidery data.

Back to FIG. 6, in the main body 10, the print/embroidery data editing procedure is executed in S217. In the print/embroidery data editing procedure, the embroidery data created in S215 and the print data created in S216 are edited and a single piece of data is created, in which the embroidery data and the print data are related to each other.

In the print/embroidery data editing procedure (S217), data is edited to have a structure: "embroidery data start code"+"embroidery data"+"print data start code"+"print data"+"print/embroidery data end code".

Optionally, at the top of the print/embroidery data, a "print/embroidery data start code" which is an identifier indicating the start of the print/embroidery data may be provided. Further optionally, to each of the embroidery data and the print data, the "start code" and the "end code" may be added. In such a case, "print/embroidery data end code" is unnecessary.

As above, the print/embroidery data creating procedure (S202) is executed, and the embroidery data to be used in the embroidering machine and the print data to be used in the inkjet printer are created in related fashion.

When the print/embroidery data is created (FIG. 4, S202), the print data and embroidery data included in the print/embroidery data are output to the memory card inserted in the memory card connector 23 (S203). When the data is transmitted to the memory card, embroidery data transmitting application installed in the print/embroidery data creating device 1 converts the print/embroidery data into data having a predetermined format which can be interpreted by the embroidering machine.

The "embroidery data start code" is the identifier indicating the start of the embroidery data of the print/embroidery data. When the embroidery data transmitting application reads this identifier, the following data, i.e., "embroidery data" is transmitted to the memory card, and when the application reads the "print data start code", it finishes transmitting the data.

Print data transmitting application installed in the print/embroidery data creating device 1 converts the print/embroidery data into data having a predetermined format which can be directly interpreted by the inkjet printer. A "print data start code" is an identified indicating the start of the print data in the print/embroidery data. When the print data transmitting application read this identifier, the following data, i.e., "print data" is transmitted to the memory card. When the print data transmitting application reads the "print/embroidery data end code", it finishes transmission of the data. As above, the print data and the embroidery data are converted and output to the memory card.

Optionally, the print/embroidery data creating device 1 and the inkjet printer may be connected and the data may be transmitted directly from the print/embroidery data creating device to the inkjet printer.

The user inserts the memory card in which the embroidery data has been stored in S203 into the memory card device connected to the embroidering machine, and sets the objective fabric (T-shirt) at the predetermined position of the embroidering machine, and starts the embroidery operation.

In the embroidering machine, the embroidery data is retrieved from the memory card loaded to the memory card device, and the embroidering operation for embroidering the pattern on the T-shirt is automatically executed in accordance with the retrieved embroidery data.

As a result of the embroidering operation of the embroidering machine, the content of the embroidery data shown in FIG. 14 is transferred onto the T-shirt as an embroidery pattern. That is, corresponding to the hair portion which is set as the usable color area in the area separating procedure (S213), an embroidery using the usable color "black" is formed. Further, corresponding to the area which is not set as the area other than the usable color area (i.e., the print area), an embroidery using the white thread is formed. It should be noted that the output size is 12 cm(H) 9 cm(W), which is the size input by the user in S212, and the output position is the position input by the user in S212.

When the embroidering operation by the embroidering machine is finished, the memory card in which the print data has been stored in S203 is loaded in the memory card device provided to the personal computer that controls the operation of the inkjet printer, and transmits the print data into the inkjet printer. After the T-shirt on which the embroidery is formed by the embroidering machine is placed at a predetermined position of the inkjet printer, the printing operation is started.

In the inkjet printer, the converted print data is transmitted from the memory card loaded to the memory card device, and the printing operation is executed in accordance with the transmitted print data (S205).

The print data created in S202 reflects the output size of the inkjet printer and a relative output position with respect to the print area of the inkjet printer. Then, in S203, the print data is converted into a format that can be interpreted by the inkjet printer using a printer driver and the like. Thus, if the printer is in an environment where the print data contained in the print/embroidery data into a form that can be interpreted by the printer, any printer can use the print data.

As above, in the inkjet printer, the automatic printing operation to print the image pattern on the T-shirt is executed in accordance with the print data contained in the print/embroidery data. Thus, the image shown in FIG. 16, which is represented by the print data, is printed on the T-shirt. That is, the printing operation is performed to print the pixel area which is set as the print area (i.e., the area other than the hair portion) in the area separating procedure of S213. Regarding the example shown in FIG. 16, an image 4.27 inches high (i.e., approximately 12 cm)×3.54 inches wide (i.e., approximately 9 cm) is printed with 2833 dots in height×2126 dots in width on the T-shirt at a predetermined output position.

On a portion of the T-shirt where the embroidery with white threads is formed, the image shown in FIG. 16 (i.e., an image other than the hair of the image shown in FIG. 5) is printed.

As a result, as shown in FIGS. 17A-17C, the face of the person represented by the image data is formed on the T-shirt as a combination of the embroidered area and printed area. That is, the embroidery data representing the image shown in FIG. 17A indicates that the hair portion is embroidered with the black thread and the other area is embroidered with the white thread. Further, the print data representing the image shown in FIG. 17B indicates that the image other than the hair portion is printed. As a result of the embroidery shown in FIG. 17A and the printing shown in FIG. 17B, the face shown in FIG. 17C is formed on the T-shirt.

As described above, with the print/embroidery data creating device 1 according to the first embodiment, the pixels constituting the image data are analyzed and usable color area(s) and the print area(s) are set. Then, the embroidery data corresponding to the usable color area(s) and the print data corresponding to the print data area(s) are created in a related manner. Further, based on the image data, the outputs which well reflect the characteristics of embroidery and printing can be obtained. As described, the print data and embroidery data have consistency in the output size and position of the image pattern.

Further, based on the usable colors designated by the user, the pixels constituting the image data is analyzed and the usable color area and print area are set. Therefore, the print data and embroidery data which meet various conditions such as the user's needs, performance of the embroidering machine and the like can be created, freely and arbitrarily. Further, the print data and embroidery data corresponding to the output size and position designated by the user can be created. Further, the print/embroidery data including the print data and embroidery data which are related to each other can be created.

When the printing/embroidering operations are performed based on the print data and embroidery data, the image pattern represented by the image data is formed on the T-shirt in such a manner that the printed pattern and embroidered pattern are combined. Further, the printed pattern and the embroidered pattern have consistency in the output size and output position. Therefore, the characteristics of respective patterns (i.e., printed pattern and embroidered pattern) are well made use of, and an image having different impression in comparison with the image formed only by printing or embroidering can be output on the fabric such as the T-shirt.

Furthermore, since the embroidery data and print data are edited and one piece of print/embroidery data is created, it is convenient in comparison with a case where the print data and embroidery data exist separately. Further, by forming a single piece of data, the consistency between the data can be improved.

In the first embodiment, in the print area, the embroidery with the white thread is formed, and then the image pattern is printed thereon. Thus, the output in which the image is printed on the embroidery can be obtained, which provides a flavor that has not been obtained conventionally.

Second Embodiment

Next, a print/embroidery data creating device according to a second embodiment will be described. According to the first embodiment, only the area set as the usable color area is embroidered. That is, in the first embodiment, for the area other than the usable color area, the second embroidery data is created. Then, in the first embodiment, the embroidery with the white thread is formed based on the second embroidery data. In the second embodiment, for the print area, only the printed image by the inkjet printer is formed.

FIGS. 18A-18C illustrate an image pattern output by a print/embroidery data editing procedure according to the second embodiment. That is, FIGS. 18A-18C show an embroidered pattern represented by embroidery data, a printed pattern represented by print data, and a resultant pattern formed on a T-shirt, respectively.

FIG. 18A shows the pattern represented by the embroidery data, which indicates that only the hair portion of the face is embroidered with the black thread. FIG. 18B shows the print data, which is similar to the print data according to the first embodiment. As the pattern shown in FIG. 18A and the pattern shown in FIG. 18B are embroidered/printed, the image pattern shown in FIG. 18C is formed on the T-shirt. The other features are similar to those of the first embodiment.

According to the second embodiment, since it is unnecessary to form the embroidery with the white thread in the print area, that is, only the printing by the inkjet printer is performed for the print area, the entire process of forming the print/embroidery image pattern on the T-shirt can be done quicker. If the embroidery with the white thread is formed in the print area, it is necessary that the embroidery should be done prior to the printing so that printed image is formed on the embroidery with the while thread. According to the second embodiment, since the embroidery is not formed for the print area, there are no overlapped portions between the printed image pattern and the embroidered image pattern. Therefore, the order of the printing and embroidering can be set freely.

Third Embodiment

Next, a print/embroidery data creating device according to a third embodiment will be described. The hardware configuration of the print/embroidery data creating device according to the third embodiment is similar to that of the first embodiment. According to the third embodiment, it is assumed that image data representing an image 4 shown in FIG. 21 is scanned with the image scanner 25 in S201 (see FIG. 4). As shown in FIG. 21, the image 4 is configured such that a left-hand side half includes a pixel area 4*a* which is black, and a right-hand side half includes a pixel area 4*b* which is white. At the boundary of the black pixel area 4*a* and the white pixel area 4*b*, a pixel area 4*c* is formed, in which the color gradually changes from black to white in the left-to-right direction.

In S202, the print/embroidery data is created based in the input data 4. FIG. 22 is a flowchart illustrating the main flow of the print/embroidery data creating procedure. The print/embroidery data creating procedure shown in FIG. 22 is similar to that shown in FIG. 6 except that step 211A is added after S211 and S213 of FIG. 6 is replaced with S213A. Since the steps of FIG. 22 having the same numbers of steps of FIG. 6 are substantially the same, description will be made in detail only on steps S211A and S13A.

In S211A, an assumption of a stitch is made. The assumption of stitch is to set the type of stitch to be carried out by the embroidering machine preliminary. That is, there a plurality of types (e.g., column fill stitch, satin stitch etc.) of stitching for embroidering a pattern. In S211A, process request the user to designate the type of stitch to be used for embroidering. The direction of the stitches, pitch of the stitches and density thereof are also input by the user.

Specifically, a stitch designation dialogue as shown in FIG. 23 is displayed on the display 24. The user designates a desired type of stitch through this dialogue using the mouse 21 and keyboard 22. In the example shown in FIG. 23, the type of the stitch, direction, density and pitch can be input by the selection from a pull-down menu or typed in an input box. In the example shown in FIG. 23, the assumption stitch for outputting the image data 4 on the fabric such as the T-shirt, a pitch is set to 3 mm and the density is set to 3 lines/mm.

In S212, the output size and position are designated by the user. Similar to the first and second embodiments, for the explanation purpose, it is assumed that the output size is 120 mm in height and 90 mm in width.

FIGS. 24 and 25 are charts illustrating the output size and position of the image pattern. The image data 4 (FIG. 21) to be output on the fabric such as the T-shirt as embroidered and/or printed pattern with the size of 120 mm(H)×90 mm(W). In particular, when the image pattern is output by the embroidering, since the type of stitch has been set to the horizontal column fill stitch in the stitch assumption process, the image data 4 is output in accordance with the set stitch as shown in FIG. 24. That is, a plurality of horizontally extending stitches. Since the stitches are made at the pitch of 3 mm and 3 lines/mm, as shown in FIG. 25, in the horizontal direction, each stitch is formed to have a width of 3 mm, and accordingly, 30 stitches are formed in the width direction within the output area having the width of 90 mm. In the vertical direction, three stitches are formed within a height of 1 mm. Therefore, in the vertical direction, 360 stitches are formed in the vertical direction within the output area having the height of 120 mm.

Next, in S213A, a color continuity examining procedure is executed. In the color continuity examining procedure, with respect to the image data input in S201, it is examined whether a plurality of pixels included in a small area corresponding to each stitch correspond to the same usable color. If the plurality of pixels included in a small area corresponding a stitch corresponds to the same color, the pixels corresponding to the stitch are set as the embroidery area. Otherwise, the area is set as the print area. According to the third embodiment, the area other than the areas corresponding to the usable colors (i.e., the print area), an embroidery with the white thread is formed, similarly to the second embodiment.

The color continuity examining procedure (S213A) will be described in detail hereinafter. FIG. 26 is a flowchart illustrating the color continuity examining procedure in detail.

As shown in FIG. 26, in the color continuity examining procedure, a threshold value T is set (S331). The threshold value T is used as a standard to determine whether each pixel constituting the image data should be determined to be included in the embroidery area The threshold value T may be arbitrarily set by the user, or a single threshold value T commonly used for the examination with respect to all the usable colors. Alternatively, a preliminarily stored threshold value T in the main body 10 may be automatically set.

In S332, a stitch subject to be examined is identified (S332). That is, one of the stitches necessary to output the image data 4 is identified as the subject of the examination.

Here, a relationship between the pixels constituting the image data 4 input in S201, the stitch assumed in S211A and the output size and position designated in S212 will be described. As aforementioned, the image pattern represented by the image data 4 is to be output with the output size of 120 mm(H)×90 mm(W), on the designated T-shirt, in accordance with the 360 stitches which are made by the embroidering machine.

FIG. 27 shows a relationship between the pixels constituting the image data 4 and the assumed stitches. As shown in FIG. 27, start and end points of the assumed stitch are the needle fall points of the embroidering machine. The needle fall points correspond to a plurality of pixels of the image data 4, respectively. For example, the start point of the stitch corresponds to pixel 401, and the end point of the stitch corresponds to the end point 205.

In S332, one of the assumed 360 stitches is identified. In this example, it is assumed that the stitch closer to the start position of the coordinate system of the embroidering machine is selected. Then, a small area corresponding to the identified stitch is set, and a pixel 401 (X0, Y0) corresponding to the start point of the stitch within the small area is obtained (S333). In S334, the RGB values of the pixel 401 (X0, Y0) obtained in S333 is obtained.

In S335, the usable color used for the examination is determined (S335). The determination of the usable color is carried out such that the usable color table (FIG. 8) is referred to and one of the usable colors contained in the usable color table is identified in the order of the entry therein.

In S336, based on the RGB values of the pixel 401 (X0, Y0) obtained in S334 and the RGB values of the usable color identified in S335, the color difference distance D is calculated (S336) in accordance with the formula (1) described above.

In S337, the color difference distance D is compared with the threshold value T. If it is determined that the color difference distance D is greater than the threshold value T (S337: YES), the color of the pixel 401 (X0, Y0) is very different from the usable color and cannot be expressed using the usable color. Therefore, in such a case, it is inappropriate to form the pixel 401 (X0, Y0) with the thread of the usable color. If the procedure is executed for all the usable colors (S338: NO), process returns to S335 and the next usable color is identified from the usable color table. As above, steps S335 through S338 are repeatedly executed to judge the color difference of the pixel (X0, Y0) with respect to the usable color so that the usable color which can express the pixel 401 (X0, Y0) is searched.

If, for all the usable colors stored in the usable color table, the process is executed (S338: YES), there is no usable colors in the usable color table to express the pixel 401 (X0, Y0). In such a case, it is inappropriate to express the stitch with the embroidery. Accordingly, in this case, all the pixels included in the small area is determined to be included in the print area, which are expressed by printing of the inkjet printer (S339). With this procedure, in the case of FIG. 27, all of the pixel 401 (X0, Y0), pixel 402 (X1, Y1), . . . pixel 403 (Xm, Ym) which are included in the small area corresponding to the stitch are set to be included in the print area.

If there is the usable color satisfying the condition that the color difference distance D is equal to or less than the threshold value T (S337: NO), the usable color is determined to be the judgment-subject color (S340). The judgment-subject color is used to judge whether the pixels within the small area corresponding to the stitch identified in S332 can be expressed with one usable color.

Next, along the direction of the stitch identified in S332, the coordinates X and Y are varied (increased or decreased) to obtain the next pixel corresponding to the stitch (S341). As aforementioned, the direction of the stitches is the horizontal direction. Therefore, within the small area, the X and Y coordinates of the pixel is increased/decreased in the horizontal direction to identify the next pixel. In the example of FIG. 27, as the next pixel with respect to the beginning 401 of the stitch, the pixel 402 (X1, Y1) is obtained.

In S342, the RGB values of the pixel 402 (X1, Y1) are obtained, and based on the RGB values of the pixel 402 (X1, Y1) and the RGB values of the judgment-subject color set in S340, the color difference distance D is calculated (S343), using the formula (1).

In 344, the calculated color difference distance D and the threshold value T are compared. As a result, if the color difference distance D is greater than the threshold value T (S344: YES), it is determined that the color of the pixel 402 (X1, Y1) is greatly different from the judgment-subject color and cannot be expressed with the judgment-subject color 11 such a case, it is inappropriate to express the pixel 402 (X1, Y1) with the embroidery thread having the judgment-subject color, and the pixels included in the small area corresponding to the stitch are set to be included in the print area (S345).

That is, if process determines that the color difference distance D is greater than the threshold value T (S344: YES), there exists a usable color (i.e., the judgment-subject color) which can be used to express the pixel corresponding to the start point of the stitch, but there exists a pixel within the small area which cannot be expressed with the usable color (i.e., the judgment subject color). In other words, the stitch includes a pixel with the color largely different from the color of the other pixels, and the stitch cannot be expressed with a single color. Since one stitch is formed with one needle-falling operation using a single embroidery thread, it is impossible to change the color thereof in the midway of one stitch. Therefore, in such a case, the pixels corresponding to such a stitch is output by printing.

If the color difference distance D is determined to be equal to or less than the threshold value T (S344: NO), the pixel 402 (X1, Y1) can be expressed using the judgment-subject color. In this case, process judges whether the pixel 402 (X1, Y1) corresponds to the end of the stitch (S346). If the pixel 402 (X1, Y1) does not correspond to the end of the stitch (S346: NO), process returns to S341 to obtain the next pixel and executes the above steps (S341-S346). During such a judgment, if it is determined that a pixel (Xn, Yn) that is obtained in S341 corresponds to the end of the stitch (S346: YES), all the pixels included in the small area corresponding to the stitch can be expressed with the judgment-subject color (i.e., can be expressed with a single color), all the pixels included in the small area are determined to be included in an embroidery area (S347).

In the case of FIG. 27, from the pixel 402 (X1, Y1) to the pixel 403 (Xm, Ym) which corresponds to the end of the stitch, that is, for the pixel (Xn, Yn) (n=1, 2, . . . m), steps S341 through S346 are repeated. If the above pixels can be expressed with the judgment-subject color (i.e., the color difference distance D<threshold value T), all of the pixel 401 (X0, Y0), pixel 402 (X1, Y1), . . . pixel 403 (Xm, Ym) corresponding to the start to end of the stitch are set to be included in the embroidery area.

With the above procedure, it is possible to determine whether the pixels corresponding to the stitch identified in S332 are included in the embroidery area or the print area based on whether the small area is appropriate to be expressed with the embroidery. After steps S339, S345 or S347, if the procedure has not been executed for all the stitches necessary for outputting the image data 4 (S348: NO), process returns to S332, and the next stitch which is subjected to the examination is identified. If the procedure has been executed for all the pixels (S348: YES), process returns to FIG. 22 (S214).

As above, steps S332 through S348 are repeatedly executed and all the stitches assumed to the image data 4 are determined to be included in one of the print area and embroidery area. The image data 4 shown in FIG. 21, the number of stitches assumed in S212 is 360, and the above procedure is repeated for all of the 360 stitches.

Categorization of the pixels into the print or embroidery area as a result of the color continuity examining procedure (S213) will be described using FIG. 21 as an example. In the image data 4, the pixel area 4*a* expressed with black and the pixel area 4*b* expressed with white can be expressed with embroideries. Therefore, in S347 of the color continuity examining procedure (S213), the pixel areas 4*a* and 4*b* are set as the embroidery areas as shown in FIG. 29. On the other hand, in the pixel area 4*c*, the color thereof changes largely. Therefore, the pixel area 4*c* cannot be expressed with the embroidery and, in S345 of the color continuity examining procedure, the pixel area 4*c* is set to be the print area as shown in FIG. 30.

In accordance with the pixel areas 4*a* and 4*b*, which are set as the embroidery areas, and the pixel area 4*c* which is set as the print area, an output pattern 4' shown in FIG. 28 is output on the T-shirt. In the image data 4, the pixel area 4*a* expressed with black (FIG. 29) corresponds to the output area 4*a*' of the output pattern 4' (FIG. 28), and the pixel area 4*b* expressed with white (FIG. 29) corresponds to the output area 4*b*'+ of the output pattern 4' (FIG. 28). The pixel area 4*c* in which the color changes (FIG. 30) corresponds to the output area 4*c*+' of the output pattern 4' (FIG. 28). Further, the embroidery areas A, B and C in FIG. 24 correspond to the output areas A', B' and C' in FIG. 28, respectively. Further, as shown in FIG. 28, the output portions A', B' and C' are included in the output areas 4*a*', 4*b*' and 4*c*', respectively.

That is, based on the pixel area 4*a* set to the embroidery area of the usable color, black, the embroidery with the black thread is formed in the output area 4*a*'. Specifically, on the output portion A' included in the area which can be expressed with the black thread, the embroidery can be formed with the stitch as shown in the embroidery portion A. Similarly, based on the pixel area 4*b* set to the embroidery area of the usable color, white, the embroidery with the white thread is formed in the output area 4*b*'. Specifically, on the output portion B' included in the area which can be expressed with the white thread, the embroidery can be formed with the stitch as shown in the embroidery portion B. Further, based on the pixel area 4*c* which is set to the print area, printing is carried out by the inkjet printer with respect to the output area 4*c*'. As a result, the output pattern 4' as shown in FIG. 28 is formed as a combination of the printed pattern and embroidered pattern on the T-shirt. It should be noted that, in the third embodiment, based on the pixel area 4*c* which is set as the print area, the embroidery with the white thread is formed on the output area 4*c*', which is similar to the first embodiment.

After the color continuity examining procedure (S213A) is finished, the embroidery data creating procedure is executed (S214). The embroidery data creating procedure is similar to that of the first embodiment (FIG. 6, S214).

According the third embodiment, based on the pixel areas 4*a* and 4*b*, which are set as the embroidery areas, the embroidery data creating procedure is executed (S214). Based on the area 4*a*, the embroidery data for the usable color of black is created, and based on the area 4*b*, the embroidery data for the usable color of white is created. Further, for the area other than the embroidery areas (i.e., for the print area), the embroidery data for the white thread is created. Thus, in the example shown in FIG. 29, even for the print area 4*c*, the embroidery data for the usable color of white is created. In this example, the embroidery data for the white thread is created for both the pixel area 4*b* and the pixel area 4*c*. Therefore, in creating the embroidery data, both pixels areas 4*b* and 4*c* can be treated as a single area. Alternatively, the pixel areas 4*b* and 4*c* may be treated separately. In the following description, it is assumed that the embroidery data is created for each color, and thus the pixel areas 4*b* and 4*c* are regarded as a single area.

After the embroidery data for each usable color is created in S214, process executes an embroidery data synthesizing procedure in S215 to synthesize a plurality of pieces of embroidery data into a single data so that the embroidery operation for respective color can be done, in the embroidering machine, at a time. The embroidery data synthesizing procedure in S215 is similar to that in the first embodiment (FIG. 6, S15).

FIG. 31 shows an example of the output pattern 4' based on the synthesized embroidery data created in S215. The output area 4*a*' corresponding to the pixel area 4*a* which is set as the embroidery area for the usable color of black is embroidered with the black thread. The output area 4*b*' corresponding to the pixel area 4*b* which is set as the embroidery area for the usable color of white is embroidered with the white thread. The output area 4*c*' corresponding to the pixel area 4*c* which is set as the print area is also embroidered with the white thread. It should be noted that the synthesized embroidery data also represents the output area of 120 mm×90 mm, and the pattern is output at the designated position on the T-shirt.

After the embroidery data synthesizing procedure in S215, the print data creating procedure is executed. The print data creating procedure is similar to that of the first embodiment (FIG. 6, S16). By the print data creating procedure, the pattern 4' shown in FIG. 32 is output. As is appreciated from FIG. 32, on the output area 4*c*' corresponding to the pixel area 4*c*, an image pattern is printed by the inkjet printer. Since no images are printed on the output areas 4*a*' and 4*b*', in FIG. 32, the areas 4*a*' and 4*b*' are indicated as a blank portions. As is mentioned in the first embodiment, the output size of the pattern 4' is 120 mm×90 mm. Since, in this example, the print resolution is 600 dpi×600 dpi, the output size in units of dot, is 2833 dots×2126 dots as indicated in FIG. 32.

After the print data creating procedure in S216 is executed, the print/embroidery data creating procedure is executed. This procedure is similar to that of the first embodiment (FIG. 6, S216).

Similar to the first embodiment, the embroidery data is input to the embroidering machine, and the pattern shown in FIG. 33A is embroidered on the T-shirt. The size of the embroidered pattern is, as mentioned above, 120 mm'×90 mm.

After the embroidering operation, the output pattern 4*c*' shown in FIG. 33B is printed by the ink jet printer. As a result, as shown in FIG. 33C, the output pattern 4' is formed as a combination of the embroidered pattern shown in FIG. 33A and printed pattern shown in FIG. 33B.

In the print/embroidery data creating device 1A according to the fifth embodiment, the pixels included in the small area corresponding to a stitch are analyzed. If all the pixels corresponding to the usable color, the small area is set as the embroidery area, while if at least one of the pixels does not correspond to the usable color, the area is defined as the print area. Thus, based on the image data, areas appropriate to the embroidery are formed with embroidering, while areas appropriate to the printing are formed with printing.

FIGS. 34A-34C illustrate an image pattern output by a print/embroidery data editing procedure according to a modification of the third embodiment. FIGS. 34A-34C show an embroidered pattern, a printed pattern and a resultant pattern formed on a T-shirt, respectively. In this modification, similar to the second embodiment, only the areas set as the usable color areas are embroidered, and only the printed image is formed in the print area.

FIG. 34A shows embroidery data, which indicates that only the pixel areas 4*a* and 4*b* are set as the embroidery areas. FIG. 34B shows the print data, which is similar to the print data according to the third embodiment (FIG. 33B). As the embroidery pattern shown in FIG. 34A and the print pattern shown in FIG. 34B are formed, the image pattern shown in FIG. 34C is finally formed on the T-shirt. The other features are similar to those of the second embodiment.

Fourth Embodiment

When an image is printed, depending on whether areas are embroidered area or not, the permeability may be different. That is, even through an image is printed on a single piece of fabric (e.g., T-shirt), the permeability may be different depending on the areas. According to the fourth embodiment, such difference in permeability is taken account when an image is printed.

FIG. 35 shows an exemplary structure of a color conversion table stored in a color conversion table storing area 72 (see FIG. 1). According to the fourth embodiment, the color conversion table is configured to indicate values for each of a plurality of ink ejection levels.

The table shown in FIG. 35 has level column 7221, input RGB column 7222 and output CMYK column 7223. If the user of the print/embroidery data creating device 1 has designated the ink ejection level, the values at the designated ink ejection level are referred to when the conversion is performed. Further, in this embodiment, level 5 represents a default ink ejection level. That is, if the ink ejection level has not been designated by the user, the conversion table values at level 5 are used for conversion.

Next, an operation of the print/embroidery data creating device 1 configured as above will be described with reference to flowcharts shown in FIGS. 36 through 40, and exemplary screen images shown in FIGS. 42 though 44.

FIG. 36 is a flowchart illustrating a main procedure of the image editing device 1. In the main procedure shown in FIG. 36, a displaying procedure for displaying the input image data of the scanned image on the display 24, an area designating procedure for designating a certain area of the image data displayed on the display 24, an embroidery data creating procedure for creating the embroidery data when the embroidery is to be formed on the object, a print data crating procedure for creating the print data to be transmitted to the inkjet printer 26, and other procedure such as well-known image processing are selectively executed.

When the procedure is started, process judges whether the user has instructed to display the input image data (S2). As described above, the input image is preliminarily prepared by the user and stored in the input image data storing area 322. The input image may represent an image (e.g., drawn on a sheet and) scanned by the scanner 25, an image captured by a digital camera and input to the image editing device, or an image prepared as an image data file in the form of JPEG or BMG. When the display of the image data has been instructed (S2: YES), process proceeds to S4 where the image data is retrieved from the input image data storing area 322 and displayed on the screen of the display 24 as shown in FIG. 41.

When the display of the input image has not been instructed (S2: NO), process judges whether the instruction is for scanning of the image on the object (e.g., fabric) placed on the platen of the printer 26 (S6). If it is instructed to scan the surface of the fabric placed on the platen of the printer 26 (S6: YES), process proceeds to S8 and the surface image of the fabric placed on the printer 26 is scanned by the scanner 25 (S8). The scanned image is converted into digital data using an A/D converter (not shown), and stored in the scanned image data storing area 323 of the RAM 13 (S10). Then, in S12, the scanned image data is displayed on the screen of the display 24. Optionally, if the input image data has been displayed on the display 24 in S4, process may display the scanned image data in an overlapped manner, and allow the user to designate the position (one the screen of the display 24) at which the scanned image is displayed. After displaying the scanned image, process returns to S2.

If the scanning is not instructed (S6: NO), process judges whether it is instructed to execute the area designation procedure (S14). For the areas designated in the area designation procedure, the user further designates the ink ejection amount, which will be described later with reference to a flowchart in FIG. 37. If the execution of the area designation procedure is instructed (S14: YES), process proceeds to S16 and executes the area designation procedure. After execution of the area designation procedure, process returns to S2.

If the execution of the area designation procedure is not instructed (S14: NO), process judges whether the creation of the embroidery data is instructed (S18). The image editing device 1 according to the fourth embodiment is capable of creating the embroidery data as well as the print data on the same fabric. If the embroidery data is to be created (S18: YES), process executes the embroidery data creating procedure (S20). The embroidery data creating procedure will be described in detail later with reference to the flowchart shown in FIG. 38. After the execution of the embroidery data creating procedure, process executes an on-embroidery ink ejecting amount designating procedure in which the ink ejection amount is designated on the thus created embroidery data (S22). The on-embroidery ink ejecting amount designating procedure will be described in detail later with reference to the flowchart shown in FIG. 39. After execution of the on-embroidery ink ejecting amount designating procedure, process returns to S2.

If the creation of the embroidery data is not instructed (S18: NO), process judges whether execution of the printing is instructed (S24). If the printing operation is to be executed (S24: YES), process executes the print data creating procedure (S26). The print data creating procedure will be described in detail later with reference to the flowchart shown in FIG. 41. After execution of the print data crating procedure, process returns to S2.

If the printing operation is not to be executed (S24: NO), process judges whether it is instructed to finish the procedure of FIG. 36 (S28). If the process is to be finished (S28: YES), process finishes the image data editing procedure. If the process is not to be finished (S28: NO), other processes corresponding to the instructions are executed (S30), and process returns to S2. Examples of the other processes may be processes of drawing lines and figures, painting, adjusting the contrast/brightness of the image, and the like.

Next, the area designating procedure which is called in S16 of the main procedure (FIG. 36) will be described. FIG. 37 is a flowchart illustrating an area designating procedure. When the procedure start, process retrieves the input image data from the input image data storing area 322 of the RAM 13, and displays the image with a message requesting the user to designate an area on the display 24 as shown in FIG. 42 (S52). It should be noted that, if the scanned image data obtained by the scanner 25 is stored in the scanned image storing area 323, the scanned image data and the input image data are displayed on the display 24 in an overlapped manner. By displaying the scanned image and input image in the overlapped manner, it becomes possible that, at a later stage, the ink ejection amount can be designated with respect to the designated areas with referring to the surface condition of the fabric.

Next, process judges whether the area designation procedure is started based on whether a "START" button is clicked (S54). If the area designation procedure is started (S54: YES), process acquires designation of an area by the user with use of pointing devices such as the mouse 28, tablet and the like, and judges whether the designation is established (S56). It should be noted that the designation method above allows the user to arbitrarily designate an area, but the method is an exemplary one and any other designation method such as selection of a layer, selection of areas of the same color, and the like can be employed optionally or alternatively.

If the designation has not been established (S56: NO), process returns to S54 and judges whether the designation of the area should be started again. If the designation is established (S56: YES), a dialogue for designating the ink ejection amount for the established designated areas, as shown in FIG. 43, is displayed on the display 24 (S58). Initially, the ink ejection amount designating dialogue is displayed with the default ejection level (e.g., level 5) being selected, and process judges whether the ink ejection amount has been changed with respect to the default level (S60). If the ink ejection amount has been changed with respect to the default level (S60: YES), the designated ink ejection amount level is stored in the ejection amount storing area 324 of the RAM 13 together with the positional information of the designated area (S62). The stored ink ejection level is displayed on the display 24 such that different levels are indicted by different colors as shown in FIG. 44. For example, in FIG. 44, an area of level 5 is indicated as a grey area 101 and an area of level 4 is indicated as a block area 102. If the ink ejection amount has not been changed with respect to the default value (S60: NO), the default ink ejection level (i.e., level 5, in the fourth embodiment) is stored together with the positional information (S64).

As the ink ejecting amount has been set in S64 or S66, process judges in S66 whether designation of the next are is instructed. If the next area is to be designated (S66: YES), process returns to S54 and above-described steps are repeated for the next area. If designation of the next area is not instructed (S66: NO), process determines that designation of the ink ejection levels for all the designated areas have been finished, finishes the area designation procedure and returns to the main procedure in FIG. 36.

If a "CANCEL" button is clicked in the dialogue shown in FIG. 42, and process determines that the area designation is not started (S54: NO), it may be possible that the entire area of the input image data is designated as the designated area. Therefore, process determines that the entire area is designated in S68. For example, the printing operation is usually executed for cotton, but polyester material having less moisture-absorption property, or less permeability is to be used in the subsequent printing operation, the entire area is designated, and the ink ejection amount in the entire area can be temporarily reduced. In such a case (i.e., when the entire area is designated) (S68: YES), an ink ejection amount designating dialogue as shown in FIG. 43 is displayed on the display 24, and process moves to steps for designating the ink ejecting level (S58-S64). If the entire area is not designated (S68: NO), process proceeds to S66 and judges whether the designation of the next area is instructed.

It should be noted that in the above-described embodiment, the ink ejection amount is manually designated by the user for each designated area. It may be convenient if a test pattern is stored, for example, in the HDD 70 and is actually printed on the fabric. By checking the thus printed pattern with eyes, the used can determine appropriate ink ejection amount easily.

Next, the embroidery data creating procedure will be described in detail. FIG. 38 is a flowchart illustrating the embroidery data creating procedure called in S22 of the main procedure shown in FIG. 36. The embroidery data can be created in accordance with a conventional method. Examples of the embroidery data creation method are disclosed in Japanese Patent Provisional Publications No. P2001-259268A and No. P2003-230782A. Since the method is basically known, characteristic features of the embroidery data creation procedure will be described herein.

When the embroidery data creating procedure is started, the input image data, which represent an image of an object to be embroidered, is retrieved from the input image storing area 322 of the RAM 13 and display the image on the display 24 as shown in FIG. 41 (S142). Next, process designate an area for which the embroidery data is to be created within the displayed image (S142). For example, with respect to the sunflower shown in FIG. 41, if the center of the flower and some flower petals are embroidered, those areas are designated as embroidery areas as shown in FIG. 45.

Next, process allows the user to designate stitch data for the designated embroidery areas (S146). In this step, as in the known embroidery data creating software, a type of the stitch (e.g., running stitch, column fill stitch, satin stitch), and a stitch pitch (i.e., stitch density). Next, process lets the user select a type of thread and color thereof (S148). For example, the user may select a polyester thread, the color of which is white. In S149, process judges whether there is a subsequent embroidery area. If there are a plurality of embroidery areas, the above selections are made for each area. If there is a subsequent embroidery area (S149: YES), process returns to S146 and the stitching data for the area is designated by the user. When all the embroidery areas are processed (S149: NO), the embroidery data is displayed on the display 24 as shown in FIG. 46 (S150).

The embroidery data could be output as it is. However, the image editing device 1 is capable of executing both the embroidering operation and printing operation on the object (fabric). Therefore, in S152, process judges whether an image is displayed by synthesizing the print data and the embroidery data based on the input of the user. If the user instructs to display the synthesized image (S152: YES), the image based on the synthesized print and embroidery data is displayed on the display 24 as shown in FIG. 47. Thereafter, the embroidery data is output (S156) and process returns to the main procedure shown in FIG. 36. The embroidery data may be written in a memory card which an embroidery machine can access, or directly transmitted from the image editing device 1 to an embroidery machine via, for example, an USB (not shown). If the display of the synthesized image is not instructed (S152: NO), the embroidery data is output without displaying the synthesized image (S156), and process returns to the main procedure shown in FIG. 36.

FIG. 39 is a flowchart illustrating the ejection amount designating procedure which is called in S22 of the main procedure shown in FIG. 36. If the embroidery data is created in the embroidery data creating procedure (FIG. 38), the areas which are embroidered will have different permeability in comparison with the areas which are not embroidered the on-embroidery ink ejection amount designating procedure is for automatically designating the ink ejecting amount in the embroidered areas.

In S82, process judges whether a currently selected area is an embroidery area (i.e., an area which will be embroidered). If the currently selected area is not the embroidery area (S82: NO), process finishes the ink ejection amount designating procedure and returns to the main procedure since the ink ejection amount designating procedure has been executed for all the embroidery areas.

If the currently selected area is the embroidery area (S82: YES), process judges whether the embroidery data in the currently selected area represents the "column fill stitch with a stitching pitch of 2 mm or less" (S84). If the embroidery data represents the "column fill stitching with a stitching pitch of 2 mm or less" (S84: YES), process sets the ink ejection amount level to level 5, which is a little less than the default amount, and stores the set level in the ink ejection amount storing area 324 with the positional information of the embroidery area (S86).

If the embroidery data does not represent the "column fill stitch with a stitching pitch of 2 mm or less" (S84: NO), process judges whether the embroidery data represents the "satin stitch with a satin width of 4 mm or more" (S88). If the embroidery data represents the "satin stitch with a satin width of 4 mm or more" (S88: YES), process sets the ink ejection amount level for the area to level 2 and stores the set level in the ink ejection amount storing area 324 with the positional information of the embroidery area (S90).

If the embroidery data dose not represent the "satin stitch with a satin width of 4 mm or more" (S88: NO), process sets the ink ejection amount level for the area to level 3 and stores the set level in the ink ejection amount storing area 324 with the positional information of the embroidery area (S92).

With the processes in S86, S90 or S92, the ink ejection amount is set for the currently selected area and stored in the ink ejection amount storing area 324. Therefore, process proceeds to S94 and judges whether the ink ejection amount level should be set for a subsequent area (S94). If it is necessary to set the ink ejection amount level for the subsequent embroidery area (S94: YES), process returns to S82, and above-described process is repeated. If it is unnecessary to set the ink ejection amount level for the further embroidery areas (S94: NO), since setting of the ink ejection amount for all the embroidery areas has been finished, process finishes the ink ejection amount designating procedure and returns to the main procedure (FIG. 36). As above, for the embroidery areas, the user need not designate the areas and ink ejection amount therefor since process automatically selects the embroidery areas and set the ink ejection amount in accordance with the embroidery data. Therefore, without the user's operation, the print data optimized for the fabric formed with the embroidery can be created.

FIG. 40 is a flowchart illustrating the print data creating procedure called in S26 of the main procedure sown in FIG. 36. The print data is created based on the input image data stored in the input image data storing area 322 of the RAM 13 and the ink ejection amount levels of the designated areas stored in the ink ejection amount storing area 324 of the RAM 13. According to the embodiment, the input image data is configured such that each pixel has RGB values. Therefore, in the print data creating procedure, the RGB color values of each pixel are read, and based on a color conversion table corresponding to the ink ejection amount level for the area in which the pixel located, the RGB color values are converted into the CMYK color values.

In S102, the RGB color values of the first pixel data are read. Then, the ink ejection amount level corresponding to the area in which the currently processed pixel (hereinafter, referred to as a notice pixel) is located is retrieved from the ink ejection amount storing area 324 (S104). In S106, process judges whether the retrieved ink ejection amount level is equal to level 5. If the retrieved ink ejection amount level is equal to 5 (S106: YES), process converts the RGB values to the CMYK values in accordance with the color conversion table for level 5, and stores the converted CMYK values in the print data storing area 321 (S108). Then, process judges whether there are unprocessed pixels (S110). If there is another pixel to be processed (S110: YES), process returns to S102 and above-described conversion process is executed.

If the retrieved ink ejection amount level is not 5 (S106: NO), process judges whether the ink ejection amount level is 4 (S112). If the ink ejection amount level is 4 (S112: YES), process converts the RGB values to the CMYK values in accordance with the color conversion table for level 4, and stores the converted CMYK values in the print data storing area 321 (S114). Then, process judges whether there are unprocessed pixels (S110). If there is another pixel to be processed (S110: YES), process returns to S102.

If the retrieved ink ejection amount level is neither 5 or 4 (S106: NO; S112: NO), process judges whether the ink ejection amount level is 3 (S116). If the ink ejection amount level is 3 (S116: YES), process converts the RGB values to the CMYK values in accordance with the color conversion table for level 3, and stores the converted CMYK values in the print data storing area 321 (S118). Then, process judges whether there are unprocessed pixels (S110). If there is another pixel to be processed (S110: YES), process returns to S102.

If the retrieved ink ejection amount level is not 5, 4 or 3 (S106: NO; S112: NO; S116: NO), process judges whether the ink ejection amount level is 2 (S120). If the ink ejection amount level is 2 (S120: YES), process converts the RGB values to the CMYK values in accordance with the color conversion table for level 2, and stores the converted CMYK values in the print data storing area 321 (S122). Then, process judges whether there are unprocessed pixels (S110). If there is another pixel to be processed (S110: YES), process returns to S102.

If the retrieved ink ejection amount level is not 5, 4, 3 or 2 (S106: NO; S112: NO; S116: NO; S120: NO), process judges whether the ink ejection amount level is 1 (S124). If the ink ejection amount level is 1 (S124: YES), process converts the RGB values to the CMYK values in accordance with the color conversion table for level 1, and stores the converted CMYK values in the print data storing area 321 (S126). Then, process judges whether there are unprocessed pixels (S110). If there is another pixel to be processed (S110: YES), process returns to S102.

If the retrieved ink ejection amount level is not 5, 4, 3, 2 or 1 (S106: NO; S112: NO; S116: NO; S120: NO; S124: NO), which means that no ink ejection level is set to the area, process determines that the default level of the ink ejection amount level is used. Therefore, process converts the RGB values to the CMYK values in accordance with the color conversion table for level 5 (which is the default level), and stores the converted CMYK values in the print data storing area 321 (S108). Then, process judges whether there are unprocessed pixels (S110). If there is another pixel to be processed (S110: YES), process returns to S102.

When all the pixels are processed (S110: NO), process executes a pseudo-gradation procedure for converting multi-value data to data corresponding to the gradation of the printer 26 (S128). AS the pseudo-gradation procedure, well-known error-diffusion method or Dither method can be used. As a result of the pseudo-gradation procedure, the CMYK print data is created (S130). The print data created as above is stored in the print data storing area 321, and process returns to the main procedure shown in FIG. 36.

The print data stored in the print data storing area 321 of the RAM 13 is transmitted to the inkjet printer 26 in response to the user's instruction. When the embroidery is formed, the user forms the embroidery on the fabric in accordance with the embroidery data created in the above-described procedures, and thereafter, the printing operation is carried out in accordance with the print data which is also created during the above-described procedures. Thereafter, the printed image is fixed, for example, by applying heat, thereby the final product (e.g., T-shirt) having an embroidery and printed image being provided.

As described above, with the image editing device according to the first embodiment, for the embroidery areas, which have been manually designated by the user, appropriate color conversion table is selected and the input image data is converted into the print data. Therefore, even if the material or ink permeation property of the fabric is not even over its surface, the ink ejection amount can be optimized. Therefore, printing can be performed with appropriate color at any portion of the fabric.

Fifth Embodiment

Next, the print/embroidery forming system according to a fifth embodiment will be described. In the fifth embodiment, the inkjet printer and the embroidering machine do not exist independently, but the system is configured as a single apparatus having functions of the printer and embroidering machine. It should be noted that each of the above described first through fourth embodiment can be reconfigured to integrally include the printing function and embroidering function as well as the print/embroidery data creating function.

FIG. 48 is an exemplary flowchart illustrating an overall flow according to the fifth embodiment. FIG. 48 is different from the flowchart of the first embodiment (FIG. 4) in that the embroidering by the embroidering machine and printing by the inkjet printer are executed by the same apparatus. That is, in S206 of FIG. 48, based on the print data and the embroidery data, the embroidering with use of the embroidering function and the printing with use of the printing function are performed. It should be noted that which one of the embroidering and printing is prior to the other may be preliminarily set, or selected by the user before step S206 is executed. The other steps are similar to those of the second embodiment, and will not be described in detail.

According to the fifth embodiment, it is possible to omit troublesome work of exchanging the fabric such as the T-shirt and/or loading the memory cards storing the print data and embroidery data to the printer and embroidering machine, respectively. Further, the shift and errors in the output size and position due to the exchange of the fabric can be prevented, and the consistency between the printed pattern and embroidered pattern can be realized more accurately.

It should be noted that the invention need not be limited to the configurations of the second through fourth exemplary embodiments, and various modifications can be made.

In the above-described embodiments, the stitch data of the embroidery data defines the stitch positions in the X-Y coordinate system intrinsic to the embroidering machine as moving amounts in the X and Y directions. The stitch data in the present invention can be any type of data which indicates the stitches of the output embroidery. The stitch data can be, for example, data that indicates absolute stitch positions with respect to the internal coordinate system defined for the embroidering machine. The embroidery data can indicate embroidery other than the embroidery defined by stitches.

Further, in the second through fourth embodiments, the inkjet printer that prints images on dot basis. However, the printer need not be limited to the inkjet printer. Further, the image to be printed may not be defined on dot basis. For example, the image may be defined in a different manner, for example, in units of point (pt) or pica (pc). Farther, the image may be formed on bit basis, line basis or the like.

In S211 (FIG. 6), the user designate "black" as the usable color. This is only an exemplary designation and the user can designate any color. Further, the user can designate more than one color as the usable colors. The color the user designate is not limited to the colors usable by the embroidering machine. Even if the designated color is not usable by the embroidering machine, a closed color can be assigned. Alternatively, the user may assign different color at a later stage.

In the first embodiment, the print area is embroidered with white thread. It should be noted that the color of the thread for embroidering the print area need not be limited to white, and the color may be selected from the usable colors of the embroidering machine. As the color for the print area, grey or even a transparent color may be used.

Designation of the usable color in S211 by the user may be modified as follows.

FIG. 19 shows a usable color input window, and FIG. 20 shows a thread-color table. According to this modification, a thread-color table, in which a plurality of embroidery thread and color codes thereof are registered in a related manner, is preliminarily provided (FIG. 20). When the usable color is set by the user, the threads registered with the thread-color table are displayed in the input dialogue as show in FIG. 19. The user can select the usable colors by checking the displayed threads. Then, based on the checks made in FIG. 19, thread color information and color codes are obtained from the table shown in FIG. 20, and the table as shown in FIG. 8 may be created. According to such a configuration, the user need not input the color information and color codes. Therefore, the use can designate the usable colors easier.

As described above, the print/embroidery data includes both the print data and the embroidery data. However, by modifying the print/embroidery data creating procedure such that S217 is not executed, the print/embroidery data creating device 1A can be used as a device that creates the print data and the embroidery data separately, but based on the same image data.

It should be noted that a plurality of pieces of embroidery data and/or a plurality of pieces of print data may be synthesized to form a single piece of print/embroidery data.

The print/embroidery data has a particular data structure in which the print data and the embroidery data are included in on piece of data. Therefore, an application that controls the embroidering operation of the embroidering machine may be configured to read only the embroidery data necessary for the embroidering operation, based on the data structure. Similarly, an application that controls the printing operation of the inkjet printer may be configured to read only the print data necessary for the printing operation, based on the data structure. In such a case, the retrieved print data or embroidery data may be converted by respective driver software or the like, and the printing operation or embroidering operation may be executed based on the converted print data or embroidery data, respectively.

The image data uses the RGB format color space. In S211, the usable color is designated according to the RGB format. In the area separating procedure (S213), the color difference distance D is calculated according to the RGB format. The embroidery data and the print data as created also define the color codes in accordance with the RGB format (S214-S217). However, the present invention need not be limited to such a configuration, and any other color space can be employed. For example, the CMYK color space, L*a*b* space, L*u*v* space, YIQ space, YES space and the like can be employed.

The print data converted by the printer driver defines the color codes according to the CMYK color space. It is because the inkjet printer carries out the printing using the CMYK inks. If the inkjet printer uses another print method, the print data may be configured to meet the print method as used. Further, the usable color may also be designated according to any color space as well as the RGB space.

Instead of the print data included in the print/embroidery data described above, data converted by a printer driver or the like and can be interpreted by the inkjet printer may be included in the print/embroidery data. Further, instead of the embroidery data included in the print/embroidery data described above, data converted such that it can be interpreted by the embroidering machine may be included in the print/embroidery data.

As the printing device, the inkjet printer is indicated in the second through fourth embodiments. However, the printing device need not be limited to the inkjet printer, and may be another printing device such as a laser printer or thermal printer. Further, in the above embodiments, as the embroidering device, a home-use embroidering machine is described as an example. Further, the invention is applicable to any type of embroidering device, regardless whether it is a home-use one or commercial use one. That is, the printing device and/or the embroidering device may be any type of device as far as the print data and embroidery data created by the print/embroidery data creating device 1A can be used. Further, as an object on which the image pattern is formed (printed/embroidered) should not be limited to the fabric or T-shirt. Still further, the image data from which the print/embroidery data is created need not be limited to the photographic image, and various types of image data can be used.

What is claimed is:

1. A print/embroidery data creating device that creates print/embroidery data from image data which is a collection of a plurality of pixels, the print/embroidery data being printed by a printer and embroidered by an embroidering machine, the print/embroidery data creating device comprising:

a usable color designating system that allows a user to designate at least one usable color;

an output information setting system that allows the user to set an output size and an output position of each of an embroidery of the embroidery data formed by the embroidering machine and a printout of the print data formed by the printer;

a pixel examining system that examines whether each pixel of the image data corresponds to the usable color;

an area setting system that sets a pixel area, which is a collection of pixels, determined to correspond to the usable color as a usable color area and sets an area which does not correspond to the usable color area as a print area;

an embroidery data creating system that creates embroidery data such that a pixel area set as the usable color area by the area setting system is output as embroidered with a thread having a color corresponding to the usable color, the usable color area being output with the size set by the output information setting system at the position set by the output information setting system by the embroidering machine; and a print data creating system that creates print data such that a pixel area set as the print area by the area setting system is output as printed area with a color corresponding to the pixel color, the print area being output with the size set by the output information setting system at the position set by the output information setting system by the printer.

2. The print/embroidery data creating device according to claim 1, further includes a print/embroidery data creating system that creates print/embroidering data including both the print data and embroidering data.

3. The print/embroidery data creating device according to claim 1, wherein a ratio of a size of the image data in units of pixel to a measurable size of an embroidery formed by the embroidering machine is equal to a ratio of a size of the image data in units of pixel to a measurable size of a printout formed by the printing device.

4. The print/embroidery data creating device according to claim 1, wherein the embroidery data includes:

information indicating color code of each thread and position and size of the embroidery the embroidery data represents; and stitch data indicating stitches for expressing the specific area.

5. The print/embroidery data creating device according to claim 1, wherein the print data includes a pixel area of the image data which has been set as the print area, and position and size of a printout.

6. The print/embroidery data creating device according to claim 1, wherein the embroidery data creating system creates second embroidery data based on a pixel area that has been set as the print area by the area setting system.

7. The print/embroidery data creating device according to claim 6, wherein the second embroidery data includes a color code for white thread, size and position of an embroidery, and stitch data indicating needle fall points of the embroidering machine to express the print area with an embroidery.

8. The print/embroidery data creating device according to claim 1, further including a thread table storing a relationship between a plurality of embroidery thread and color codes thereof, wherein the usable color designating system designates one of the colors corresponding to the codes stored in the thread table as the usable color.

9. The print/embroidery data creating device according to claim 1, wherein the pixel examining system determines that a pixel corresponds to the usable color when a distance of the color of the pixel and the usable color in a certain color space is smaller than a predetermined threshold value.

10. A computer program product comprising computer accessible instructions that cause a computer to serve as a print/embroidery data creating device that creates print/embroidery data from image data which is a collection of a plurality of pixels, the print/embroidery data being printed/embroidered by printer/embroidering machine, the print/embroidery data creating device comprising:

a usable color designating system that allows a user to designate at least one usable color, an output information setting system that allows the user to set an output size and an output position of each of an embroidery of the embroidery data formed by the embroidering machine and a printout of the print data formed by the printer;

a pixel examining system that examines whether each pixel of the image data corresponds to the usable color;

an area setting system that sets a pixel area, which is a collection of pixels, determined to correspond to the usable color as a usable color area and sets an area which does not correspond to the usable color area as a print area;

an embroidery data creating system that creates embroidery data such that a pixel area set as the usable color area by the area setting system is output as embroidered with a thread having a color corresponding to the usable color, the usable color area being output with the size set by the output information setting system at the position set by the output information setting system by the embroidering machine; and a print data creating system that creates print data such that a pixel area set as the print area by the area setting system is output as printed area with a color corresponding to the pixel color, the print area being output with the size set by the output information setting system at the position set by the output information setting system by the printer.

* * * * *